US010342270B2

(12) United States Patent
Stevenson et al.

(10) Patent No.: US 10,342,270 B2
(45) **Date of Patent: *Jul. 9, 2019**

(54) URINATION RELIEF HATCH FOR WATERPROOF WADERS AND FOUL WEATHER GEAR

(71) Applicants: Robert A. Stevenson, Canyon Country, CA (US); Wendy L. Stevenson, Canyon Country, CA (US); Anthony Ismael Lopez, Saugus, CA (US)

(72) Inventors: Robert A. Stevenson, Canyon Country, CA (US); Wendy L. Stevenson, Canyon Country, CA (US); Anthony Ismael Lopez, Saugus, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/050,223

(22) Filed: Jul. 31, 2018

(65) Prior Publication Data

US 2018/0338545 A1 Nov. 29, 2018

Related U.S. Application Data

(60) Continuation of application No. 15/782,846, filed on Oct. 12, 2017, now Pat. No. 10,058,134, which is a (Continued)

(51) Int. Cl.
*A41D 1/08* (2018.01)
*A41D 13/012* (2006.01)

(Continued)

(52) U.S. Cl.
CPC ..... *A41D 1/08* (2013.01); *A41B 9/026* (2013.01); *A41D 13/012* (2013.01); *A41D 13/02* (2013.01);

(Continued)

(58) Field of Classification Search
CPC ..... A41D 1/08; A41D 13/012; A41D 13/02; A41D 2600/106; A41D 2600/108;

(Continued)

(56) References Cited

U.S. PATENT DOCUMENTS 291,854 A 1/1884 Platt
507,466 A * 10/1893 Van Oostrum ..... A41D 13/012 2/82

(Continued)

FOREIGN PATENT DOCUMENTS

EP 1101463 A1 5/2001

*Primary Examiner* — Amy Vanatta
(74) *Attorney, Agent, or Firm* — Hackler Daghighian Martino & Novak

(57) ABSTRACT

A rigid frame is sealed in a waterproof manner to a pair of pants and/or waders, where the frame forms a frame aperture separating an outside from an inside of the pair of pants and/or waders. A rigid lid is pivotably connected to the frame and configured to engage the frame aperture. The rigid lid in an open position allows access through the frame aperture and the rigid lid in a closed position does not allow access through the frame aperture. A seal is disposed between the frame and the lid forming a waterproof closure of the frame aperture when the lid is in the closed position. A latch is pivotably connected to the frame and configured to retain the lid in the closed position. A spring is disposed between the latch and the frame, the spring biasing the latch to retain the lid in the closed position.

20 Claims, 48 Drawing Sheets

Related U.S. Application Data continuation-in-part of application No. 15/355,580, filed on Nov. 18, 2016, now Pat. No. 9,808,037, which is a continuation-in-part of application No. 15/184,119, filed on Jun. 16, 2016, now Pat. No. 9,532,609, which is a continuation-in-part of application No. 14/948,378, filed on Nov. 22, 2015, now Pat. No. 9,380,814, which is a continuation-in-part of application No. 14/542,591, filed on Nov. 15, 2014, now Pat. No. 9,775,385, which is a division of application No. 14/182,295, filed on Feb. 18, 2014, now Pat. No. 8,914,912.

(60) Provisional application No. 61/766,089, filed on Feb. 18, 2013.

(51) Int. Cl.
*A41D 13/02* (2006.01)
*A41B 9/02* (2006.01)
*A41D 1/06* (2006.01)

(52) U.S. Cl.
CPC ..... *A41D 1/065* (2013.01); *A41D 2300/30* (2013.01); *A41D 2600/106* (2013.01); *A41D 2600/108* (2013.01)

(58) Field of Classification Search
CPC ..... A41D 1/088; A41D 1/06; A41D 1/065; A41D 7/00; A41D 7/005; A41D 1/067; A41D 27/00; A41D 3/06; A41D 3/00; A41D 2300/20; A41D 2300/30; A61F 5/448; A61F 2005/4483; A61F 2005/4486; A61F 5/449; A61F 5/453; A61F 5/4556; A61F 5/455; A41B 9/026
USPC ..... 2/82, 2.15, 2.17, 456, 457, 79, 2.11, 46, 2/78.2, 87, 403–405, 408, 227, 234, 901, 2/228, 238; 604/345, 343, 337, 338
See application file for complete search history.

(56) References Cited

U.S. PATENT DOCUMENTS

| | | | | |
|---|---|---|---|---|
| 1,488,536 | A | 4/1924 | Fry | |
| 2,385,816 | A | 10/1945 | Krupp | |
| 2,570,019 | A | 10/1951 | Wolk | |
| 2,746,113 | A | 5/1956 | Williams | |
| 2,853,758 | A | 9/1958 | Topf | |
| 3,034,131 | A | 5/1962 | Lent | |
| 3,107,408 | A | 10/1963 | Huelster et al. | |
| 4,014,044 | A | 3/1977 | Figueroa et al. | |
| 4,274,159 | A | 6/1981 | Schmidt | |
| 4,558,467 | A | 12/1985 | Barditch | |
| 4,568,340 | A | 2/1986 | Giacalone | |
| 4,593,415 | A | 6/1986 | Vykukal | |
| 4,601,085 | A | 7/1986 | Yoshida | |
| 4,888,859 | A | 12/1989 | Horita | |
| 4,892,527 | A | 1/1990 | Livny | |
| 5,159,719 | A | 11/1992 | Aumann | |
| 5,210,879 | A | 5/1993 | Miller | |
| 5,346,483 | A | 9/1994 | Thaxton | |
| 5,367,726 | A | 11/1994 | Chaffee | |
| 5,444,989 | A | 8/1995 | Norvell | |
| 5,539,926 | A | 7/1996 | Mantos | |
| 5,865,820 | A | 2/1999 | Myello | |
| 6,049,913 | A | 4/2000 | Harrigan, Jr. | |
| 6,076,571 | A | 6/2000 | Burns | |
| 6,105,214 | A | 8/2000 | Press | |
| 6,223,349 | B1 | 5/2001 | Roiser | |
| 6,237,621 | B1 | 5/2001 | Chaffee | |
| 6,296,627 | B1 | 10/2001 | Edwards | |
| 6,317,893 | B1 | 11/2001 | Walton | |
| 6,363,531 | B1 | 4/2002 | Quinn | |
| 6,389,598 | B1 | 5/2002 | Westers | |
| 6,438,757 | B1 | 8/2002 | Quinn | |
| 6,508,264 | B2 | 1/2003 | Chaffee | |
| 6,755,208 | B2 | 6/2004 | Chaffee | |
| D507,466 | S | 7/2005 | Hu | |
| 6,920,646 | B2 | 7/2005 | Crye | |
| 6,986,360 | B2 | 1/2006 | Chaffee | |
| 7,025,576 | B2 | 4/2006 | Chaffee | |
| 7,422,578 | B2 | 9/2008 | Shan et al. | |
| D621,130 | S | 8/2010 | Brown | |
| 7,770,235 | B2 | 8/2010 | Lepage | |
| 7,803,144 | B1 | 9/2010 | Vollrath | |
| 7,867,207 | B2 | 1/2011 | Therkelsen | |
| 8,887,757 | B2 | 11/2014 | Moren et al. | |
| 2003/0188368 | A1 | 10/2003 | Stinton | |
| 2004/0069828 | A1 | 12/2004 | Turner | |
| 2008/0078775 | A1 | 4/2008 | Steiger | |
| 2009/0255950 | A1* | 10/2009 | Simkins | A47K 10/3818 221/45 |
| 2015/0135407 | A1 | 5/2015 | Krishnan | |
| 2015/0141944 | A1 | 5/2015 | Hanuka | |
| 2015/0230523 | A1 | 8/2015 | Stevenson | |

* cited by examiner

URINATION RELIEF HATCH FOR WATERPROOF WADERS AND FOUL WEATHER GEAR

CROSS REFERENCE TO RELATED APPLICATIONS

This continuation application claims priority to the continuation-in-part application Ser. No. 15/782,846 filed on Oct. 12, 2017, which itself was a continuation-in-part application claiming priority to Ser. No. 15/355,580 filed on Nov. 18, 2016 which is now U.S. Pat. No. 9,808,037 issued on Mar. 16, 2017, which itself was a continuation-in-part application claiming priority to continuation-in-part application Ser. No. 15/184,119 filed on Jun. 16, 2016 which is now U.S. Pat. No. 9,532,609 issued on Jan. 3, 2017, which itself claimed priority to continuation-in-part application Ser. No. 14/948,378 filed on Nov. 22, 2015 which is now U.S. Pat. No. 9,380,814 issued Jul. 5, 2016, which itself claimed priority to divisional application Ser. No. 14/542,591 filed on Nov. 15, 2014, which itself claimed priority to application Ser. No. 14/182,295 filed on Feb. 18, 2014 which is now U.S. Pat. No. 8,914,912 issued Dec. 23, 2014, which itself also claimed priority to provisional patent application 61/766,089 filed on Feb. 18, 2013, where the contents of all applications are fully incorporated herein with these references.

DESCRIPTION

Field of the Invention

The present invention generally relates to fishing waders. More particularly, the present invention relates to a watertight urination relief hatch for fishing waders, foul weather gear, or aquatic sports wear.

Background of the Invention

Waist and chest waders are commonly used worldwide by both fly fishermen, spin fishermen, hunters and the like. Modern waders typically have built-in feet and in many cases, these are built-in stocking feet or neoprene-type feet or boots. Similar equipment is worn by crab fishermen or other mariners in foul weather situations wherein chest-type rain pants with suspenders are used with a jacket over the top. In a fly or spin fishing application, a fishing vest is normally worn over the wader suspenders and also a foul weather jacket may be placed over top. For example, when a fisherman is in Alaska, it is not unusual for the fisherman to have on a pair of undergarments, such as jeans over a fleece, the chest waders and suspenders, a fly fishing vest, a rain proof over jacket, a wading safety belt, and another belt containing either a canister of pepper spray or a pistol for protection against bears and other wildlife.

For both fishing and foul weather gear applications, the wader or rain protection garment may be worn for many hours or even an entire day. Hunting waders are also very popular. Hunting waders come in a variety of camouflage patterns and accommodate the hunter who is wading through bogs or tundra or even lakes (for example—duck hunters). Another name for these systems is "Waders With Bibs." One is referred to any search engine of the internet where one can enter the search term "waders" and see the wide variety that is available. Fishing wader manufacturers include Cabela's®, Orvis®, Simms®, Redball®, Hodgman® and many others. Waders can either be simple waders or rain protection suits. Pants or chest high waders can be rubber or of modern high technical fabrics that breathe, such as Gore-tex®.

Taking the waders and all of this equipment off to urinate is a real hassle. Not only is it inconvenient, but in a driving rain storm, one can get very wet during the process. For an Alaska fly fisherman, taking off and laying down your fly fishing vest and jacket often results in it being laid along the muddy banks of a river or worse. Furthermore, taking off all of the gear could temporarily leave a fisherman or hunter without access to a firearm or bear spray if the need to defend themselves from wildlife occurred at that same moment. Even if this unfortunate situation never happens, it is still quite disconcerting to the fisherman or hunter every time they need to remove their gear and put themselves in greater harm.

Dehydration is another important issue which can happen to a fly fisherman or hunter. With the advent of modern breathable waders, it is now possible to hike for many miles wearing your waders. In July and August of 2012, the inventors of this patent application extensively fished Southeast Alaska's rivers and streams. The inventors found there is a tendency to drink very little water because it is so much of a hassle to remove all of the gear and the waders to urinate. Leg cramps and other symptoms due to dehydration became apparent on many occasions. This is simply an unhealthy situation. What is needed is to allow a fisherman or hunter wearing a wader to drink as much as they would like and still be able to relieve themselves in a quick and efficient manner.

Many have already attempted to address such issues and concerns, yet were either unsuccessful or unable to bring their inventions to market. Orvis's® U.S. Pat. No. 7,770,235 describes a typical modern fishing wader consisting of a lightweight nylon-faced laminate material utilizing tape or sonic welds to achieve a durable, lightweight and comfortable wader. The '235 patent has no provision to facilitate urination. However, a number of rubber clothing or wader patents do disclose features for urination. For example, U.S. Pat. No. 291,854 to Platt shows a strapped opening in the front of the wader with folds to prevent water entry. This is, of course, a very crude and cumbersome approach compared to the present invention.

U.S. Pat. No. 2,385,816 illustrates a waterproof sealing closure zipper, which again, is very difficult and cumbersome to use and also, is not completely waterproof during long-term immersion, for example, in a river or a lake.

U.S. Pat. No. 2,570,019 illustrates a protrusion with a drawstring to facilitate urination. This has a number of obvious disadvantages. Not only is it aesthetically unacceptable, it would also tend to be very messy.

U.S. Pat. No. 2,746,113 illustrates yet another type of waterproof zipper, which again, is not completely waterproof during long-term immersion.

U.S. Pat. No. 2,853,758 shows a method of rolling the fabric tightly and then clamping it down to attempt a waterproof seal. This also has a lacing structure over it. Of course, all of this would be very cumbersome and probably no more efficient than simply removing the garment.

U.S. Pat. No. 4,274,159 illustrates a type of tube with a roll-up and a waterproof zipper. It is aesthetically unacceptable, messy and also cumbersome.

U.S. Pat. No. 4,601,085 illustrates a water resistant slide fastener which appears very cumbersome and difficult to use in practice.

U.S. Pat. No. 4,888,859 also illustrates a water tight slide fastener which appears to be not completely waterproof during long-term immersion.

U.S. Pat. No. 5,210,879 illustrates waders equipped with an opening and closing means to allow fisherman to urinate without having to draw the garment down. However, this opening is in the form of a tubular member, which must be coiled and then closed over with Velcro® to prevent ingress of water. Again, this is aesthetically not pleasing, messy and it is also dubious whether this would truly form a water tight seal.

U.S. Pat. No. 5,444,898 illustrates another type of water resistant closure, involving a slide fastening assembly and a pair of stringer tapes integrated with waterproof fabric. In the field, this would be difficult to use and very difficult to close back up again.

U.S. Pat. No. 6,105,214 illustrates a water resistant slide fastener with gripper elements positioned along the edges. Again, this looks like it would be very difficult to use and is of dubious quality during long-term immersion.

U.S. Pat. No. 6,223,349 illustrates a closure device for a slit opening of an aquatic sports suit. This is a type of zipper closure that may or may not be waterproof during total immersion. In any event, it would be difficult to use in the field and impractical for a chest wader. Most waders come up to well above the waist area. The drawing shown in FIG. 5 of the '349 patent is really not practical. In other words, one is not going to be able to open up the zipper at the top of the garment analogous to a pair of Levis. This is because the wader typically goes up onto the chest where there may be one or more pockets for holding fly fishing boxes and the like. This is an essential problem with all of the zipper approaches in that there is really no way to open them in the traditional way at the top. This is because the garment goes a very long way above the groin area. Zipping the entire garment, from the chest all the way down to the groin then involves pockets, a safety belt and the suspenders which rapidly becomes very impractical.

U.S. Pat. No. 6,317,893 is a good illustration of a prior art wader with a safety belt 24 and suspenders 14. This particular invention does not have provision for urination, but does illustrate the difficulty of removing the wader and pulling it down. Wader safety belt 24 is essential because if the person wearing the wader were to slip in a river or a lake, the wader legs would very quickly fill with water which could immediately add a lot of weight to the system and be life-threatening. Accordingly, one or more wader belts 24 or 18 are worn to prevent such water ingress into the system. Even if the water was not life-threatening, it would certainly wet the undergarments and make the wearer very wet and miserable for the remainder of the day.

U.S. Pat. Nos. 6,363,531 and 6,438,757 illustrate types of waterproof zippers. The '757 patent shows a zipper that is designed with a flap enclosure at the top so that it would not have to be zipped all the way up the chest area. However, the next problem it ensues is one ends up with a very narrow slit, in terms of enough of an opening, to be able to conveniently urinate.

U.S. Pat. No. 6,389,598 illustrates a sealably accessible wader system. This particular invention attempts to create a wader material that forms an opening. A removably discrete and separate closure element is detachable from the wader. This creates problems in that the closure element must be placed on the ground during urination or held with one of the user's hands. This can become awkward and difficult to operate when in use. If the closure element is placed down on the ground it can become soiled and then later interfere with the watertight seal when reattached. There is no provision to attach the closure element to the wader where it does not interfere with the urination process. Furthermore, this particular invention does not disclose or teach how such a structure will be manufactured as the wader material is not a suitable material to be used to form a water tight hatch. Wader material is substantially flexible, malleable and flowing and does not hold its shape because it is not substantially rigid. The disclosure of the patent fails to enable one skilled in the art to actually practice the invention because its structures cannot be manufactured nor do the structures work in reality.

Accordingly, there is a need to provide a convenient access hatch in the wader or equivalent garment, which can be easily flipped open allowing the wearer to urinate without removing any of the other garments, belts or accessories. None of the prior art illustrates a sealed enclosure area with a hinged lid, which can be quickly opened. The present invention provides a hinged access cover which can be round, oval or of many shapes that when shut provides a high integrity waterproof seal. It is provided with a quick release snap so that it can be opened quite readily. The opening is sufficiently large to conveniently access undergarments and to be able to urinate, and the entire system does not feature tubes or tunnels, which could become messy during urination. In addition, the access cover is provided with a convenient attachment mechanism so that it can be put up out of the way during the process. It is readily closed by snapping it back into place and once again forming a waterproof seal for the wader or garment. The present invention fulfills the needs discussed above and provides other related advantages.

SUMMARY OF THE INVENTION

An exemplary embodiment of a rainproof pair of pants and/or a waterproof pair of waders includes a sealable opening for relief of bodily fluids, comprising a pair of pants and/or waders comprising a first and a second leg portion. The first and the second leg portions are joined to a torso portion terminating generally at or between a waist and a neck of a wearer. The pair of pants and/or waders comprise a substantially waterproof material. The pants are configured to overlap a separate pair of boots and/or the waders are configured to be integrally attached to a pair of boots. A rigid frame is sealed in a waterproof manner to the pair of pants and/or waders disposed in a groin section of the pair of pants and/or waders. The frame forms a frame aperture separating an outside of the pair of pants and/or waders from an inside of the pair of pants and/or waders. A rigid lid is pivotably connected to the frame disposed on the outside of the pair of pants and/or waders and configured to engage the frame aperture. The rigid lid in an open position allows access through the frame aperture and the rigid lid in a closed position does not allow access through the frame aperture. A seal is disposed between the frame and the lid forming a waterproof closure of the frame aperture when the lid is in the closed position. A latch is pivotably connected to the frame and configured to retain the lid in the closed position. As can be seen in this design, the latch is no longer made as a contiguous and continuous part of the frame, but rather is separately made and then later pivotably attached. A spring is disposed between the latch and the frame, the spring biasing the latch to retain the lid in the closed position. Note that the use of the word "pivotably" is synonymous with "pivotally" as they both mean of, relating to, or serving as a pivot.

In other exemplary embodiments, the latch may be separately manufactured component in relation to the frame and/or the lid. The frame and the latch may be different materials. The frame may be plastic and wherein the latch may be metallic. The frame and the latch may be made from different plastic materials. A pin may be attached to the frame by an interference fit, wherein the latch is pivotable about the pin. The spring may be a torsion spring.

A first pin may be attached to the frame by an interference fit, wherein the latch is pivotable about the first pin. A second pin may be attached to the lid by an interference fit, wherein a distal end of the latch is configured to hook onto the second pin and retain the lid in the closed position. Other embodiments may include a metallic sleeve disposed over a portion of the second pin, where the metallic sleeve is rotatable about the second pin and the distal end of the latch is configured to hook onto the metallic sleeve to retain the lid in the closed position.

A movable lockout feature may be attached to either the lid and/or the frame, wherein the lockout feature in a first position is configured to prevent the opening of the latch, and wherein the lockout feature moved by the user to a second position is configured to allow the opening of the latch.

A cam may be formed as part of the lid and/or the frame disposed at or near a pivot between the lid and the frame, wherein the cam is configured to bias the lid into remaining in the open position once the lid is moved into the open position.

The frame may define a three-dimensional coordinate system located at its center of mass, the frame coordinate system having a x-axis pointing towards a top of the frame, a y-axis pointing towards a side of the frame and a z-axis pointing through the frame aperture towards the inside of the pair of pants and/or waders; wherein, when the density of the frame is first set to be 0.04 pounds per cubic inch (lbs*in3) and when the frame and lid are scaled so an area of the frame aperture is first set to be 7.205 inches squared (in2), then the following is true: a mass moment of inertia taken at the frame center of mass about the frame x-axis is equal to or greater than 0.19 pound square feet (lbs*in2); and a mass moment of inertia taken at the frame center of mass about the y-axis is equal to or greater than 0.27 pound square feet (lbs*in2).

The frame may define a three-dimensional coordinate system located at its center of mass, the frame coordinate system having a x-axis pointing towards a top of the frame, a y-axis pointing towards a side of the frame and a z-axis pointing through the frame aperture towards the inside of the pair of pants and/or waders; wherein the lid defines a three-dimensional coordinate system located at its center of mass, the lid coordinate system having a x-axis pointing towards a top of the lid, a y-axis pointing towards a side of the lid and a z-axis pointing towards the inside of the pair of pants and/or waders; wherein, when the density of the frame and lid are the same, a mass moment of inertia taken at the frame center of mass about the frame x-axis and frame y-axis are greater respectively than a mass moment of inertia taken at the lid center of mass about a lid x-axis and a lid y-axis.

The frame and lid may be scaled so an area of the frame aperture is first set to be 7.205 inches squared (in2), then the following is true: the frame has a surface area equal to or greater than 45.97 square inches (in2); and the lid has a surface area equal to or less than 61 square inches (in2).

When the frame and lid are scaled so an area of the frame aperture is first set to be 7.205 inches squared (in2), then the following may be true: the lid has a volume equal to or less than 3.50 cubic inches (in3); and the volume of the frame is equal to or greater than 2.64 cubic inches (in3).

The frame aperture may comprise a shape of a larger circular arc at least partially overlapping a smaller circular arc, wherein the larger circular arc is disposed at a top of the frame aperture and the smaller circular arc is disposed at a bottom of the frame aperture.

The frame aperture may comprise a shape of a larger contoured aperture at least partially overlapping a similarly shaped smaller contoured aperture, wherein the larger contoured aperture is disposed at a top of the frame aperture and the smaller contoured aperture is disposed at a bottom of the frame aperture.

An adhesive bond may be disposed between a back side surface of the frame and the waterproof material of the pair of pants and/or waders, wherein the back side surface of the frame comprises a non-smooth surface.

A rigid backing may form a backing aperture, wherein a first surface of the backing and a back side surface of the frame capture there between the waterproof material of the pair of pants and/or waders in the groin section; including at least one adhesive bond disposed between the back side surface of the frame and the waterproof material of the pair of pants and/or waders, and/or, between the first surface of the backing and the waterproof material of the pair of pants and/or waders; wherein the backing aperture and frame aperture are substantially aligned; and wherein the backing aperture is equal to or greater in surface area in comparison to the frame aperture A middle line may be defined horizontally across the frame aperture equal distance between a top and a bottom of the frame aperture separating a top half of the frame aperture from a bottom half of the frame aperture, wherein the top half of the frame aperture comprises a larger amount of surface area as compared to the bottom half.

A weld, a hot air weld, a hot wedge weld, a radio frequency weld, a sonic weld or an ultrasonic weld may attach the waterproof material of the pair of pants and/or waders to the frame.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
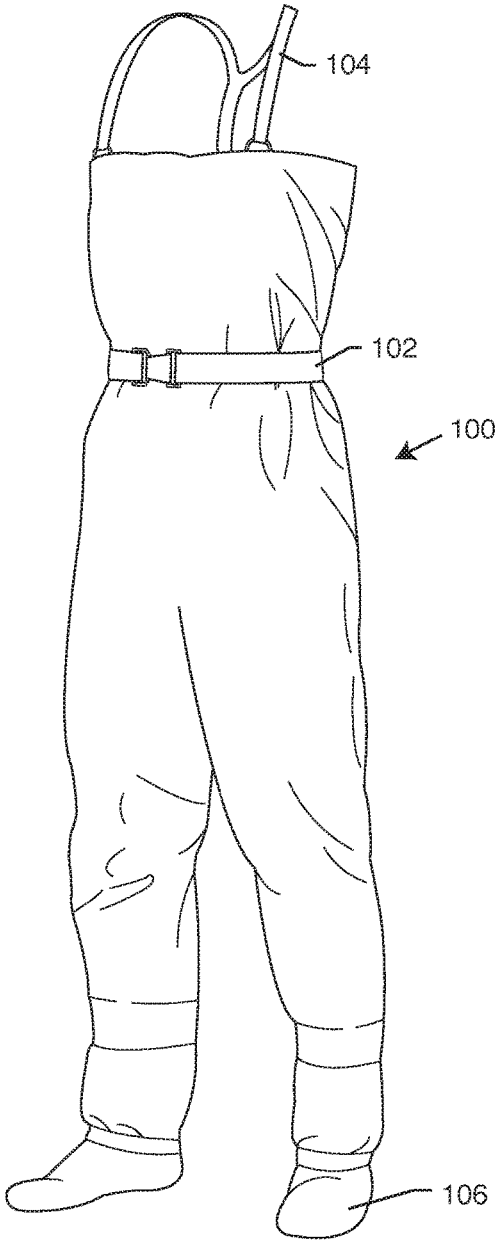
FIG. 1 PRIOR ART
FIG. 1 is a perspective view of a prior art wader.

FIG. 1 illustrates prior art chest waders 100. These are also equivalent to prior art rain gear. The chest wader 100 may be of rubber, various breathable membranes, such as Gortex® neoprene or any other fabric. In a wading application, a safety belt 102 is typically worn. This is a tightly or snugly fitting belt which prevents the rapid ingress of water into the lower part of the waders if one should, for example, slip into a deep pool in a river. The suspenders 104 are worn over the shoulders and keep the waders held up in place.

Referring once again to FIG. 1, the waders can actually include an entire family of similar garments. As defined herein, the term "wader" includes chest high waders, waste high waders, foul weather or rain suits, exposure suits, ice rescue suits, survival suits and water rescue dry suits. The term "wader" is also extendable to any type of scuba diving gear, whether they be wet or dry suits. In the broadest sense, the term "wader" as used herein refers to any type of waterproof clothing. In one embodiment, the "wader" could be rain gear where the feet 106, instead of being sealed to the wader pants, are actually a separate boot and the garment 100 is slipped down over the boots thereby keeping water from entering the boot. In a similar fashion, a rain jacket would be worn (not shown) over the wader along with a built-in hood or a hat. These types of heavy duty marine rain gear systems are worn throughout, for example, the Pacific Northwest where crab fishermen or other fishermen are on the ocean in extreme weather conditions. Ocean passage makers, such as sailors, have similar foul weather gear requirements, particularly for exposure suits.

Applications for waders 100 with built-in feet 106 include both traditional and fly fishermen as well as duck hunters and many other types of outdoor sports. For example, the present inventors have used waders extensively in Alaska where one not only wears the waders, but also a rain-type jacket over which (or under) is also placed a fly fishing vest. In addition, there is another belt (not shown) typically disposed somewhat below the safety belt 102, which can contain a firearm, pepper spray, a knife or similar items. The present inventors also wore hand-held radios, for example, on a belt clip.

It is very important when you are hiking and wading to stay properly hydrated. The inventors found this to be a significant problem because urination is not easy when wearing such a system as illustrated in FIG. 1 and as described. In order to urinate you first have to remove your belt containing the accessories, such as the gun, pepper spray canister and the radio. You also need to remove the fly fishing vest with all of its pockets and the rain jacket. Then you must remove the safety belt 102 and then remove the suspenders 104 at which point you are finally ready to drop down the waders to the point wear you can unzip your pants or pull down your fleece in order to perform the act of urination. When staying properly hydrated, this means, for an average adult male, that this process may be repeated from 5 to 10 times a day. Add the fact that many, if not most, fishermen are male and are in the upper age ranges (i.e. with enlarged prostates) meaning that the urination frequency becomes an enormous problem.

Figure 2:
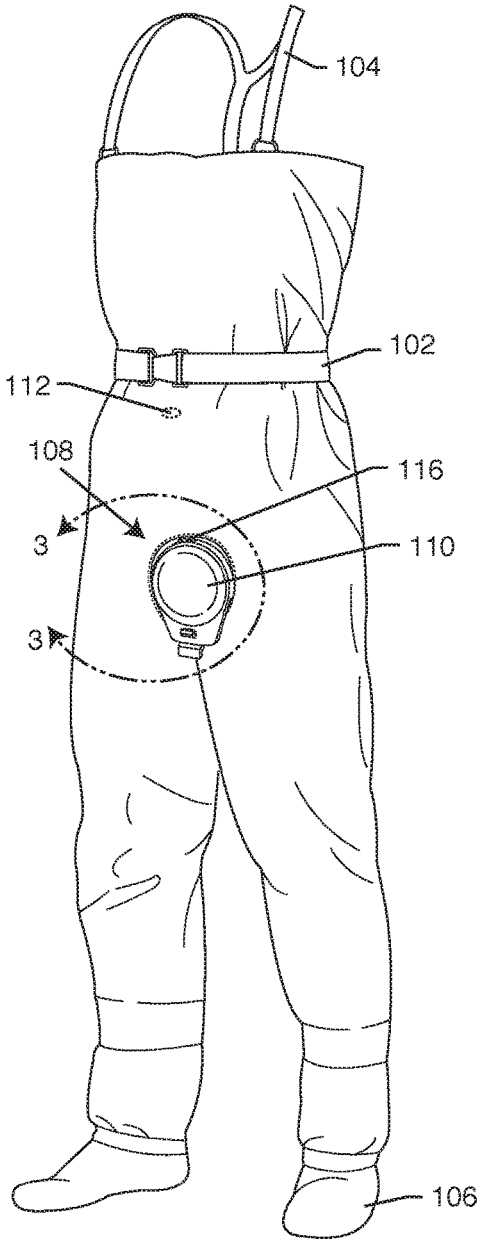
FIG. 2 is a perspective view of a wader with an exemplary relief hatch embodying the present invention.

FIG. 2 is very similar to FIG. 1, but illustrates the present invention of a urinary relief hatch assembly 108 including a lid 110 as shown. This urinary relief hatch 108 can come in many forms as will be shown in subsequent drawings. In general, it has a hermetic watertight seal and a hinge 116 so that it can be easily raised up. In this case, there is either a hook-and-loop fastener patch, a snap, a magnet or the like 112 which holds the urinary relief lid conveniently up in place. The present invention is best worn with the correct undergarments, such as a fleece with a large flap instead of a zipper so one may easily access the penis. As will be shown in an alternative embodiment in FIG. 19, it is also possible for the urinary relief lid 150 to fold downward and simply hang by gravity below the opening in the waders. It is also important that the urinary relief lid 110 be sufficiently large in diameter cross-section to easily access the undergarments. This also makes it easy for a female to use the system along with a complimentary urination device, such as the GoGirl™. The GoGirl™ is a flexible and soft rubber-like structure that allows women to urinate while standing up. It is a hygienic, portable discrete and reusable device that can be used in concert with the present invention. It would be easy for a female to use a device, such as the GoGirl™ by opening the lid 110 of the present invention and then inserting the GoGirl™ such that it channels bodily fluid out through the open lid 110.

Figure 3:
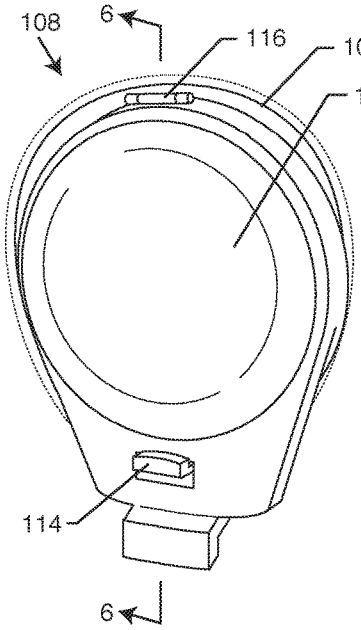
FIG. 3 is a close-up perspective view of the relief hatch in FIG. 2.

FIG. 3 is taken from section 3-3 from FIG. 2 and shows the urinary relief lid 110 in an enlarged view. Shown is a quick and convenient release snap 114 which is activated by simply pushing down with one's thumb. The lid 110 automatically flaps open as it is compressed against a rubber O-ring seal (gasket, compressible washer) or the like attached to the base 105, which naturally acts as a spring to keep it firmly seated, but also make it open on its own. Also shown is the hinge 116 which in this embodiment, is shown on top of the urinary relief hatch.

Figure 4:
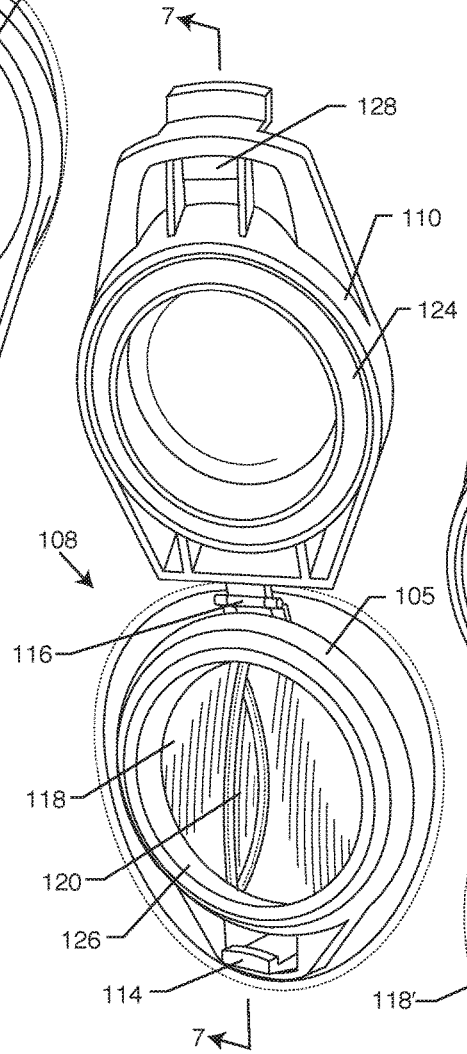
FIG. 4 is a view similar to FIG. 3 now showing the relief hatch in the open position.

FIG. 4 is the same as FIG. 3, but it shows the relief lid 110 in the open position away from the base 105. The snap 114 has been pushed down so that it disengages from the snap retainer 128 thereby allowing the entire relief lid 110 to pivot on its hinge assembly 116. A garment 118 is shown through the relief hatch. In this case, the garment is some sort of a long underwear or fleece. There is an optional flapped opening 120 for convenient access to the penis. Some types of similar garments do not have such a flap, however, during experimentation the inventors found it very easy to pull down such a garment from its elastic band and still easily access the penis. A seal of silicone rubber or similar flexible material is shown 124 which could also be an O-ring. The various types of seals are not limited by the invention, but several examples will be given in subsequent drawings. It will be known to those skilled in the art that the various forms of the seal, gasket or compressible washer are applicable to any of the disclosed and shown embodiments throughout the entirety of this disclosure. When the urinary relief lid 110 is closed, it swings down on its pivot 116 until it firmly snaps in place between the snap retainer 128 and the snap assembly itself. A variety of materials can be used for all of these structures as will be discussed in subsequent drawings such as plastics, metals, composites, wood, fiberglass, laminates or combinations thereof.

Figure 5:
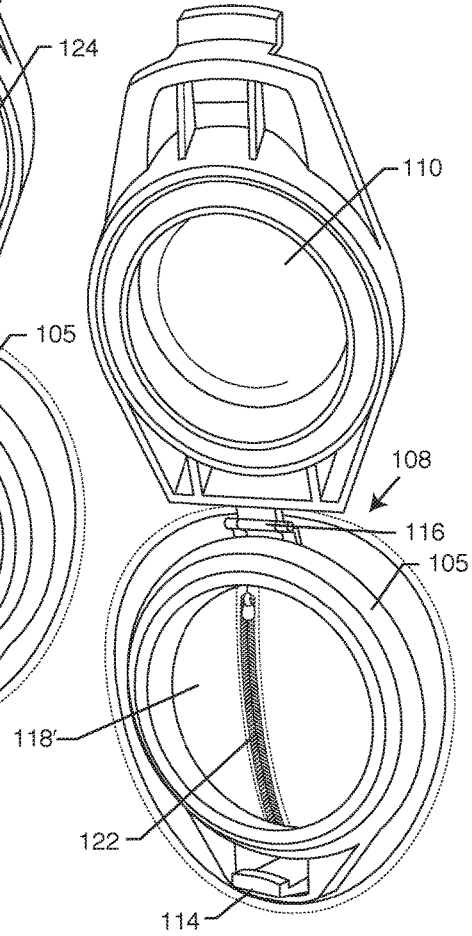
FIG. 5 is a view similar to FIG. 4 now showing a zippered pant underneath the wader.

FIG. 5 is very similar to FIG. 4 except that the undergarment 118' has a zipper 122. This would be analogous say to a simple pair of jeans. With the relief lid 110 in the open position, one can see that it would be very easy to pull down the zipper 122 to access the penis for urination. It is also noted that the present invention is intended to be used for males, but could also be used for females. Auxiliary devices may be used by females to aid in the use of the present invention. For instance, a hygienic funnel, such as the GoGirl™ may be used by females that help capture and direct urination out through the present invention.

Figure 6:
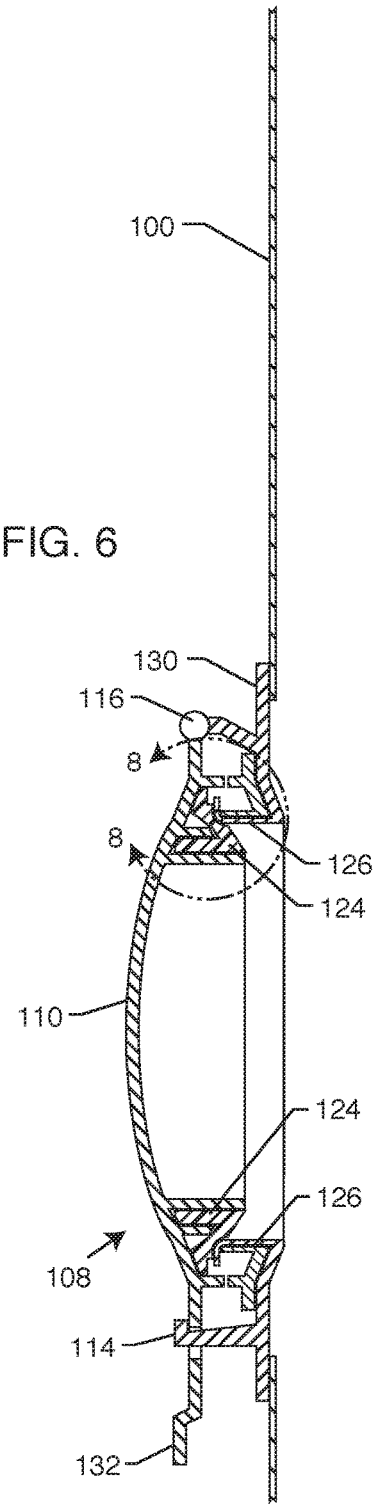
FIG. 6 is a cross-sectional view of the structure of FIG. 3 taken along line 6-6.

FIG. 6 is taken from section 6-6 from FIG. 3. The urinary relief lid 110 is shown seated closed by virtue of the snap assembly 114, 132. There is a circumferential flexible or deformable seal 124 that is shown that is seated against a seal compressor 126. One can see how the seal would be formed as it is pressed into the seal compressor 126. This forms a water-tight seal which is extremely important for waders or heavy duty rain wear. In particular, this is important when wearing waders where this area of the wader is most often times under water. A seal joint 130 is shown which makes a connection between the wader or rain gear garment 100 and the urinary relief hatch assembly 108. As will be shown, this joint can be of a thermal-setting adhesive, a glue, a rubber bond, a stitch, a thermal bond, a weld, a rivet or any other type of joint that would be waterproof and strong.

Figure 7:
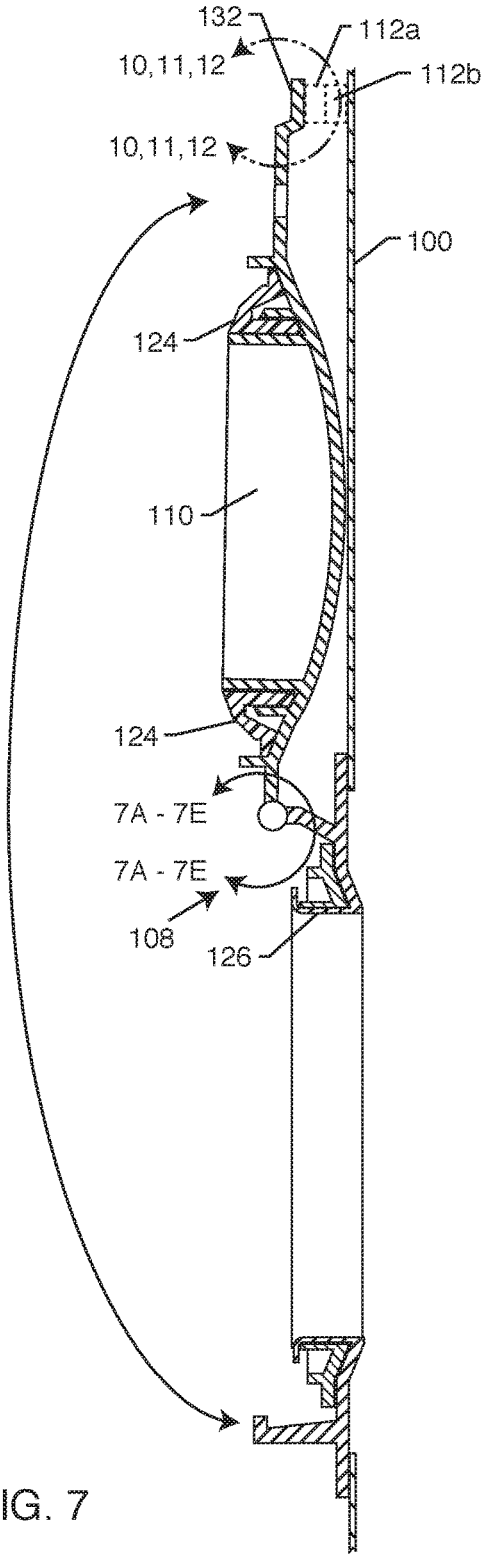
FIG. 7 is a cross-sectional view of the structure of FIG. 4 taken along line 7-7.

FIG. 7 was taken from section 7-7 from FIG. 4 and shows the urinary relief hatch assembly 108 in FIG. 6 in the open position. One can see that the water-tight deformable seal material 124 is no longer indented since it is no longer pressed against the seal compressor 126. Also, in this embodiment there is a retention assembly attached to the urinary relief handle 132. As will be shown, this relief hatch retainer 112*a* and 112*b* can be accomplished by a variety of designs. The idea of having the relief hatch in this embodiment open upwards is to provide maximum access to the penis for urinating and taking advantage of gravity so that one does not splash the lid 110 or any of its components with urine.

Figure 7A:
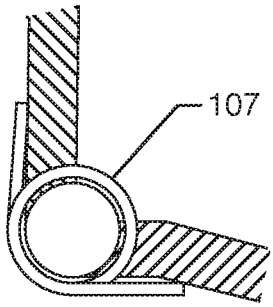
FIG. 7A is an enlarged view of similar structure of section 7A-7A taken from FIG. 7 now showing a spring mechanism.

FIG. 7A is an enlarged view of similar structure of section 7A-7A taken from FIG. 7 now showing a spring 107. The spring 107 is biasing the lid 110 to remain open and not fall down and close against the base 105. This prevents the lid 110 from unwantingly close against the base 105.

Figure 7B:
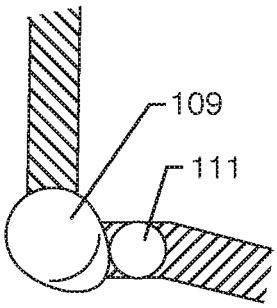
FIG. 7B is an enlarged view of similar structure of section 7B-7B taken from FIG. 7 now showing a cam mechanism in the open position.
Figure 7C:
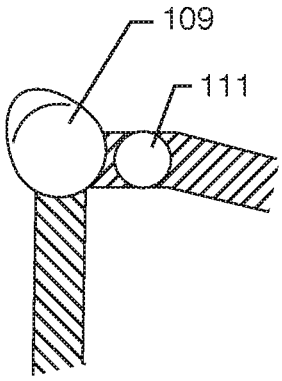
FIG. 7C is an enlarged view of similar structure of section 7C-7C taken from FIG. 7 now showing a cam mechanism in the closed position.

FIG. 7B is an enlarged view of similar structure of section 7B-7B taken from FIG. 7 now showing a cam mechanism 109, 111 in the open position. The cam 109 has a raised portion that interferes with protrusion 111. In this way when the lid 110 is open it is held in the open position. FIG. 7C is an enlarged view of similar structure of section 7C-7C taken from FIG. 7 now showing the cam mechanism 109, 111 in the closed position. Here, the raised portion of the cam 109 has passed the protrusion 111 and is no longer being held open. It will be understood that the cam 109 and protrusion 111 could be placed in different locations and different positions. This example merely illustrates that a wide variety of friction joints can be used to keep the lid 110 in the open position so it does not unwantingly close against the base 105.

Figure 8:
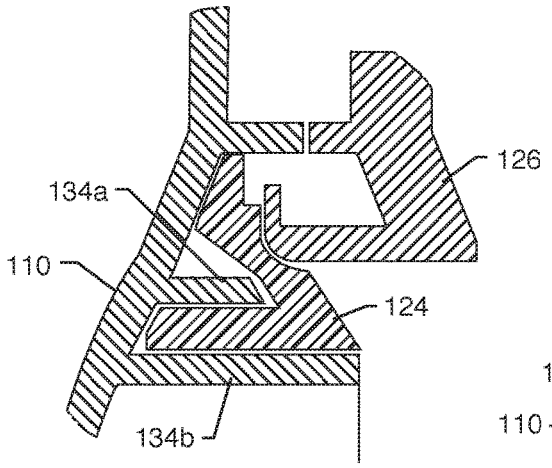
FIG. 8 is a close-up view of the structure of FIG. 6 taken along line 8-8.

FIG. 8 is an enlarged view taken from section 8-8 from FIG. 6. Shown is a portion of the urinary relief lid 110 and the flexible seal 124. The flexible seal retainer is the sandwich between structures 134*a* and 134*b*. The seal 124 is press fit in a way that is held securely or snugly while the relief lid 110 is swung up or down. Also shown is the seal compressor assembly 126. In the closed position, the deformable or compressible seal 124 is firmly seated against the seal compressor 126 in order to form a water-tight seal.

Figure 9:
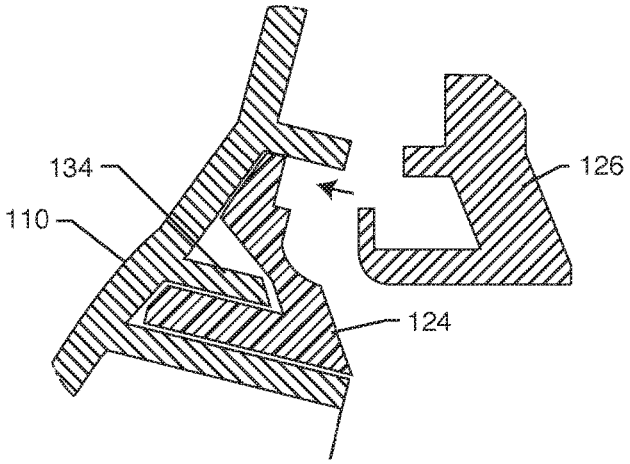
FIG. 9 is a view similar to FIG. 8, now with the lid slightly opened.

FIG. 9 is very similar to FIG. 8 and simply shows the urinary relief lid 110 in the process of being swung open. At this point, one can see that the seal material 124 is no longer indented or compressed.

Figure 10:
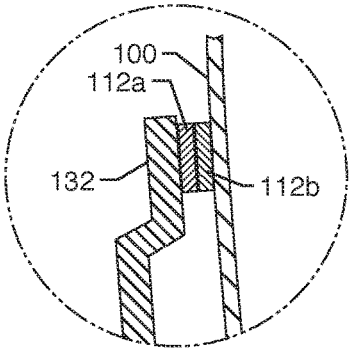
FIG. 10 is a close-up view of the structure of FIG. 7 taken along line 10-10.

FIG. 10 is taken from section 10-10 from FIG. 7. This is a retainer mechanism so that when the lid is in the upward position, it is held up while one goes about their business of urinating. In the case of FIG. 10, this would be opposite polarity magnets so that the lid is held up magnetically in place.

Figure 11:
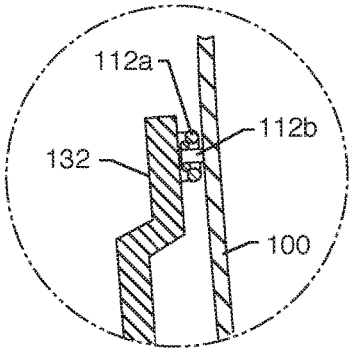
FIG. 11 is a close-up view of the structure of FIG. 7 taken along line 10-10 now showing another embodiment.

FIG. 11 is taken from section 11-11 from FIG. 7 and shows a male and female snap assembly. The female snap 112*a* is affixed to handle 132 and is pressed over the male snap portion 112*b* as shown. There is a retainer clip spring to hold the two firmly together. To unsnap this, one simply pulls against it as it pops off. The male and female portions of the snap may be used on either side.

Figure 12:
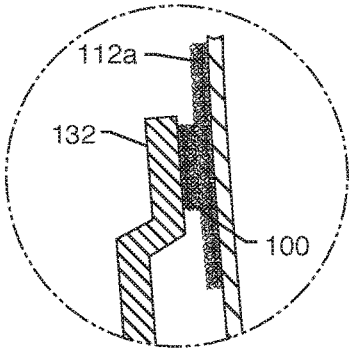
FIG. 12 is a close-up view of the structure of FIG. 7 taken along line 10-10 now showing yet another embodiment.

FIG. 12 is taken from section 12-12 from FIG. 7 and is very similar to FIG. 10. Shown are a hook-and-loop style attachments, which in the industry are also known as Velcro®. In a preferred embodiment, the part of the hook-and-loop attachment system that is attached to the wader 100 would be larger in diameter or size. This would allow for dimensional misalignments as material stretches or wrinkles.

Figure 13:
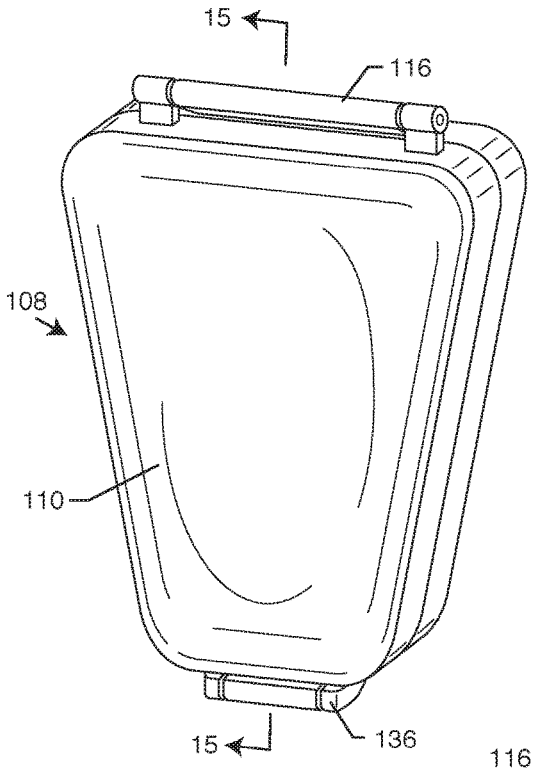
FIG. 13 is a perspective view of another exemplary relief hatch embodying the present invention.
Figure 14:
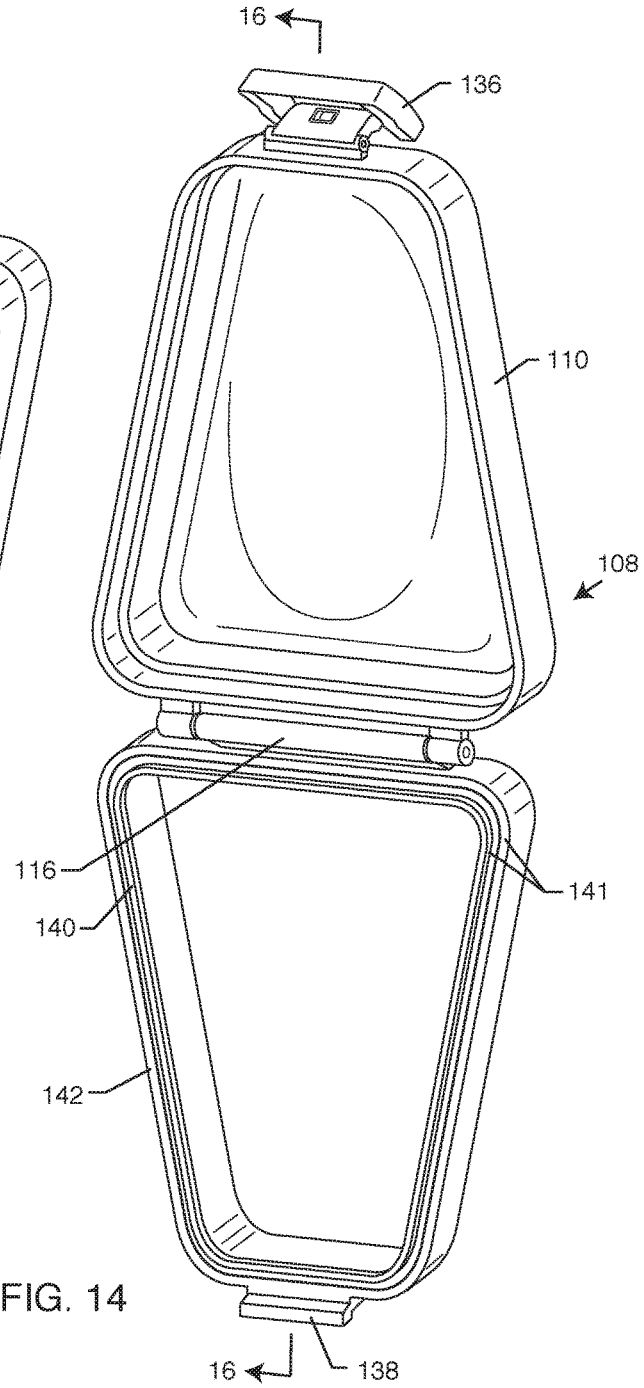
FIG. 14 is a view similar to FIG. 13 now showing the relief hatch in the open position.

FIG. 13 is very similar to FIG. 3 except that the urinary relief hatch assembly 108 has more of a triangular shape and also has a different type of container and catch mechanism. For strength, in a preferred embodiment, the hinge 116 is shown full width. A compression latch 136 is used to compress the lid 110 against an O-ring seal 140 (gasket, seal, compressible washer). The O-ring seal 140 is fitted into a groove 141, which is better shown in FIG. 14. FIG. 14 shows the urinary relief hatch 108 of FIG. 13 in the open position. One can see the compression latch 136 and the compression latch retainer 138. The compression latch, when pushed down, compresses the edge of the lid 110 firmly against the O-ring 140 which ratchet seals it and makes it water tight. It will be obvious to those skilled in the art that any number of alternative dimensions could be used to provide convenient access for urination. It will also be obvious to those skilled in the art that any of the retention devices as previously illustrated in FIGS. 10, 11 and 12 may be adapted to the mechanism as illustrated in FIGS. 13 and 14.

Figure 15:
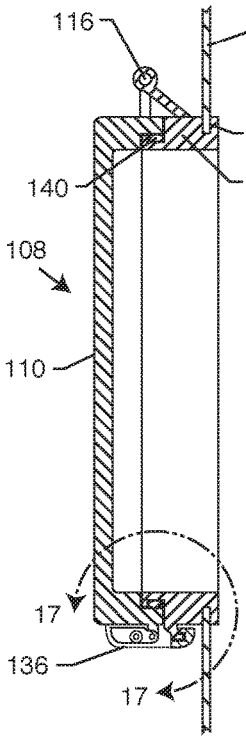
FIG. 15 is a cross-sectional view of the structure of FIG. 13 taken along line 15-15.
Figure 16:
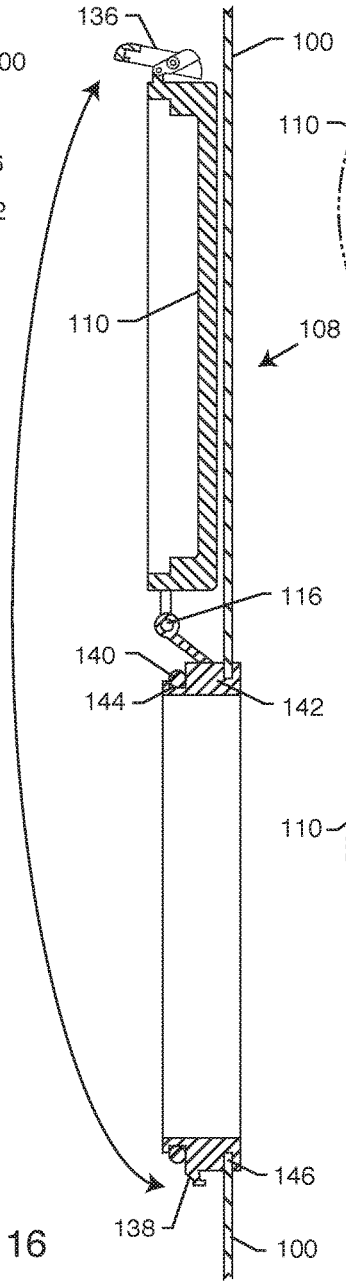
FIG. 16 is a cross-sectional view of the structure of FIG. 14 taken along line 16-16.

FIG. 15 is a sectional view taken from section 15-15 from FIG. 13. It shows the lid 110 in the closed position with the compression latch 136 firmly seated in place, which is compressing O-ring 140 in both the axial and side load directions. This forms a very tight water-tight seal. Item 142 is a very rigid seating assembly for the O-ring, which also holds it firmly in place. It is really hard to visualize how the O-ring 140 is seated while it is compressed like this. One is referred to FIG. 16, which is taken from section 16-16 from FIG. 14. This shows the urinary relief lid 110 in the open position. With this in the open position, one can now clearly see the O-ring 140 in its uncompressed state. One can also see that there is a little groove or slot 144 into which the O-ring is firmly seated. To replace the O-ring, one expands the O-ring by stretching it in diameter and then slips it into this slot where it snaps firmly into place where it cannot come out. An alternative (not shown) would be to add some silicone grease all along the O-ring, which helps it to form a water-tight seal.

Figure 17:
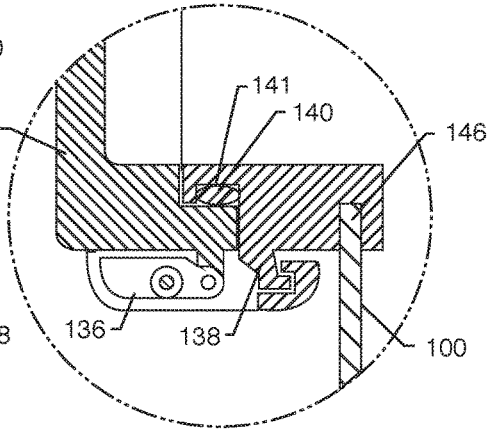
FIG. 17 is a close-up view of the structure of FIG. 15 taken along line 17-17.

FIG. 17 is taken from section 17-17 from FIG. 15 and shows an enlarged view of the compression latch 136 firmly seated against its retainer 138. This firmly compresses the O-ring 140 (gasket, seal, and compressible washer) as shown, forming a water-tight seal.

Figure 18:
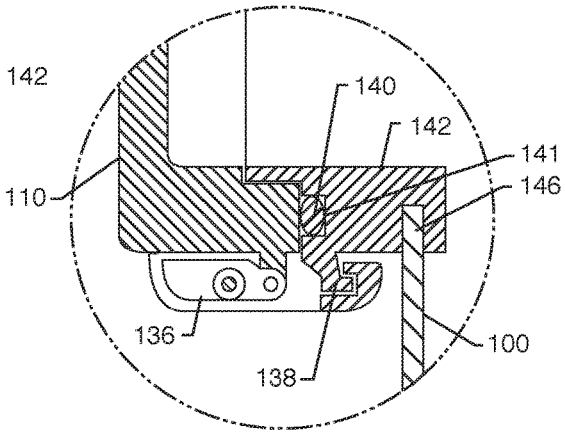
FIG. 18 is a view similar to FIG. 17 now showing an alternative sealing arrangement.

FIG. 18 is very similar to FIG. 17 except in this case, the O-ring is in straight compression when the lid 110 is seated. That is, the edge of lid 110 presses straight down against the O-ring, which causes it to change shape from a circle to more of an oval. Again, this forms a solid water-tight seal.

Referring back to FIGS. 15, 16, 17 and 18, one can also see that there is a joint 146 between the wader or rain gear material and a groove that is formed in the urinary retention device 108. The material 100 is held firmly in this groove 146 by compression, by glues or cements, by thermal-setting adhesives or the like.

Figure 19:
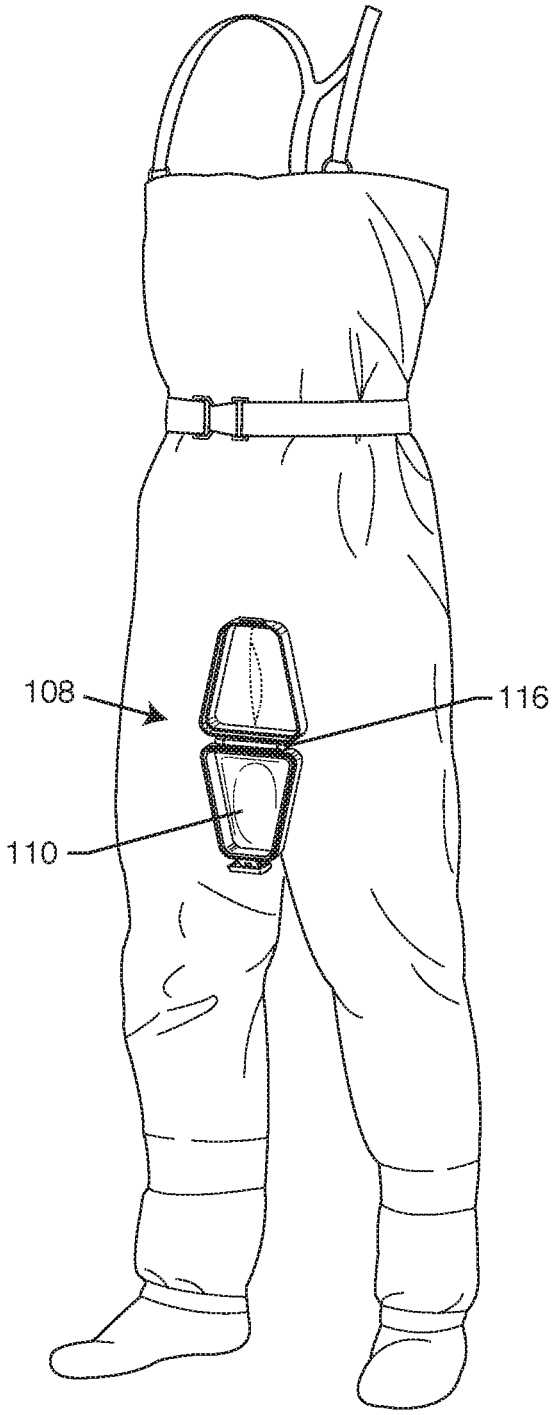
FIG. 19 is a perspective view of yet another embodiment of an exemplary relief hatch now showing the lid opening downwards.

FIG. 19 is very similar to FIGS. 2, 13 and 14 except that in this case, the hinge 116 has been inverted so that it appears towards the bottom. In this case, there is no need for any type of retention device as previously illustrated in FIGS. 10, 11 and 12. In this case, the lid 110 flaps down and is held simply in place by gravity while one goes about the process of urination. One advantage of this assembly as illustrated in FIG. 19 is its simplicity and reduced costs. Cost is reduced by not needing to provide for a retention device to hold the lid in the upward position. There are also some geometry advantages to the structure as illustrated in FIG. 19 as this provides a more open access through the undergarment.

Figure 20:
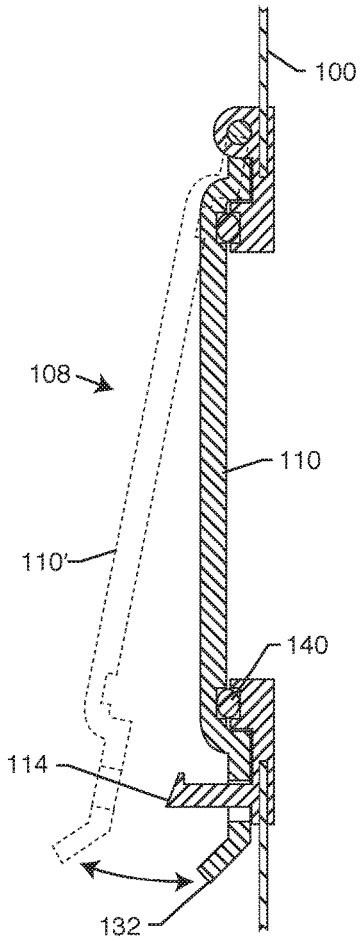
FIG. 20 is a cross-sectional view of another exemplary relief hatch embodying the present invention.
Figure 21:
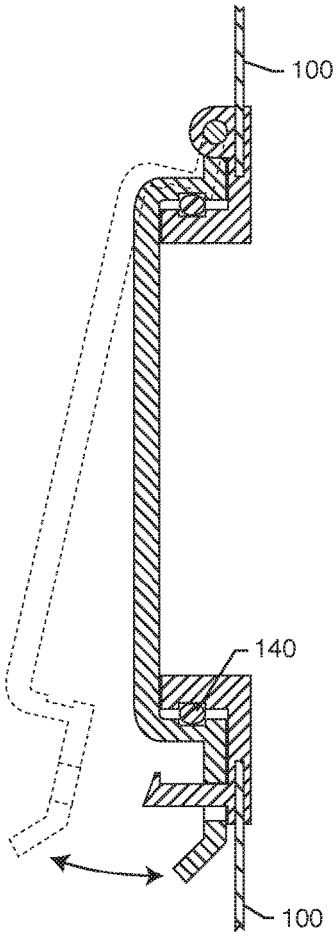
FIG. 21 is a cross-sectional view of another exemplary relief hatch embodying the present invention.

FIG. 20 illustrates a different type of O-ring compression assembly (gasket, seal, compressible washer) and is similar to those previously described in FIGS. 15 through 18. In the case of FIG. 20, one simply pushes downward on latch mechanism 114 while at the same time, pulls up on the handle mechanism 132. This allows one to swing the lid 110 into its opening position 110'. As can be seen, in this configuration, the O-ring 140 is in direct compression. An alternative to FIG. 20 is shown in FIG. 21 and is very similar except that the O-ring is in both side and axial compression.

Figure 22:
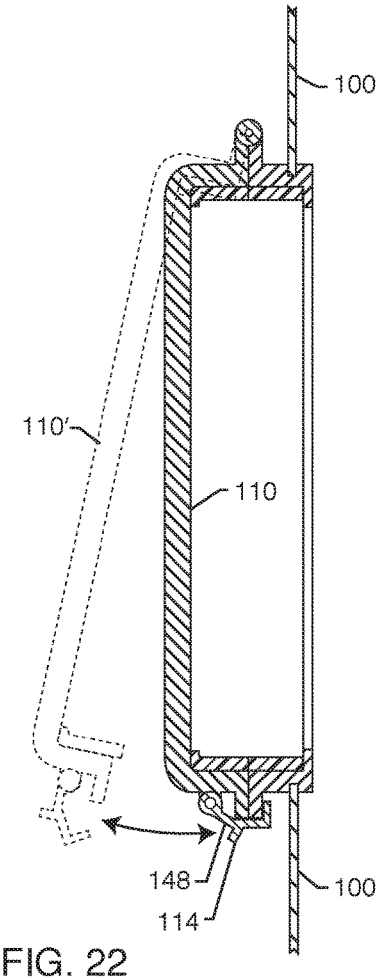
FIG. 22 is a cross-sectional view of another exemplary relief hatch embodying the present invention.

FIG. 22 is yet another type of latch retainer mechanism 148 which pivots on a hinge. One can see that by applying their thumb to location 114, it is easy to rotate this latch so that the lid 110 can be swung into its open position 110'.

Figure 23:
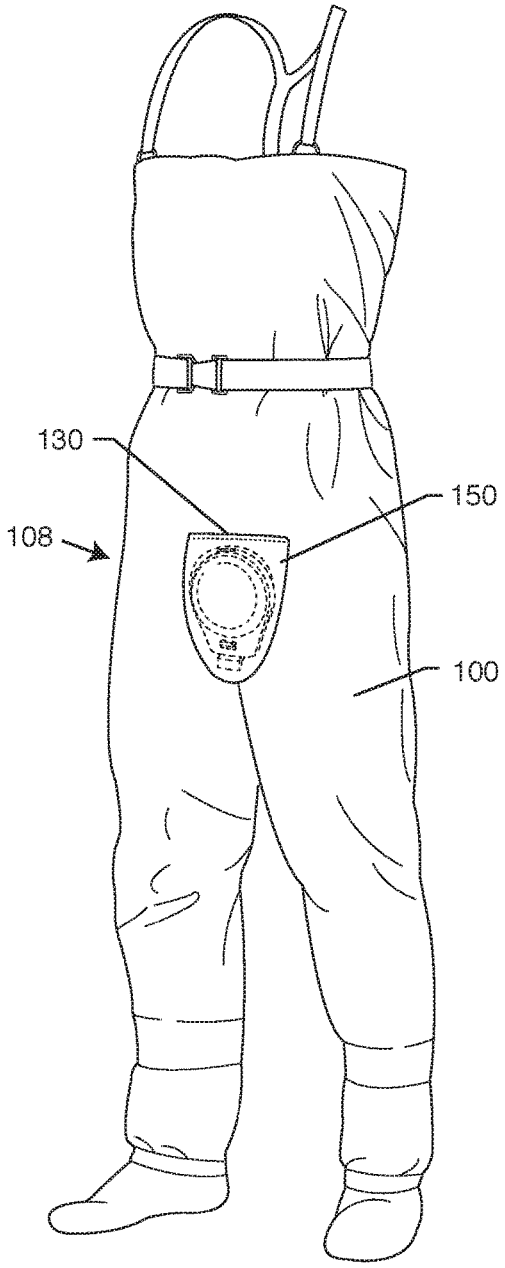
FIG. 23 is a perspective view of an aesthetic cover for any of the exemplary embodiments of the relief hatch.

FIG. 23 is an alternative view of the wader relief mechanism 108 as previously illustrated in FIGS. 2, 19 and any alternative thereof. In this case there is a flap 150 which covers over the urinary relief mechanism 108, but preserves a better cosmetic look for the garment. The flap 150 may be of the same material as the wader itself. It may be held down by hook-and-loop type closures.

Figure 24:
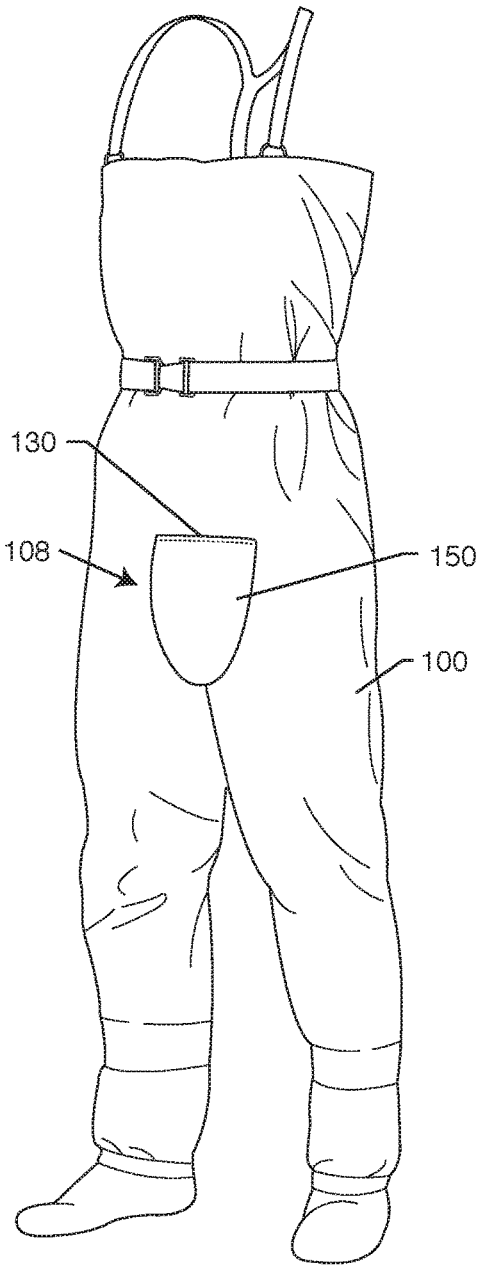
FIG. 24 is similar to FIG. 23 now showing the relief hatch hidden.

FIG. 24 is the same as FIG. 23 which illustrates the flap 150 without the dash lines showing the present invention 108 underneath. One can see by looking at FIG. 24 that this does provide a better cosmetic appearance.

There are several possibilities for the marketing of the urinary relief hatch assembly 108 of the present invention. One would be during original manufacturing of the wader and the rain garment, to simply install the urinary relief hatch at that time. Compatible materials would be used so that automated thermal-bonding or glue/adhesive processes can be used to join the wader material 100 to a flange 130, which is part of the urinary relief mechanism 108. However, there is a very important aftermarket. Many people already own very expensive waders and would like to retrofit their waders to add the urinary relief mechanism 108.

Figure 25:
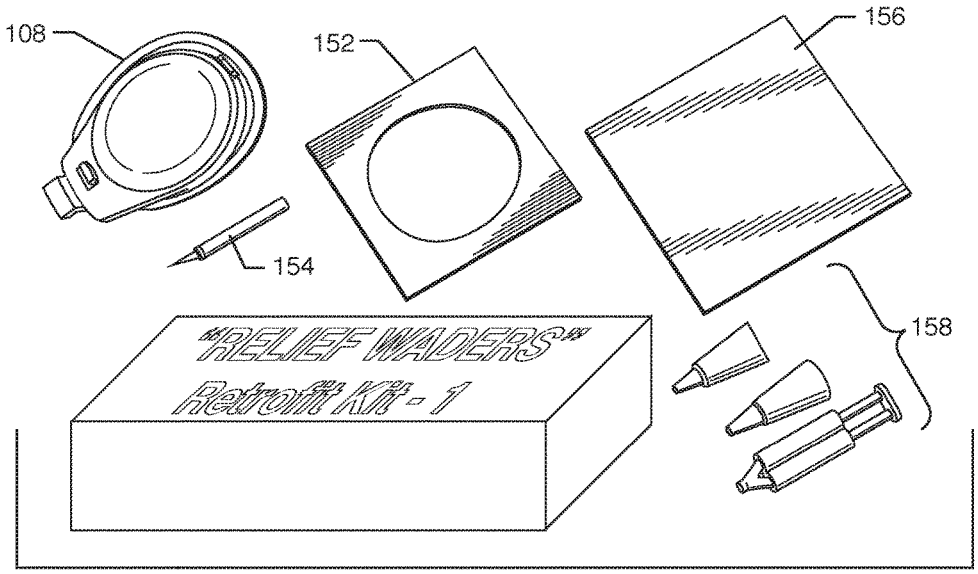
FIG. 25 is a perspective view of an exemplary embodiment of a relief hatch retro-fit kit.

FIG. 25 illustrates a kit which may be sold as an aftermarket assembly. The kit would contain the urinary relief hatch 108 of the present invention along with a template 152 which would come with instructions and in a preferred embodiment, a sticky adhesive 158 so that this could be placed on the garment. One could then either use the template 152 to trace a line with permanent ink, or use it as a cutting template to take a sharp knife 154 or scissors and cut an appropriate opening in the wader garment 100. A convenient cutting board 156 may be optionally supplied which can be placed inside and behind where the cutting is to take place. This backing board 156 is very important because it would destroy the waders to cut through both the front and back sides at the same time.

Figure 26:
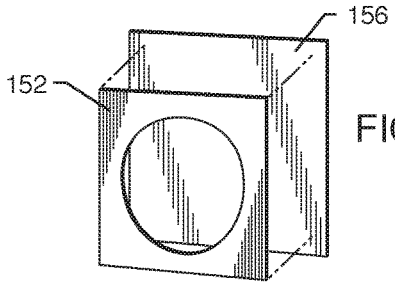
FIG. 26 is a perspective view of a cut-out template and a cutting board.

FIG. 26 illustrates placing the backing or cutting board 156 inside the wader in the appropriate location and roughly centered over template 152. Also shown, are a number of glues, adhesives or even epoxies 158 which may be used. There would be a variety of bonding agents 158 supplied in the kit along with instructions so that the user can properly identify which type of wader they have and what type of material it has and therefore what kind of sealant it will be compatible with.

Figure 27:
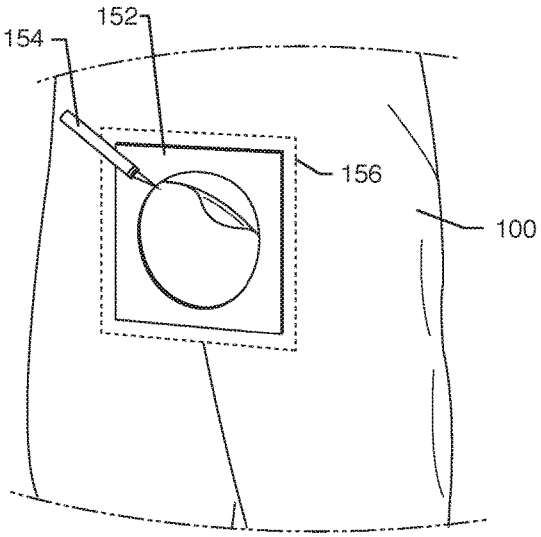
FIG. 27 is a perspective view of the cut-out template of FIG. 26 being cut along a wader with the cutting board behind.

FIG. 27 illustrates the use of the template 152 and the cutting tool 154 to make the primary opening in the front of the waders 100.

Figure 28:
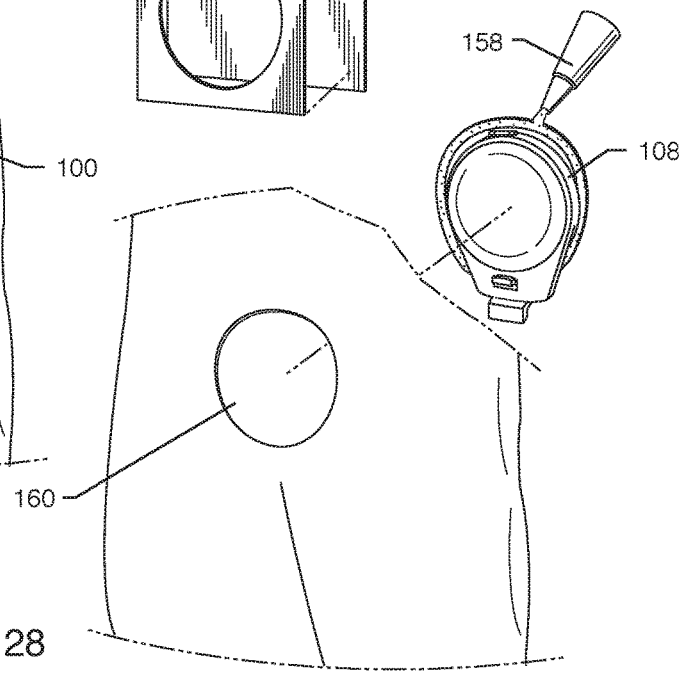
FIG. 28 is a perspective view showing an exemplary embodiment of bonding the relief hatch of FIG. 25 to the wader.

FIG. 28 shows the opening 160 into which the urinary relief assembly 108 is fitted into place. As one can see, the appropriate adhesive material 158 is first applied and then the urinary relief hatch is placed into the hole 160. This can be done through the inside as shown or from the outside (not shown).

Figure 29:
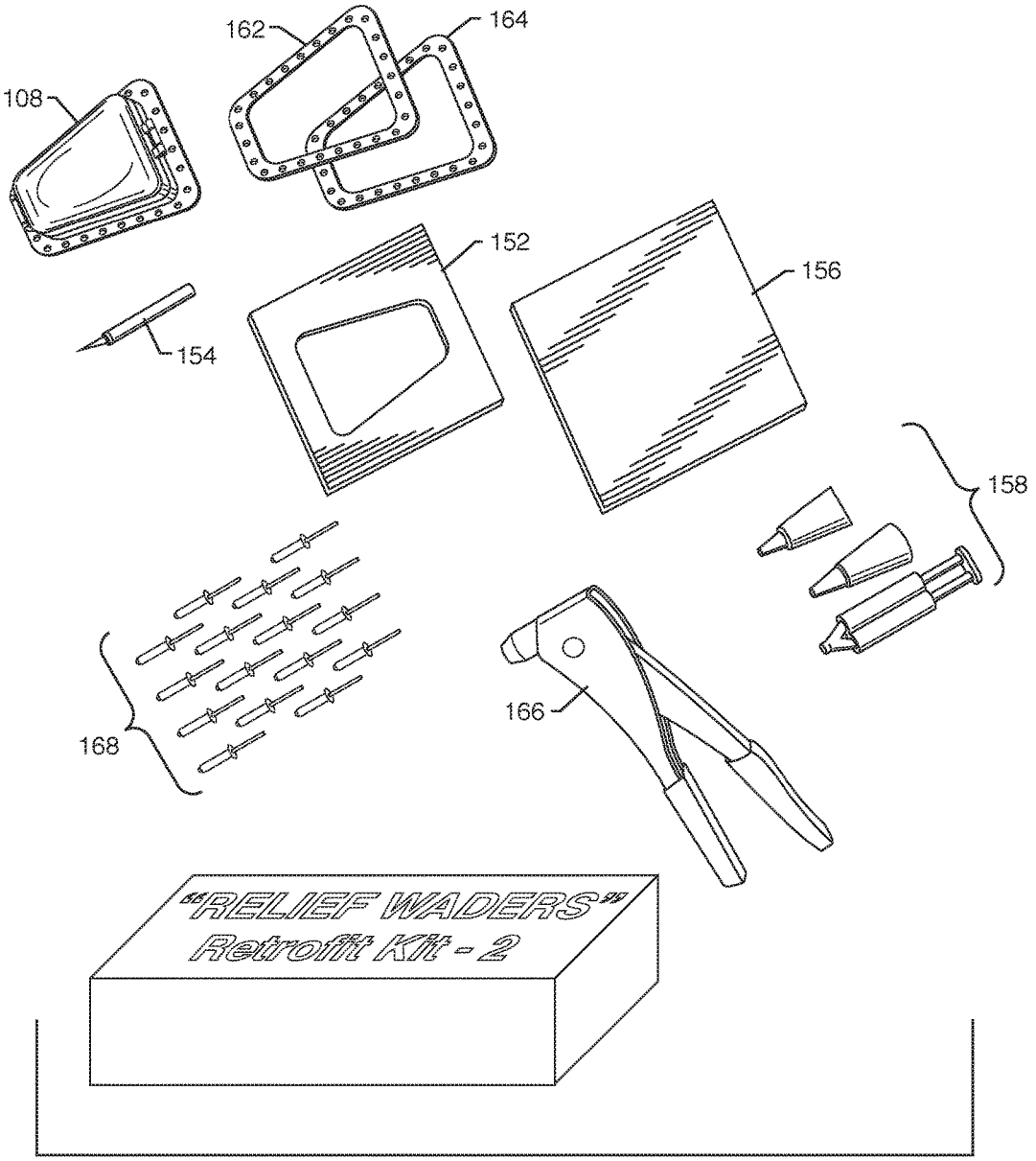
FIG. 29 is a perspective view of another exemplary embodiment of a relief hatch retro-fit kit.

FIG. 29 is a kit very similar to FIG. 25 and is used in very much the same way. Provided are two compressible rubber or neoprene or the like gaskets 162 and 164. There is also a cutting template 152 and a backing board 156 along with the appropriate adhesives 158 as previously described in FIG. 25. In lieu of the adhesives, a pop rivet tool 166 may be provided along with the appropriate number of pop rivets 168 so that one can literally sandwich the wader material 100 (not shown) between the two gaskets 162 and 164 and then pop rivet everything in place. Pop rivets can press together solidly as they are tightened by compressing the two gaskets 162 and 164, which are flexible. This provides a water-tight seal all around the periphery of the urinary retention device 108. It will be obvious to one skilled in the art that any other type of fastener, such as screws and small bolt heads and the like may be used.

Figure 30:
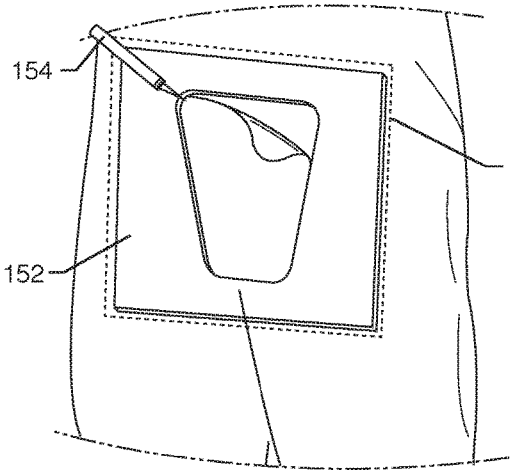
FIG. 30 is a perspective view of the cut-out template of FIG. 29 being cut along a wader with the cutting board behind.

FIG. 30 is an enlarged view showing the use of the template 152 and backing plate 156 previously described in FIG. 29.

Figure 31:
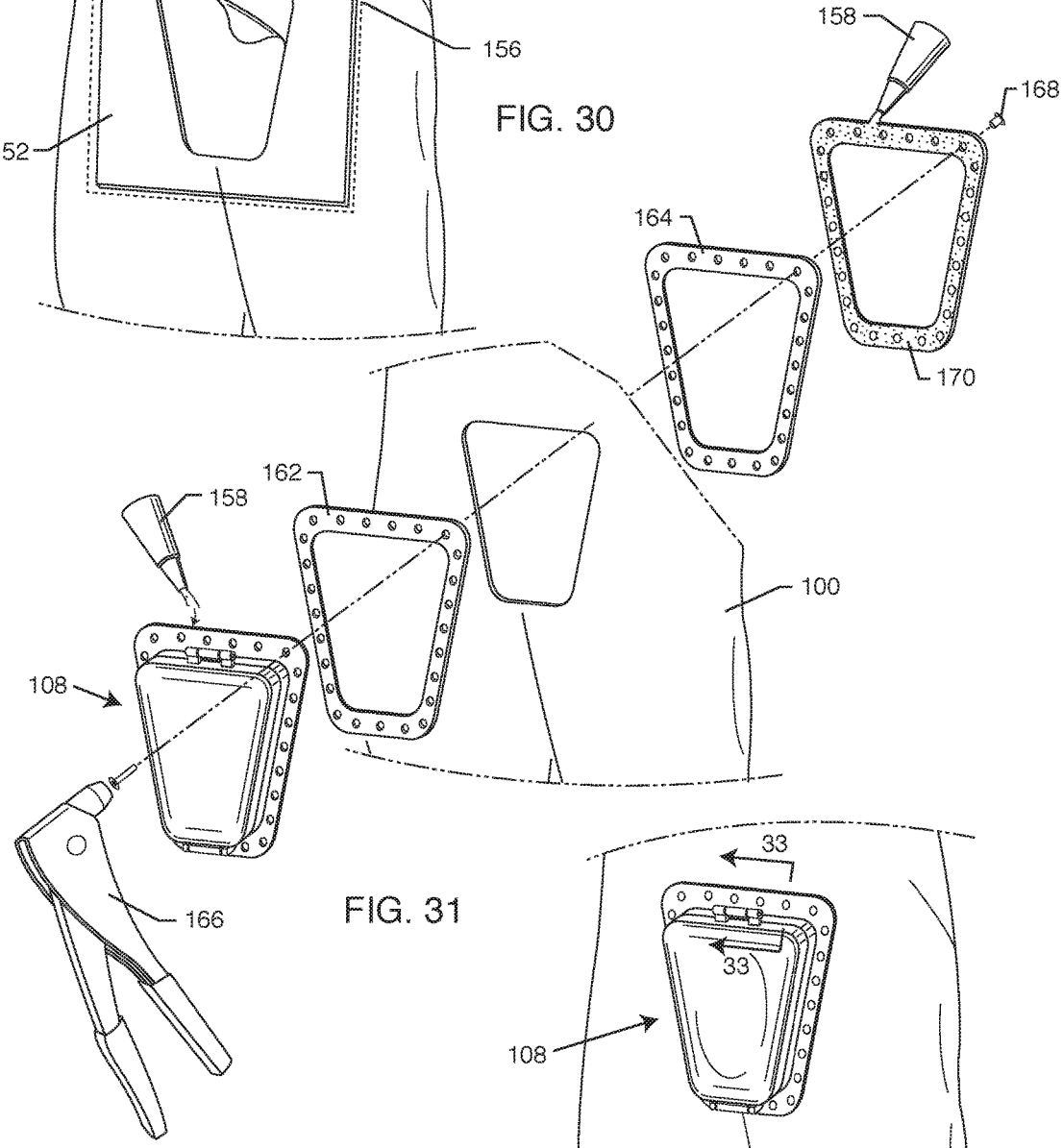
FIG. 31 is an exploded perspective view of the structure of FIG. 29 being fixtured and sealed to the wader.
Figure 32:
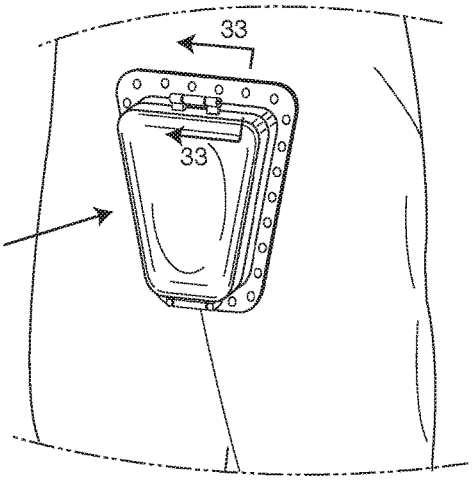
FIG. 32 is a perspective view of the finished assembly of FIG. 31.

As shown in FIG. 31, the various components of the assembly are lined up. An adhesive, sealant or glue 158 is optionally applied prior to the seating of the components. The pop rivet gun 166 is used to place pop rivets 168 through each of the holes. The completed assembly, as shown in FIG. 32, forms a water-tight urinary relief hatch of the present invention. A backing plate 170 is provided for which to place the pop rivets. It is important that the backing plate 170 be of a rigid material and that the pop rivet holes or screw holes be placed close enough apart so that the gaskets 162 and 164 are uniformly compressed in a way that water cannot ingress.

Figure 33:
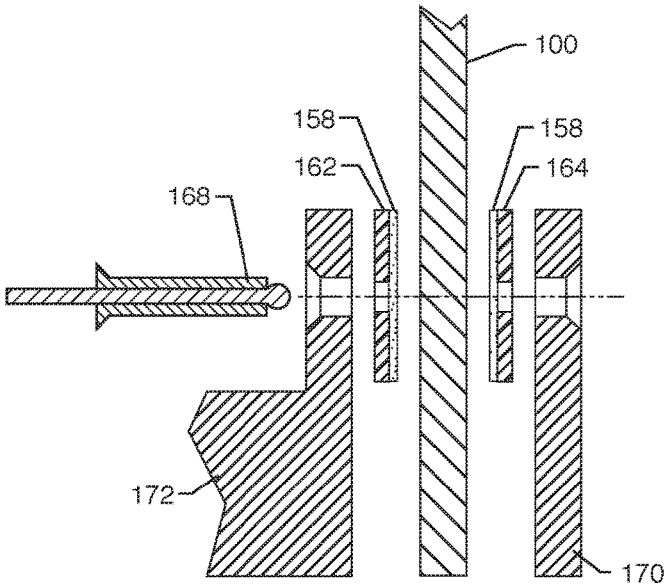
FIG. 33 is a cross-sectional view of the structure of FIG. 32 taken along line 33-33 just before completion of fastening.

FIG. 33 is a sectional view taken from section 33-33 from FIG. 32. Shown is the pop rivet 168 along with the cross-sectional view of the flange of the urinary retention device of wader material 100 along with the two gaskets 162 and 164. In a preferred embodiment, only one gasket 162 or 164 is needed to form a reliable seal. FIG. 33 shows the male end of the rivet 168*a* being inserted through the flange of the urinary retention block 172, through sealing gasket 162, through a pre-punched hole in the wader material 100 and through the secondary gasket 164 lined up with the holes in the retention flange 170.

Figure 34:
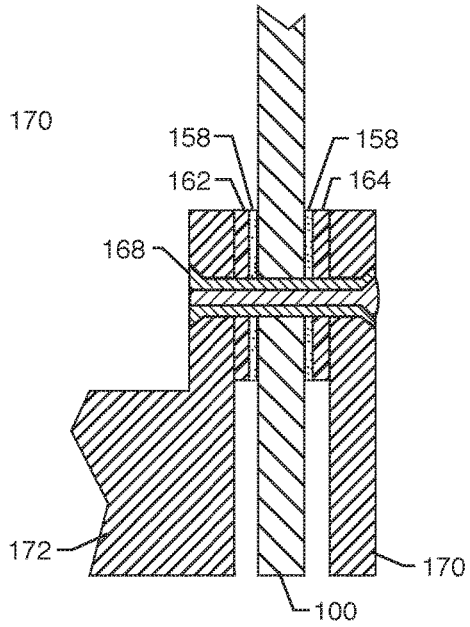
FIG. 34 is a cross-sectional view similar to FIG. 33 now showing the finished assembly being watertight.

FIG. 34 is very similar to FIG. 33 showing the rivet in its compressed state. As can be seen, gaskets 162 and 164 have been firmly compressed against the wader material or rain gear material 100. In an optional embodiment, an adhesive 158 may be placed over both ends of each of the pop rivets to make sure that they do not leak water.

Figure 35:
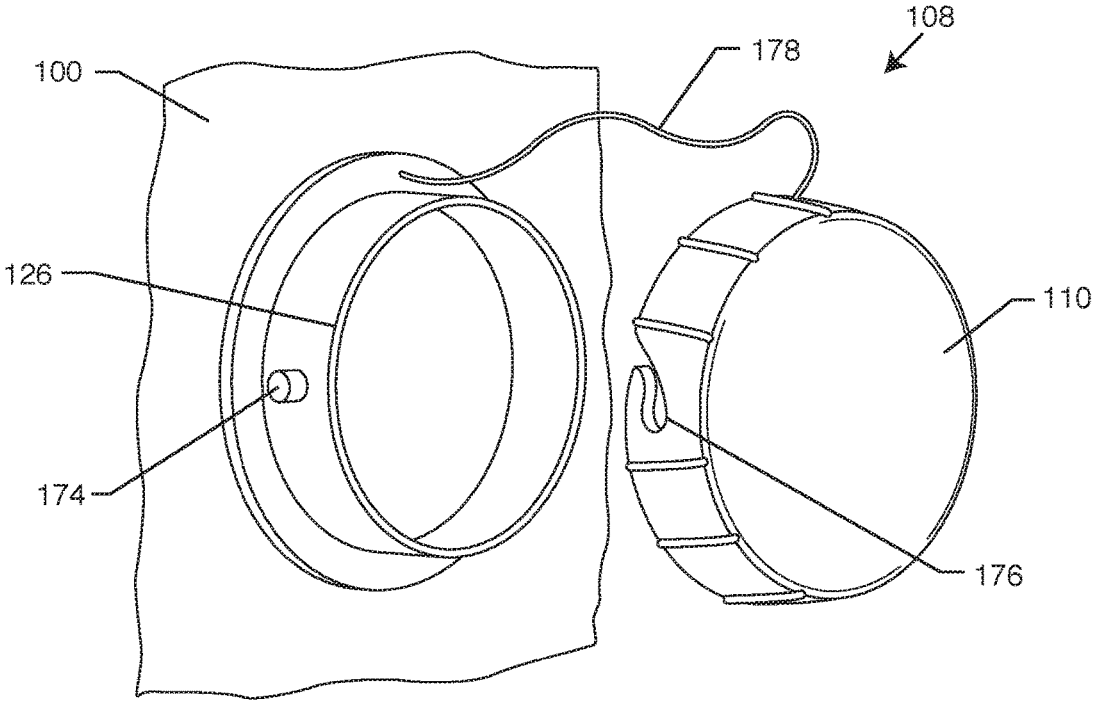
FIG. 35 is a perspective view of another exemplary embodiment of a relief hatch.

FIG. 35 is an alternative form of the invention with a twist cap lid 110 with taper engagement slots 176 which are designed to engage pins 174. As the cap is twisted, it is compressed against gasket seat 126. There is a gasket on the inside of the twist housing 110 (not shown). As the twist cap 110 is tightened, the gasket (not shown) is compressed against the gasket seat 126 in order to affect a water-tight seal. There is an optional tether 178 which can be of any suitable material which prevents the cap 110 from getting lost. Additionally, the tether 178 may be attached to the side of the wader such that when the lid 110 is opened, the lid 110 will be out of the way during urination. Alternatively, the tether 178 may be made of an elastic material such that the lid 110 is retracted further away from the aperture when opened. Referring once again to FIG. 35, one can see that this design offers a number of advantages, in that it is very quick and easy to use. Only a slight rotation of the cap lid 110 is required to engage the pins 174 and properly seat the gasket structure.

Figure 36:
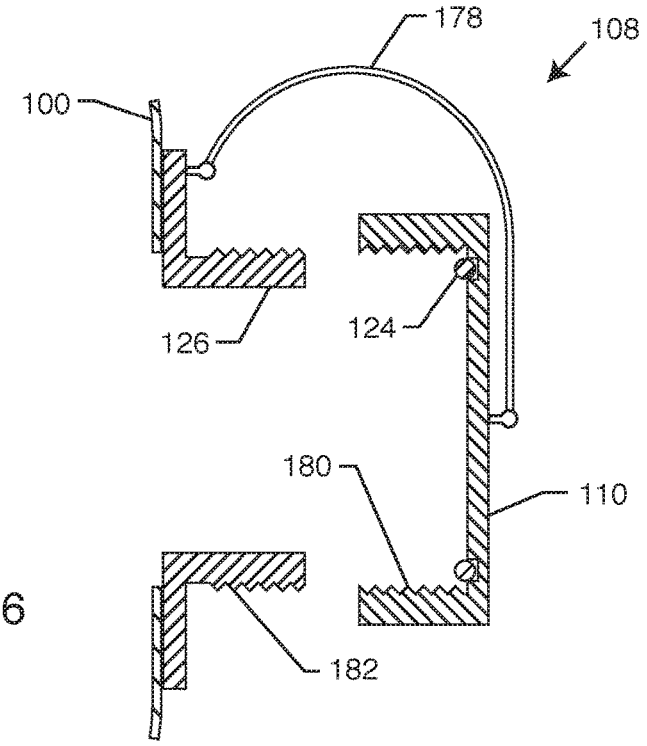
FIG. 36 is a sectional view of another exemplary embodiment of a relief hatch.

FIG. 36 is another type of round cap 110, but in this case, it has female threads 180 which are designed to engage male threads 182 of the O-ring seat 126. When the cap 110 is threaded down tightly, O-ring 124 (gasket, seal, compressible washer) is compressed against the O-ring seat 126 which affects a water-tight seal. Again, there is an optional tether 178 shown for the same purposes as previously described in FIG. 35. The tether 178 is rotatively attached to the center of the cap 110 so that it does not get tangled up as the cap 110 is screwed in place.

Figure 37:
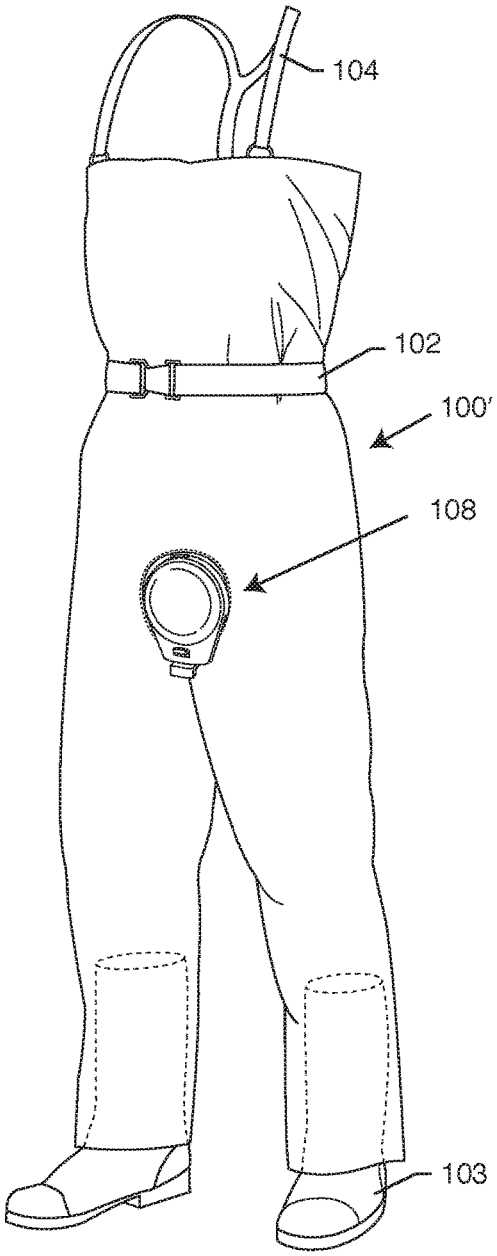
FIG. 37 is a perspective view of another embodiment of a relief hatch now with chest high pants having suspenders.

FIG. 37 is very similar to FIG. 2 showing the previously described urinary relief hatch 108. In this case, instead of being a submersible wader, this is more of a foul weather gear or a rain pant 100', which is designed to go over high top boots 103. Lower top boots could also be used, but in a preferred embodiment, high top boots 103 are used so that, in an extremely wet environment and perhaps with waves sloshing across a deck with high wind, the wearer will not get water up over the boot tops and down into his socks. The boots 103 come in a variety of sizes and shapes and sole types. A popular boot used in Alaska waters is the Bogs Boot made by the Bogs Company®. The other commonly used boot in Alaska is known as a Tuffy Boot made by the Baxter Company®. Another boot is known as TheTUF or XTRATUF® boot. All of these types of boot styles are extensively used by commercial fishermen. In FIG. 37, many survival suits and mariner's ocean passage suits, have a similar pant, which goes over the boot 103. These include, suits made by Helly Hansen®, Musto®, Henri®, Lloyd®, West Marine®, Grundens® and Gill®. In FIG. 37, one can see that the waterproof pants come well above the waist area above belt 102 and include suspenders 104.

Figure 38:
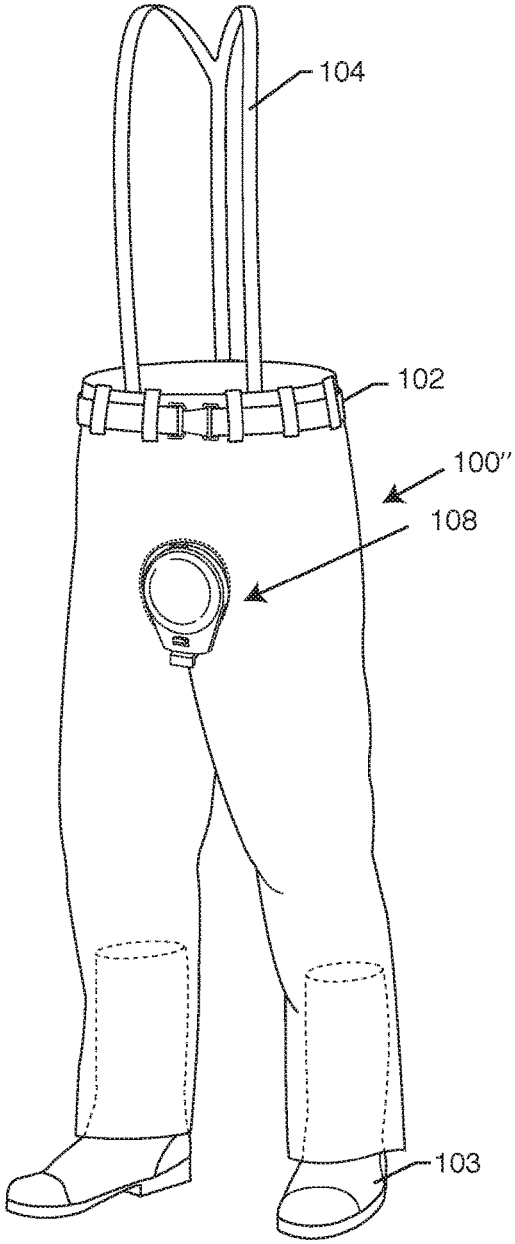
FIG. 38 is a perspective view of another embodiment of a relief hatch now with waist high pants with suspenders.

FIG. 38 is very similar to FIG. 37, except in this case, the pants 100" terminate at the waist typically with a belt 102 and can include the suspenders 104. In this case, a jacket (not shown) would come down well below the waist so that rain would run off rather than go into the waist and make one's undergarments wet. Importantly, in both FIGS. 37 and 38, the boots 103 are not attached, sealed, welded in any way to the pant 100' or 100". In other words, water resistance is achieved by the overlap of the pants over the boots 103. The pant over boot arrangement illustrated in FIGS. 37 and 38, often come with leg zippers to facilitate ease of pulling them on and off over a boot or Velcro closure straps, which allow the bottom of the pant to be drawn tightly around the boot. This is important, for example, if one is on the deck of a boat and an ocean wave comes through so that the wave does not splash up inside the pant and come down over the top of the boot. This kind of a closure feature has also helped during hiking, for example, if one temporarily steps in a puddle or mud hole.

Figure 39:
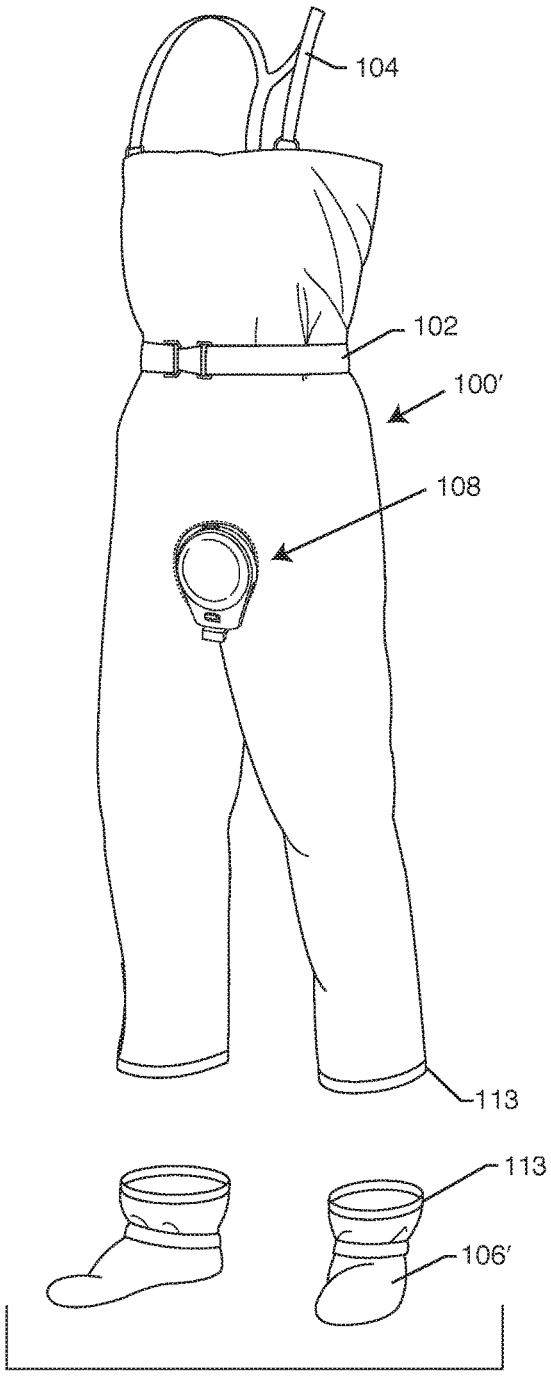
FIG. 39 is a perspective view of another embodiment of a relief hatch now with chest high pants having detachable booties.
Figure 40:
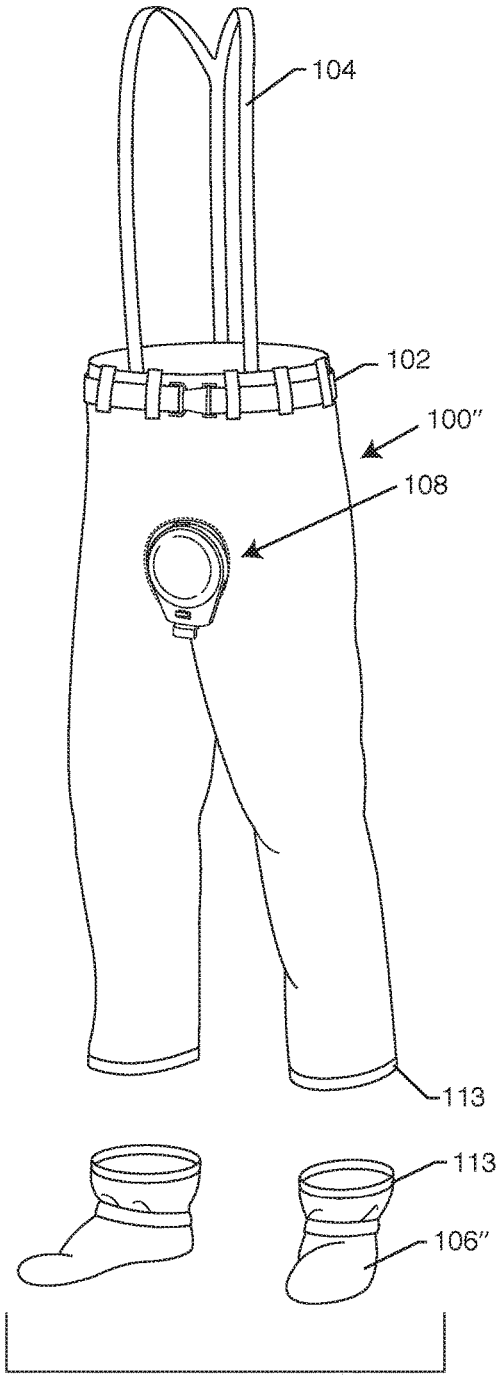
FIG. 40 is a perspective view of another embodiment of a relief hatch now with waist high pants having detachable booties.

FIG. 39 and FIG. 40 are very similar to FIGS. 37 and 38, except that in this case, there is a detachable booty 106' and 106" that may be affixed and sealed to the pant 100' or 100". In this case, after the booties were joined to the pant, one would then put on an overboot, also known as a wading boot (not shown). Typically, these boots are either laced up or closed by Velcro and the booty 106'/106", in a preferred embodiment, would be of insulative material such as neoprene. However, it will be understood that the material of 106'/106" could be of any waterproof material, including rubber, breathable fabric, such as Gortex® and the like. It will also be appreciated that the booties 106' or 106" could include a heel and a sole and various types of treads, such that a boot could be integrated and sealed to the pant 100' and 100".

Figure 41:
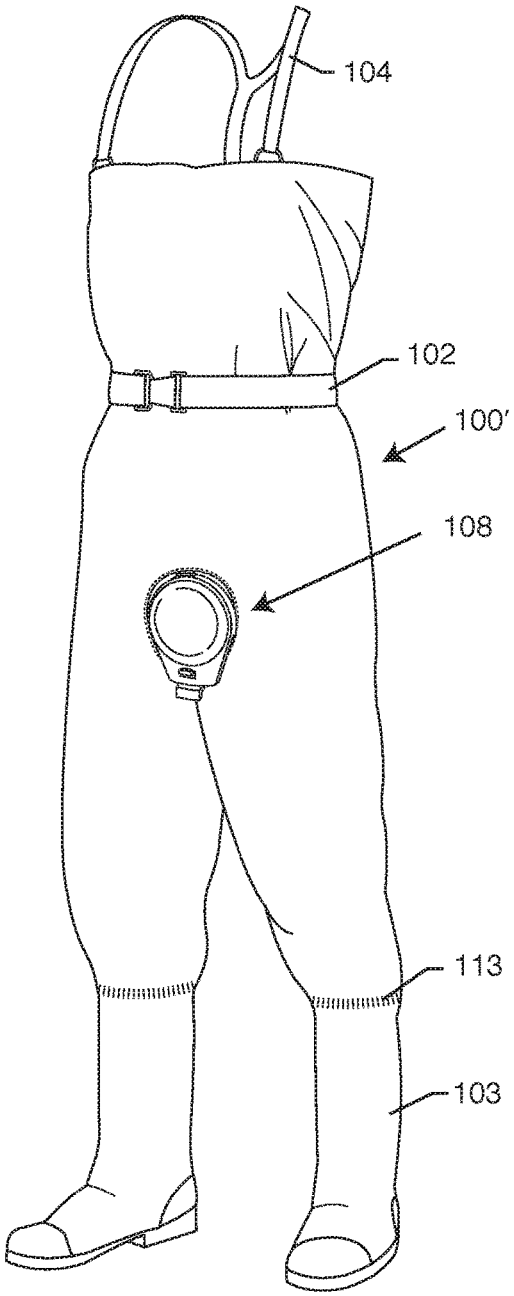
FIG. 41 is a perspective view of another embodiment of a relief hatch now with chest high pants having integrated all-weather boots.
Figure 42:
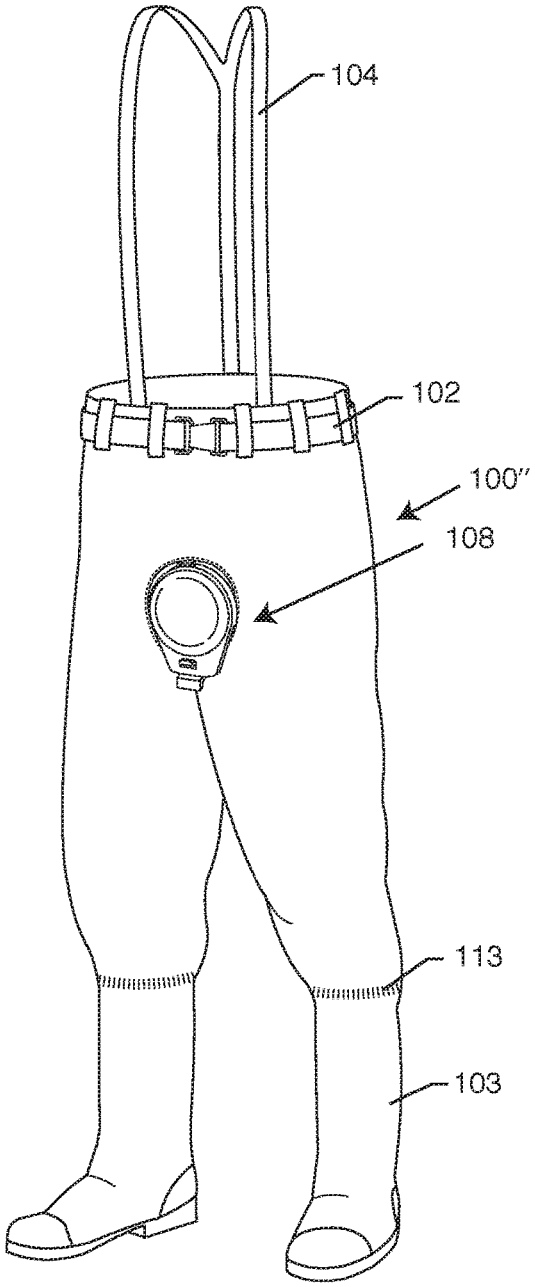
FIG. 42 is a perspective view of another embodiment of a relief hatch now with waist high pants having integrated all-weather boots.

FIG. 41 and FIG. 42 are very similar to FIGS. 37 and 38, except that in this case, the boot 103 has been sealed to at location 113 and becomes an integral piece of either the chest wader 100' or the pants 100". The boots 103 can be of a wide variety of material and have a wide variety of different sole types. Typically, the boot 103 is seam-sealed, glued, bonded or welded 113 to the material of the wader or bib 100' or the pants 100". It will be appreciated that the pant 100", as described in FIG. 38, FIG. 40 and FIG. 42, can also be integrated with suspenders 104 as previously shown for the full chest height pant or wader.

As previously described, the inventors have extensive experience both boating, wearing foul weather gear, and wading in rivers throughout the Alaska inside passage. An extremely important piece of safety gear as described in FIGS. 37 through 42 is the belt 102. If one is wading in a river and slips or falls, the entire chest-height wader or pant will instantly fill with water weighing the person down with several hundred pounds of very dangerous weight. The belt 102 prevents water from filling the waders and creating such a dangerous condition.

Figure 43:
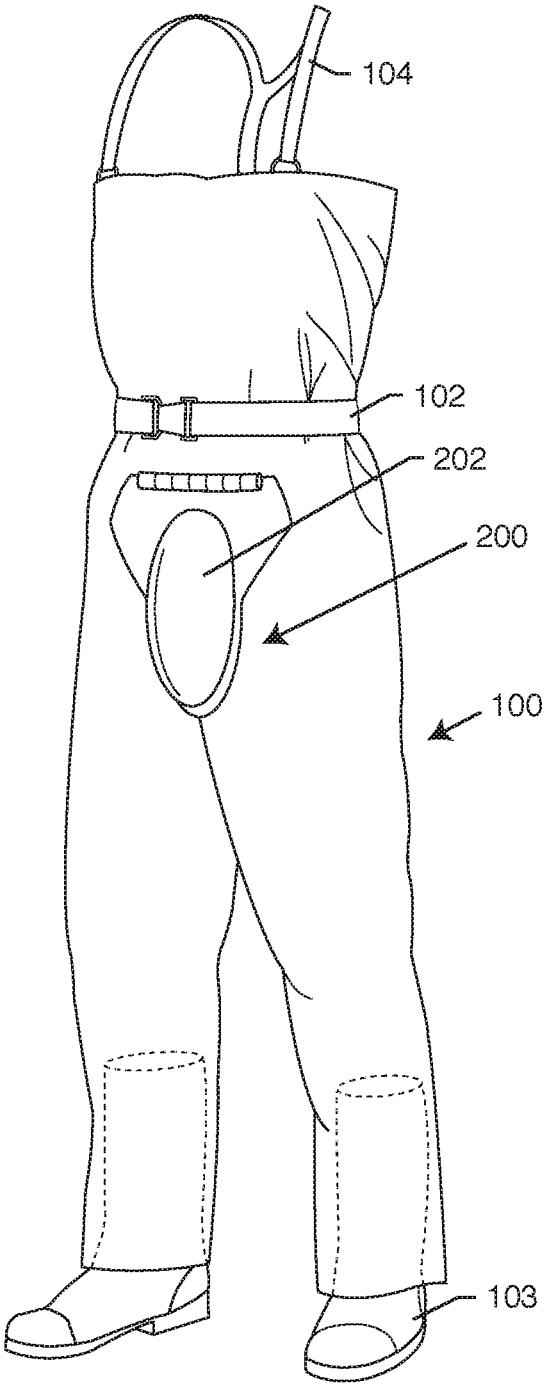
FIG. 43 is a perspective view of another exemplary embodiment of a relief hatch and groin protector of the present invention.

FIG. 43 is very similar to FIG. 2, except that the urinary relief hatch 108 has been substantially re-designed to add a number of important new features. In the summer of 2015, the inventors again spent several weeks in Alaska's inside passage both on boats and fishing in rivers. Several things were learned from this early product testing experience, and that is, the original design as shown in FIG. 2 and all of the other previous figures did not provide enough access for convenient urination. The inventors have tried a number of undergarments underneath the wader or rain suit 100. These undergarments include Levis and a variety of sweats, thermal pants and the like. In general, the inventors found that wearing a fleece undergarment with the crotch access overlay facilitated the easiest access. However, there are also many other circumstances where one wanted to have Levis, khakis or suitable undergarments, for example, if the waders were removed, in a public location, someone could, for example, go shopping afterwards. Therefore, through actual experience and testing the inventors have concluded that a completely redesigned urinary relief hatch 200 that has improved access to an underlying belt is important or improved access to an underlying button and zipper or even a draw string is desired. For example, on a number of different wading occasions, the inventors wore sweat pants with a draw string and these had no groin access flap. Accordingly, it was necessary to undo the draw string and pull down the sweats (insulating garment) to access one's private parts. The redesigned urinary access hatch 200 will be described in more detail in subsequent drawings.

In the summer of 2015 in Alaska, the inventors also spoke to a number of commercial fishermen in the marinas in which we stayed. It is very common when one enters a harbor that one talks to the Harbor Master via VHF radio who will then assign your boat to a slip. Many times, the inventors were therefore tied immediately adjacent to commercial fishing vessels and were able to observe their operations and how the crew worked on deck. The inventors observed unloading, reloading, retying of nets, stacking and handling of crab pots, and the like. The inventors came to realize that the urinary relief hatch, not only is very convenient for all of the reasons described herein, but if designed properly, could also provide a very important crotch or groin protection feature. Accordingly, the redesigned urinary relief hatch 200 has also been designed to provide protection to both the testicles and the penis.

Every type of fishing vessel that the inventors observed, from crab boat to trawler to gill netters to commercial trawlers, all have very dangerous decks with a lot of equipment and a lot of moving parts. The inventors were astounded how dangerous these environments were just by being side-tied in a calm marina. To handle all of that heavy equipment at sea, on a rocking boat or in a storm, adds further to the danger level. This caused the inventors to do some online medical research wherein, we found out some interesting facts. Men all know that even a slight knock in the testicles really hurts; however, the inventors did not fully understand until doing some research, that a hard smack down there could cause a person to pass out completely from the pain, and it is even possible to die from circulatory problems caused by damage to the testicles. Furthermore, the inventors learned that unlike some organs in your body, such as bones or your liver, which will always auto-repair over time, the testicles, once injured, are not capable of repairing themselves completely. The testicles are much more fragile and even small injuries can end up in life-long problems, including loss of one or both of the testicles. Accordingly, we came to realize that the urinary relief hatch is not just a good idea for convenience in urination, but it is also vital, particularly in commercial environments for crotch protection. Through the inventor's development, it was learned that the crotch protection offered by urinary relief hatch 200 must be properly located in order to provide protection to the testicles. Rain gear and fishing waders are often loose fitting. Therefore, having the crotch protector have a unique shape and size so that it fits against the stomach and self-locates, becomes very important. As with the discussion of the previous embodiments, the urinary relief-crotch protector 200 saves significant time for a user to quickly and efficiently urinate without the need to completely undress or leave a work area. For example, a user working on the deck of a ship can easily urinate directly into the ocean thereby saving significant down time normally required to go below deck to use the bathroom.

Figure 44:
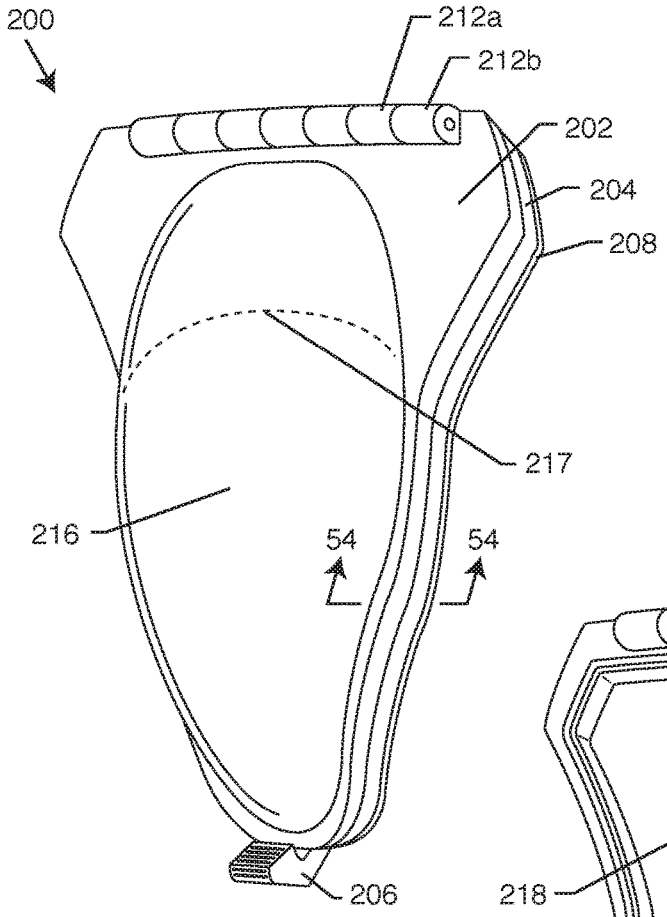
FIG. 44 is an enlarged perspective view of the structure of FIG. 43.

FIG. 44 is an enlarged view of the urinary relief-crotch protector 200 previously shown in FIG. 43. One can see that it has an enlarged flat area 202 wherein, it will naturally meet with an area just below the abdomen. The top of the hinge 212*a* and 212*b* would typically be above the belt line, button line, buckle line (or in the case of sweat pants or the like, above the draw string line). Not only has the urinary relief hatch been significantly enlarged in size, but its shape is very important, including the cup shape 216. The cup shape 216 serves a number of purposes and that is to provide enough room to comfortably fit over the genitalia and also provide enough room for one to access the penis through different types of undergarments. The dashed line 217 illustrates generally where a normal cup would stop. The curved dome structure 216 is desirably stiffer in comparison to a flatter profile which then aids in properly sealing an o-ring, seal or gasket while also providing increased impact protection.

As will be seen, there is a hinged cover 202 and a frame (i.e. base, frame base) 204. Referring once again to FIG. 44, one can see that there is a latch 206 which compresses the lid 202 down against an O-ring 214 or other suitable water-tight seal better seen in FIG. 45. It will be understood that all of the previous latches previously described can also be incorporated herein.

Figure 45:
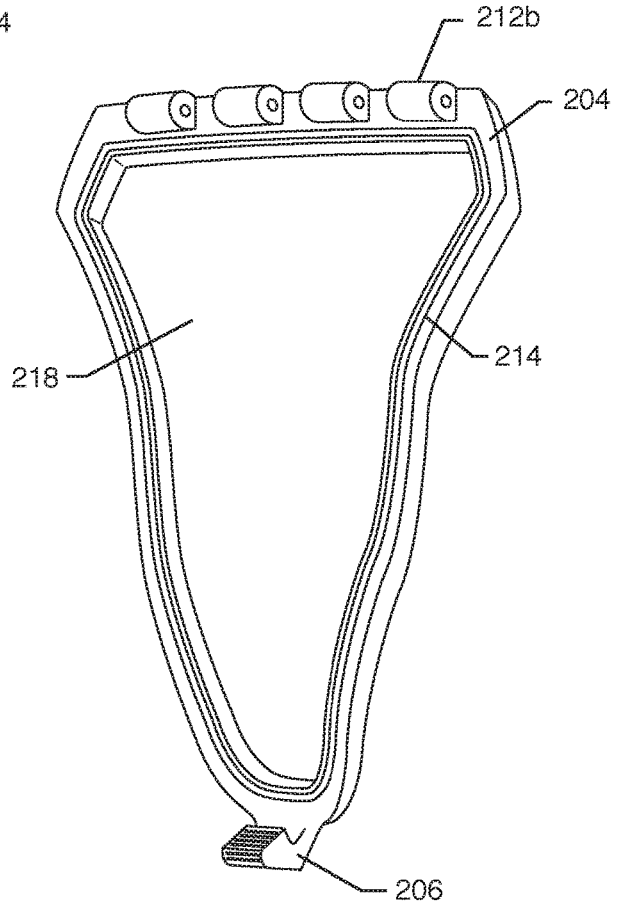
FIG. 45 is a perspective view of the base from the structure of FIG. 44.

FIG. 45 illustrates the frame 204 without the cover 202 as reference is made to FIG. 44 and in this case, the hinged lid 202 and integrated cup shape 216 have been removed so that just the frame part can be observed. One can see that the mating half of the hinge 212*b* is shown and that there is an aperture 218. One can also see that there is a seat for an O-ring 214. The flexible latch assembly is shown as 206. In this embodiment, the latch 206 can be simple due to the inherent flexibility of the plastic materials used. Importantly, the aperture 218 is much wider at the top and then narrows down. This facilitates opening up a belt or untying a drawstring or accessing a cover slot in a pair of fleece undergarments. The shape of the frame 204 has been anatomically designed such that it will seat on the skin around the legs and below the testicles such that a high impact could be sustained anywhere on the curved or cup portion 216 previously illustrated in FIG. 44.

Figure 46:
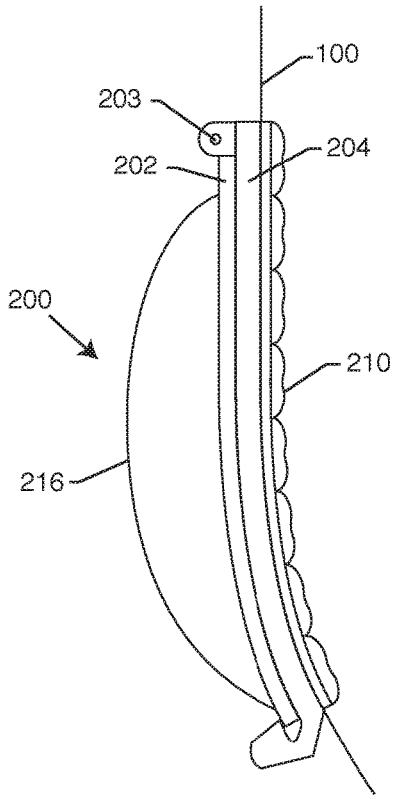
FIG. 46 is a side view of the structure of FIG. 44.

FIG. 46 is a side view of urinary relief hatch-crotch protection device 200. The cup shape 216, as previously described, can be more readily observed in this view. This takes generally the same shape as athletic protection cups as used in baseball, football and other contact sports. In the present invention, the cup area 216 has been enlarged over typical athletic cups and strengthened. One of the reasons for this is that a sliding crab pot skidding across a wet boat deck in a high sea can create huge impact forces in comparison to a contact sport. Accordingly, in some embodiments, very high strength plastics are used and even plastics that are reinforced with fibers or other materials. Those skilled in the art can also made the cup area 216 or other parts from metals, composites, polymers, fiberglass or any other suitable material.

Referring once again to FIG. 46, one can see that there is a foam material 210. This would typically be a closed cell foam. The foam helps absorb the impact and prevents skin bruising from a high impact. The foam 210 also assists in comfort as one wears this all day. Foam 210 can be formed from any other stress absorbing pliant material such as EVA foam or the like.

Figure 47:
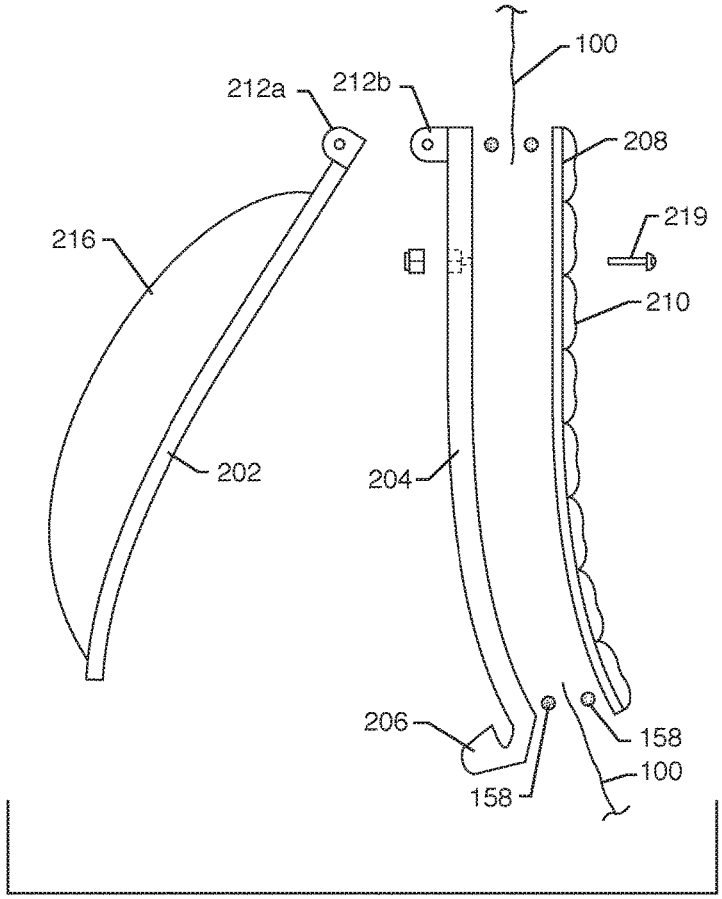
FIG. 47 is an exploded side view of the structure of FIG. 46.

FIG. 47 is taken from FIG. 46 with the various parts exploded. The urinary relief hatch cup structure 216 is shown on the left separated from hinge 212*a* and 212*b*. A hinge pin 203 has been removed. In this case, the frame structure is shown in two pieces: frame front 204 and frame backing 208. This is so they can be sandwiched around a wader or foul weather gear pant 100, which is thereby compressed in between. In this case, frame 208 forms the function of a backing plate.

There are various fasteners 219 that can be used to join the backing plate 208 to the frame 204, including a screw and lock nut as shown, rivets as previously described or even adhesives 158. In a particular embodiment, the frame is one piece without the need for the backing plate 208 at all. In this case, the wader or foul weather suit material would be directly bonded to the frame through gluing, adhesive, or welding processes.

Figure 48:
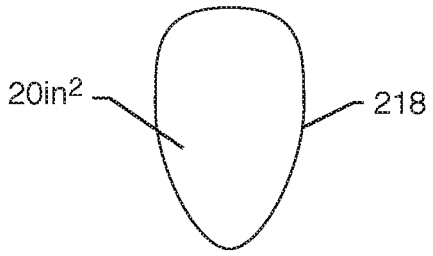
FIG. 48 is a front view of an exemplary embodiment of an aperture of the present invention.

As can now be seen, the urinary relief hatches that are described in previous drawings of the invention, generally, are relatively smaller in cross-sectional area than the improved combination urinary relief hatch-crotch protection device 200. FIG. 48 shows an aperture 218 generally conforming to the cup area and has a cross-sectional area of 20 square inches. This is considered to be a minimum in the present invention to accomplish all of the objectives of being able to readily access the penis and to also provide sufficient coverage to a forward impact protection to the penis and testicles.

Figure 49:
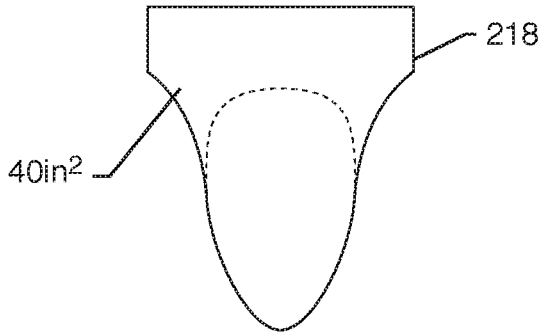
FIG. 49 is a front view of another exemplary embodiment of an aperture of the present invention.

FIG. 49 illustrates another redesigned version opening 218, which has a full 40 square inches of aperture opening. In this case, as previously described, there is enough access to undo a belt or untie drawstrings so that an underlying garment may be opened up or pulled down.

Figure 50:
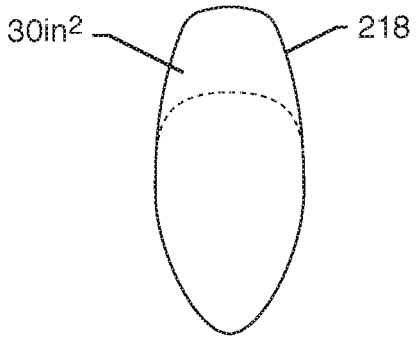
FIG. 50 is a front view of another exemplary embodiment of an aperture of the present invention.

FIG. 50 illustrates another embodiment that has a size of approximately 30 inches squared which is between the sizes depicted in FIGS. 48 and 49.

Figure 51:
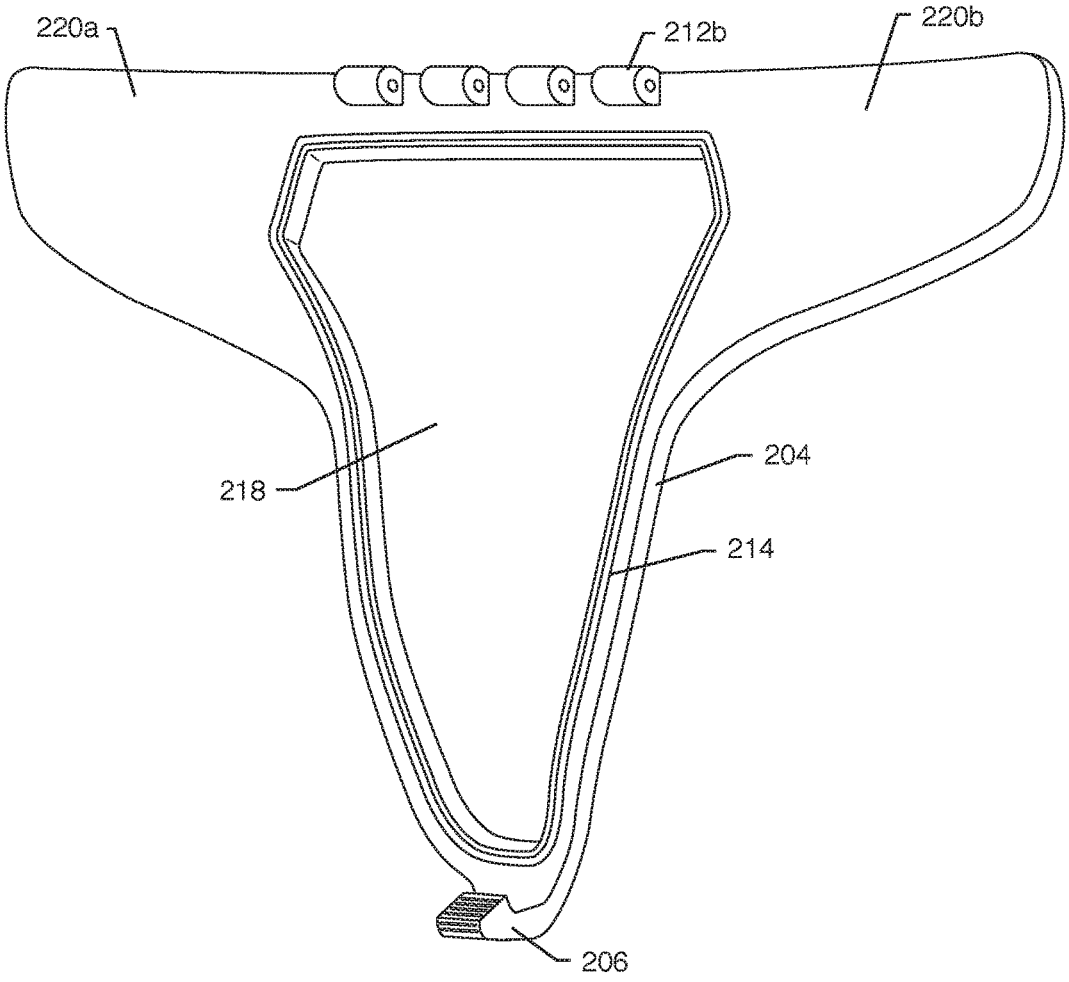
FIG. 51 is similar to FIG. 45 showing another embodiment of an exemplary base now including left-side and right-side extensions.

FIG. 51 is very similar to FIG. 45, however now FIG. 51 includes extensions 220*a* and 220*b* that are integrally formed as part of the frame 204. The extensions 220 allow for a greater amount of surface area for an impact to be distributed into the user's body, such as the impact is not localized around the edge of the frame as in FIG. 45, but instead is now distributed over a larger surface area as shown in FIG. 51. It is understood by those skilled in the art that these extensions 220 can be strategically placed around the perimeter of the frame 204 and other locations not shown.

Figure 52:
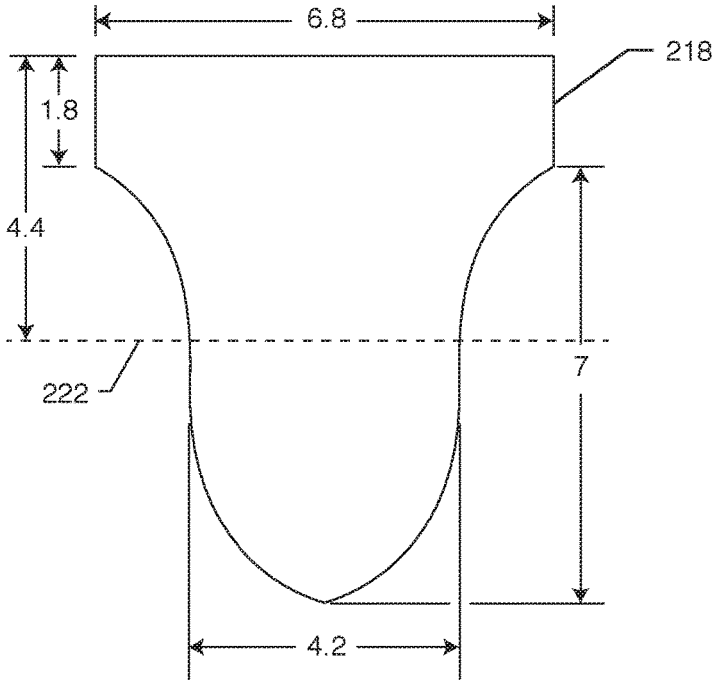
FIG. 52 is a front view of another exemplary embodiment of an aperture of the present invention with an acorn-like shape.

FIG. 52 shows the dimensions on just one embodiment of the shape the aperture 218 may take. In this embodiment, the width at the top is about 6.8 inches. Then the sides come down about 1.8 inches. The sides transition to a curved shape that has a width of about 4.2 inches and a height of about 7 inches. Therefore, the overall height of the aperture is about 8.8 inches. This embodiment described herein shows how the aperture 218 has been improved in comparison to the prior versions originally disclosed. As can be seen, the top half of the aperture comprises a larger amount of surface area as compared to the bottom half of the aperture if a middle line 222 was to be drawn about 4.4 inches from either the top or the bottom. It will be understood by those skilled in the art that the structures and shapes could be sized down to fit smaller and/or younger users.

Figure 53:
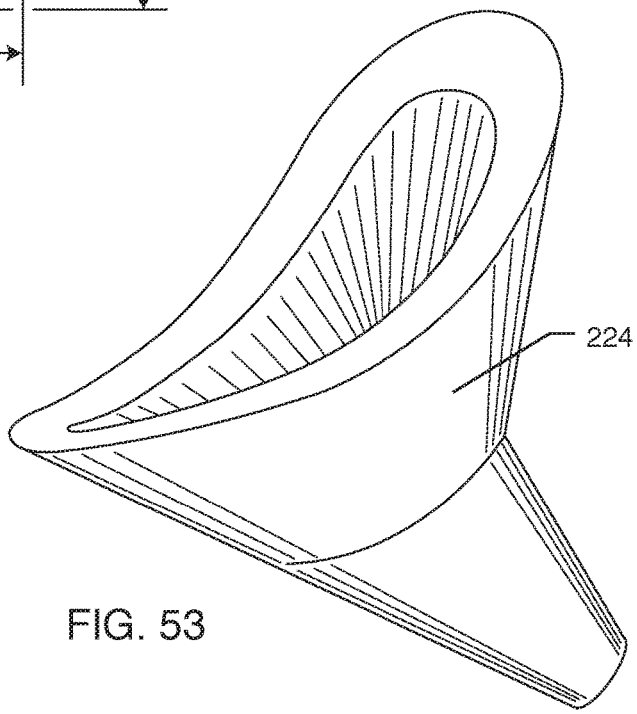
FIG. 53 is a female urination aid that may be used with the present invention.

The redesigned urinary relief hatch-crotch protection device 200 has also been designed through experience to accommodate the female body. FIG. 53 depicts a urinary device 224 which, as one example, is called the GoGirl™. One is referred to their website go-girl.com to see what the GoGirl™ looks like. As one can see, it is a soft rubber structure that is placed against the female body so that the female can, for example, urinate through a zipper. The redesigned and enlarged hatch described in FIG. 43 and on, is also particularly designed to accommodate and receive the device 224 or an equivalent device.

Figure 7D:
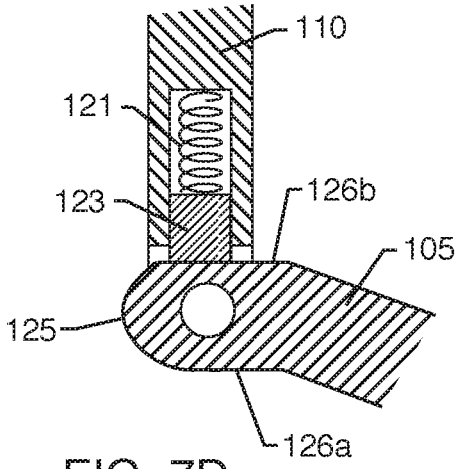
FIG. 7D is an enlarged view of a similar structure of section 7D-D taken from FIG. 7 now showing a new embodiment of a cam mechanism.
Figure 7E:
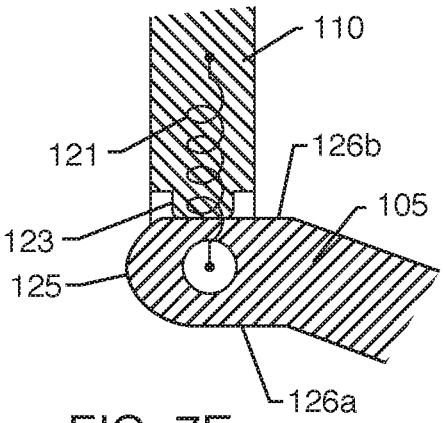
FIG. 7E is an enlarged view of a similar structure of section 7D-D taken from FIG. 7 now showing another new embodiment of a cam mechanism.

The inventors also show new embodiments for hinge designs which are captured in FIGS. 7D and 7E. FIG. 7D shows the lid 110 pivoting above the base 105. In FIG. 7D, a slider 123 moves within the lid 110. A spring 121 forces the slider into abutment with the base 105. As the lid 110 pivots about the base 105, the slider 123 goes from abutting the flat 126*a* to then abutting the corner 125 and forced away from the corner 125 to then abutting the second flat 126*b*. In this way, the lid 110 is held open as the slider 123 abuts a flat surface 126 of the base 105.

FIG. 7E is another embodiment similar to that shown in FIG. 7D, where now, the spring 121 pulls the base 105 and the lid 110 closer together. The spring 121 is shown schematically for simplicity. In this situation, the slider 123 is integrated into the lid 110 and the slider 123 engages the flats 126*a* and 126*b* while it is forced by the spring 121 away from the corner 125 as it pivots about the base 105. In this way, when the lid 110 is in an open position, it will remain so as the slider 123 is against the flat surface 126 of the base 105.

In general, the present invention has applications both in fresh water and salt water fishing wader environments, as well as all kinds of foul weather gear application. In particular embodiments, this includes foul weather gear for marine applications, including commercial fishing and long-range cruisers. Accordingly, the materials must all be such that they will not corrode in a salt water or high salt spray environment. Referring once again to FIG. 7D and FIG. 7E, the plastic structures 105 and 110 inherently will not corrode. The slider mechanism 123 could be of plastic as well or it could be of a suitable non-corrosive metal, such as titanium or various alloys of stainless steel and the like. Spring 121 could be of stainless steel-type 302 or alloy 316 will also work well in marine environments.

Referring back to FIG. 7A, it would be considered a likely embodiment for commercialization because the spring 107 (stainless steel or the like) automatically raises and keeps the hatch open. This would also serve as a warning device, if the latch became undone or loosened for some reason, one would immediately notice that the hatch was raised up. From actual experience thrashing through brush and thickets along the edges of rivers in Alaska, one could easily envision how the latch could be bumped before one enters back into the river. Accordingly, the spring system of FIG. 7A or a similar embodiment is a strong candidate for production.

Figure 54:
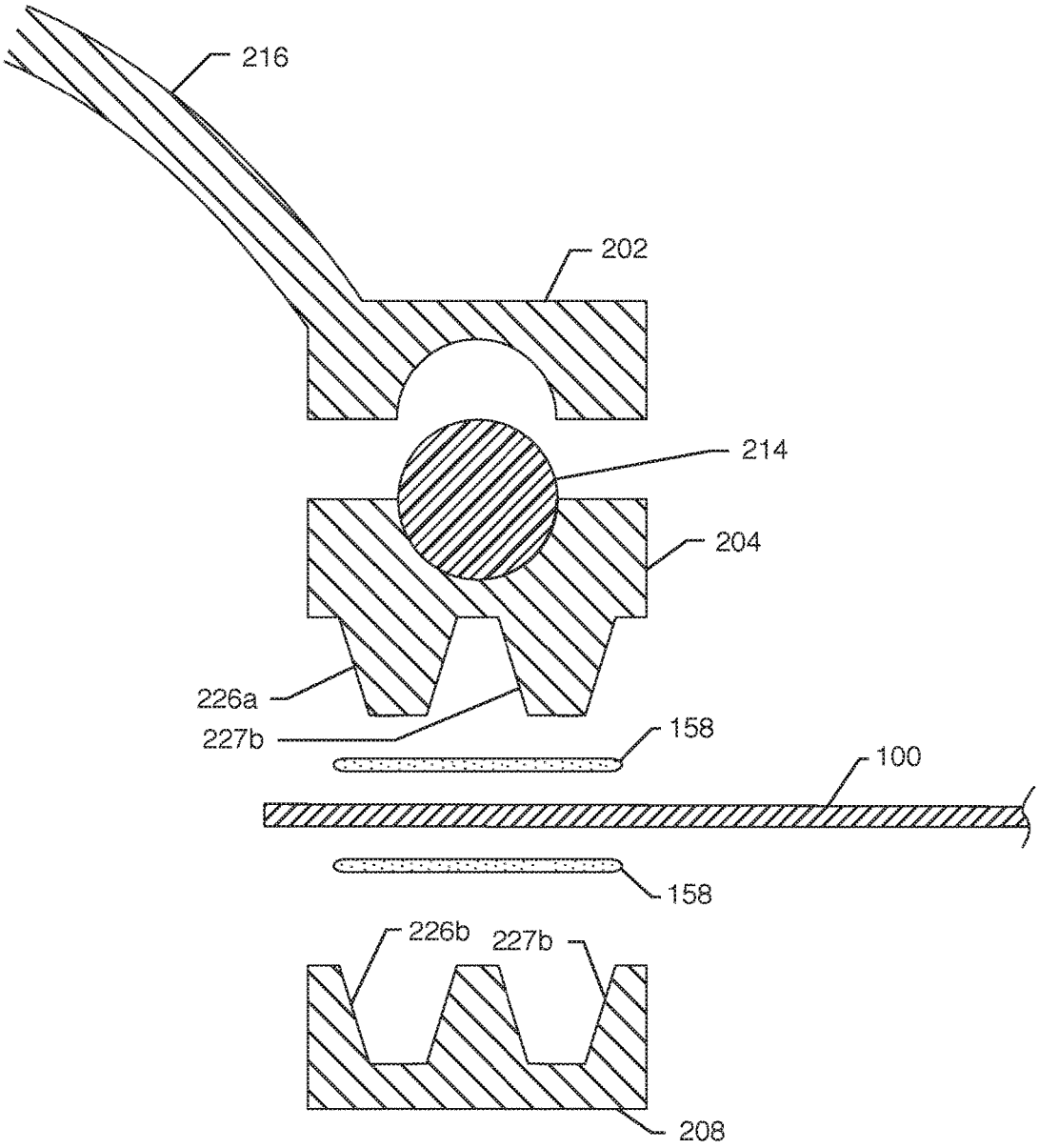
FIG. 54 is an exploded sectional view taken generally from lines 54-54 of FIG. 44 now showing the wader material captured in castellation-like features.

FIG. 54 is a sectional view taken generally from section 54-54 from FIG. 44. One is also referred to FIG. 6 specifically, where the water-tight joint is made between the wader or fishing garment material 100 and the urinary relief hatch frame 130. Referring once again to FIG. 44, one can see that in the area of the section 54-54, the frame 204 and lid 202 are relatively narrow. This is important for comfort and fit particularly while somebody is hiking, walking or moving about. This does present challenges in order to seal the urinary relief hatch frame 204 to the wader or fishing pant material 100. FIG. 54 illustrates a methodology in which a very narrow and strong water-tight joint can be made between the wader/pant material 100 and the frame 204. Shown, are the cup portion 216 and the urinary relief hatch sealing location 202 where it seats on O-ring 214. Water-tightness is achieved by the tight pressing of the urinary relief hatch 202 against the O-ring (gasket, seal, compressible washer) which is seated into the frame element 204. An important feature here is the torturous path provided by castellations 226*a* and 227*a* and their female mating features 226*b* and 227*b* in the backing plate 208. When the backing plate 208 is firmly compressed against the frame 204, the wader-pant material 100 is sandwiched between this torturous path area and firmly held in place. In an embodiment, an adhesive or bonding material 158 is used in conjunction with the compressing of the wader/pant material between these castellation surfaces 226/227. Two castellations 226 and 227 are shown, however, it will be understood by those skilled in the art that any number of castellations (one, two, three or . . . n) can be used. In other words, the structure shown in FIG. 54 pinches and grabs a hold of the wader material 100 in such a way that has enormous sheer strength and increased mechanical strength, particularly in the area of the urinary relief hatch where it is quite slender.

Figure 55:
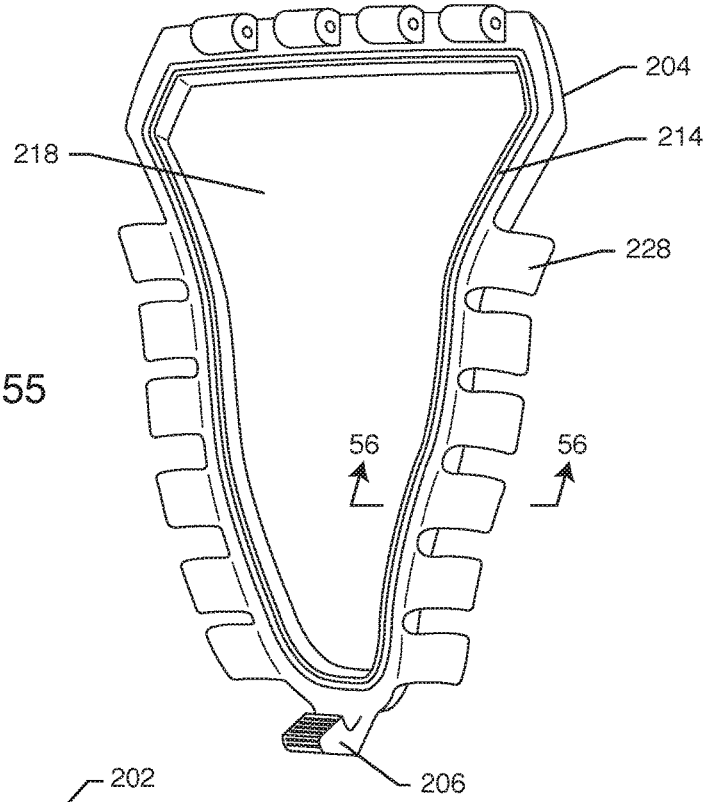
FIG. 55 is a perspective view of another exemplary embodiment of a frame now with tab-like extensions for better bonding to the wader material.

FIG. 55 is very similar to frame FIG. 45 except that the flexible plastic/polymer tabs 228 have been co-bonded to become an integral part of the frame 204. These tabs 228 could be used in conjunction with the simple waterproof joint previously illustrated in FIG. 6, which is the joint between the wader/pant material 100 and the frame 130; or, referring to FIG. 56, which is taken from section 56-56 in FIG. 55, one can incorporate the castellation features with the increased surface area of the tabs 228 to further improve the sheer strength and overall mechanical strength of the bond between the wader/pant material 100 and the frame 204.

Figure 56:
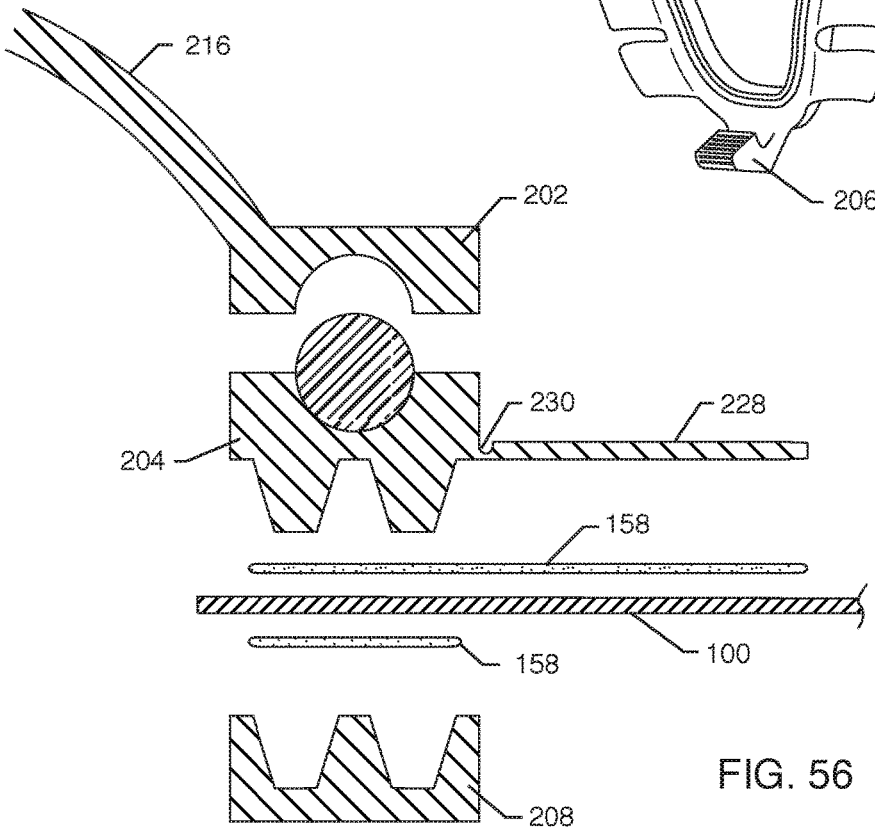
FIG. 56 is an exploded sectional view taken generally from lines 56-56 of FIG. 55 now showing the tab-like extension and how it can pivot at the reduced thickness flexure.

FIG. 56 is a sectional view taken generally from section 56-56 of FIG. 55 and better illustrates the tabs 228. The tabs can be formed as an integral part of the frame 204 or can be attached in a secondary process such as in an over molding step. The tabs 228 could also be located on the backing plate 208. The tabs 228 can also include an area 230 of reduced cross sectional area that then operates as a living hinge. The reduced area 230 increases the flexibility and movement of the tabs 228.

Figure 57:
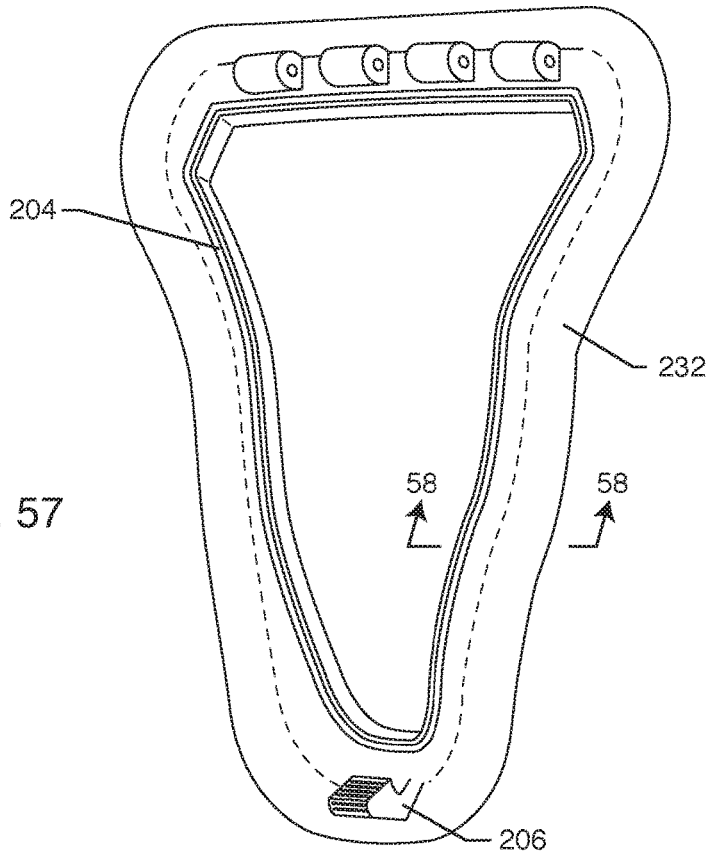
FIG. 57 is a perspective view of another exemplary embodiment of a frame now with a continuous flexible extension for better bonding to the wader material.

FIG. 57 is very similar to FIG. 55 except that the flexible tabs 228 have been made into a continuous surface/flexible extension 232, which surrounds the entire perimeter of the base frame 204 of the urinary relief hatch.

Figure 58:
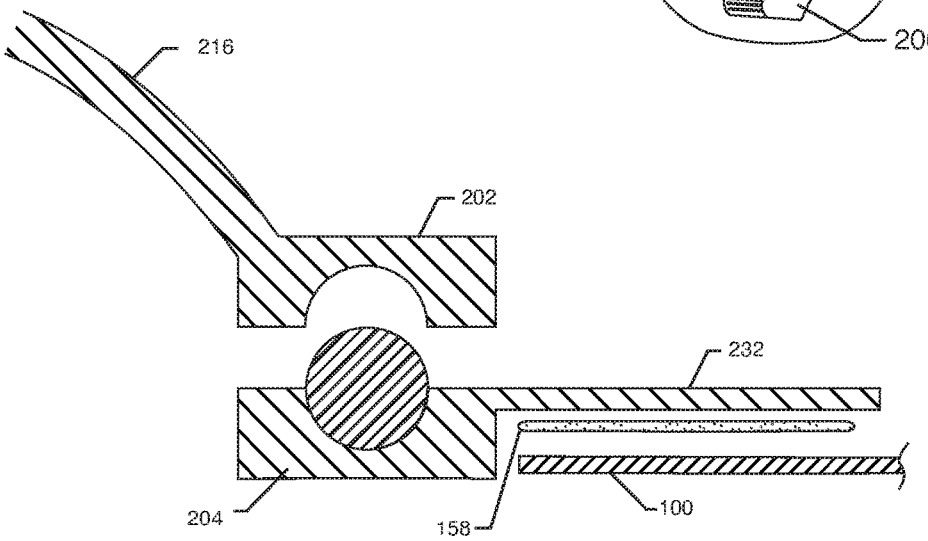
FIG. 58 is an exploded sectional view taken generally from lines 58-58 of FIG. 55 now showing the continuous flexible extension and how it can be bonded to the frame.

FIG. 58 is a sectional view taken generally from section 58-58 of FIG. 57 and better illustrates the continuous surface 232. In this embodiment the backing plate 208 is no longer needed as a sufficient amount of surface area is created for a proper water-tight bond between the flexible extension 232 and the wader material 100. An adhesive 158 is used to create such a bond that is water-tight and also mechanically strong. The flexible extension can be of the same material as the frame 204 or made from a more flexible and resilient material that is then over molded to the frame 204. Plastic molding and thermal bonding processes may be used as alternatives to adhesive 158.

Figure 59:
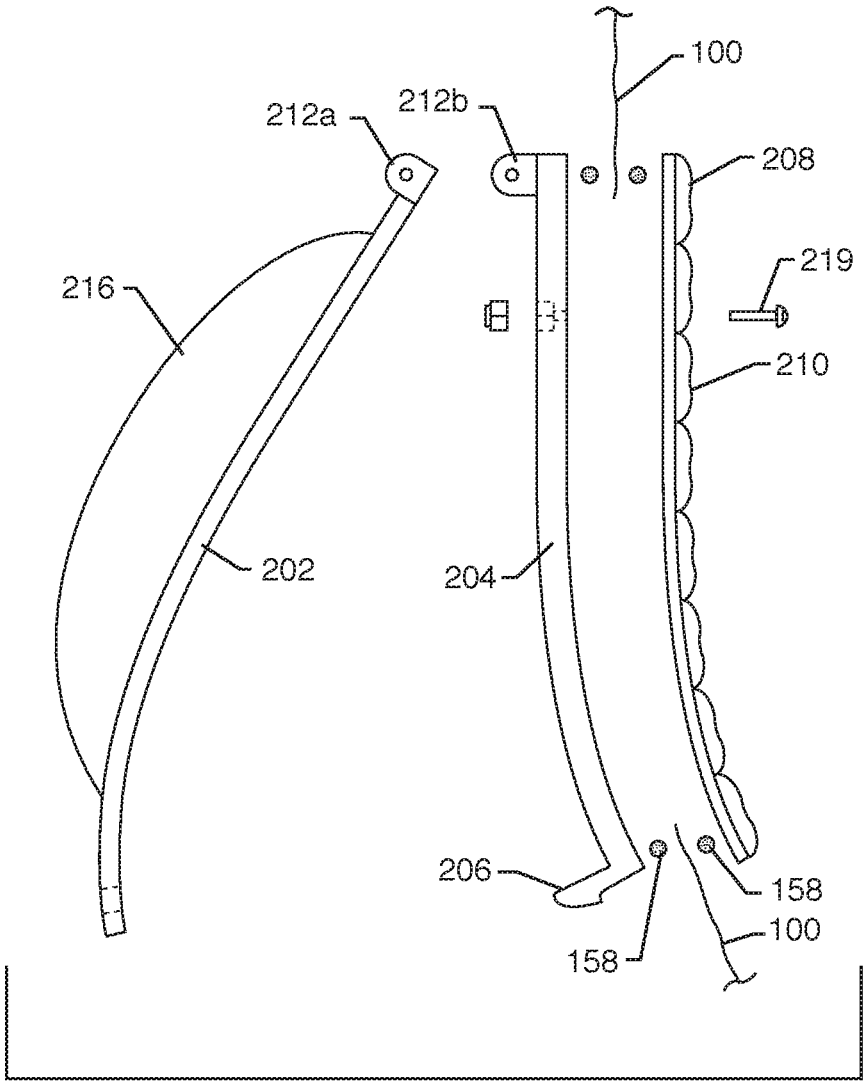
FIG. 59 is an exploded side view similar to FIG. 47 now showing the latch facing the opposite direction for ease of molding.

FIG. 59 is similar to FIG. 47 now showing that the latch 206 may be reversed such that the lid 202 may be made from a simple two-part mold. Additionally, the frame 204 may also be made from a two-part mold. These designs simplify the structure of the invention and allow it to be manufactured at a lower cost.

Figure 60:
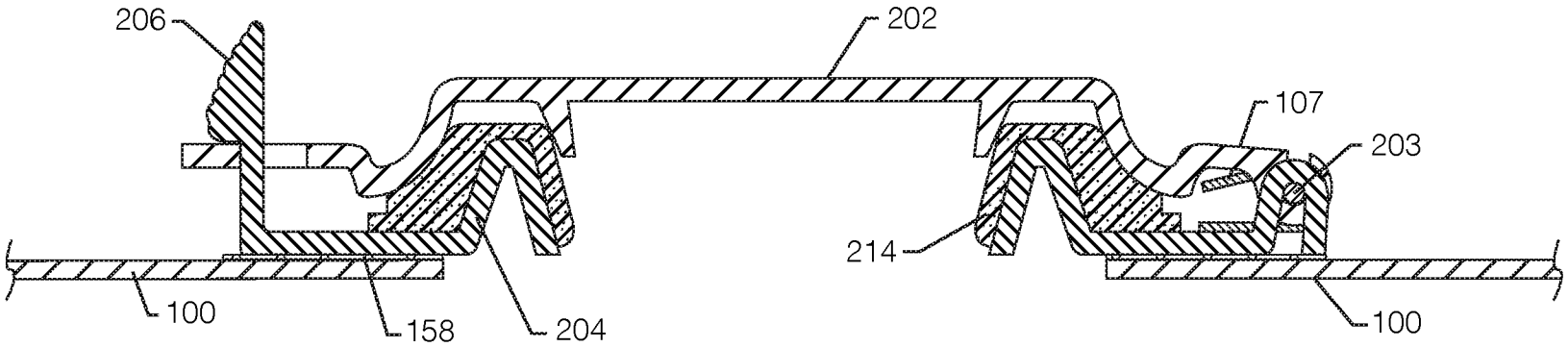
FIG. 60 is a sectional view of one embodiment of the present invention with a double seal.

FIG. 60 is a sectional view of another embodiment of the present invention. The lid 202 and the frame 204 have been designed to be made from a simple two-part mold. The seal/gasket 214 may create a double circumferential sealing structure as the lid 202 engages the seal/gasket 214 at two circumferential locations to increase the reliability of the sealing mechanism. The wader 100 is bonded to the frame 204 with adhesive 158 with any of the previously taught methods or structures, such as with adhesives, fabric seam welding, heat sealing or mechanical clamps and fasteners. The hinge pin area 203 of each of the lid 202 and frame 204 can be slotted on respective sides to facilitate the two-part mold but still function to capture the hinge 203 properly. Finally, the spring 107 would be placed around the hinge 203 to keep the lid 202 in the open position for ease of urination while in use.

Figure 61:
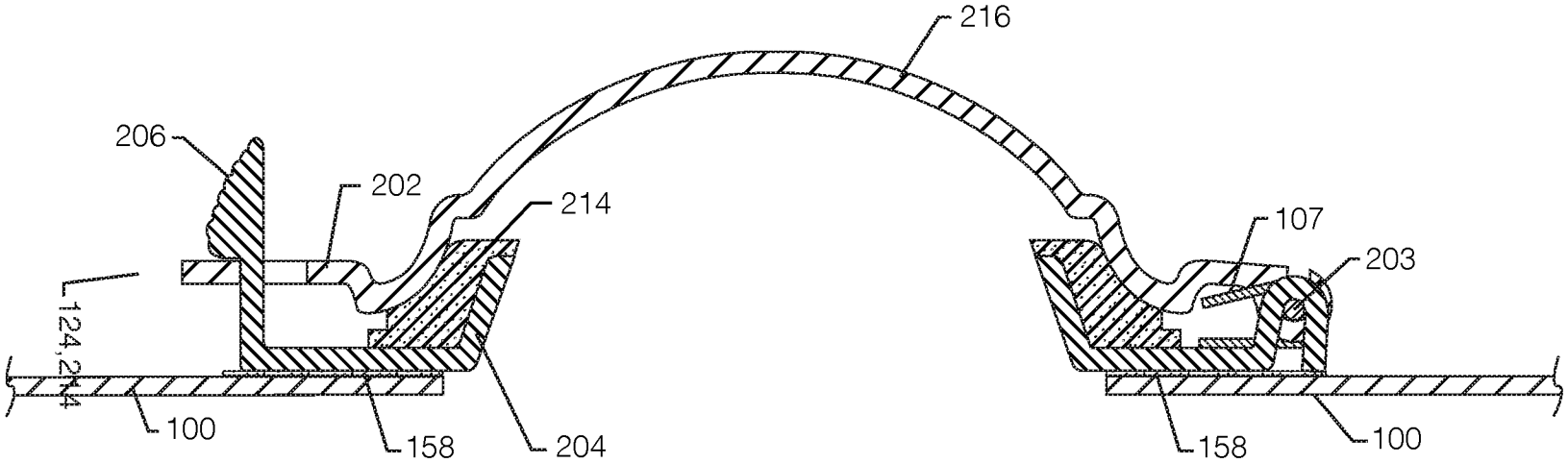
FIG. 61 is a sectional view of another embodiment of the present invention with a single seal.

FIG. 61 is a sectional view of another embodiment of the present invention. The lid 202 now has the curved section 216. The lid 202 engages the seal/gasket 214 at just one location around the circumference. The wader 100 is bonded to the frame 204 with adhesive 158. Similar to FIG. 60, the lid 202 and frame 204 of FIG. 61 can be manufactured with a simple two-part mold. As will be understood by those skilled in the art, all of the embodiments shown and described herein can be simplified to be made from a simple two-part mold that doesn't require the use of perpendicularly moving sliders or pull outs. These cost saving features reduce the upfront mold costs and lead to less parts which lowers overall cost of production.

In more detail regarding the various attachment methods, the wader 100 can be fabric welded to the frame 204. Fabric welding is the process of joining pieces of fabrics using heat and pressure. Thermoplastic coatings, such as polyvinylchloride (PVC), polyurethane (PU), polyethylene fabric (PE) and polypropylene (PP) are used for heat sealing. Once done, fabric welding reduces maintenance cost as there is no need of threads, sewing machines, seam tapes or any other such material.

There are basically two types of fabric welding: dielectric welding and rotary welding. They are further categorized into many types of welding of which four are mostly used by the professionals such as: hot air welding, hot wedge welding, radio frequency welding and ultrasonic welding. Hot air, hot wedge, and ultrasonic welding are generally categorized as rotary welding. In this type, the fabric moves continuously through the machine while it is being welded. Radio frequency welders are a stamping type machine. The fabric pieces don't move but are held in place while they are being welded.

Dielectric welding is the older of the two types of welding. In this method, a die is lowered onto the two fabric pieces that are supported by an underlying base plate. A timed pulse of radio frequency energy is sent between the die and the base plate. The fabric between the die and base plate gets heated enough so as to melt the thermoplastic coating on a temporary basis. With the melting of this coating, both pieces of fabric are fused together. The die is then lifted and new pieces of fabric move into position, and the whole process is repeated again.

Rotary welding is a continuous process where the fabric pieces move continuously through the welding area, usually pulled along by a pair of drive wheels. Heat is sent through any of the sources like heated metal wedge or hot air, just before the fabric passes between the drive wheels. On the drive wheels, the welding pressure is applied which seals the fabric permanently. Rotary welding is faster than dielectric welding. The speed increases with the length of the products and seams. Welding speeds of up to 20 feet (6 meters) per minute and even higher can be achieved through it. However, rotary heat sealing requires a skilled and well trained operator to achieve full speed and flexibility. It is also capable of producing three dimensional finished products (products that do not lie flat) like garments, inflatable boats, bags, and luggage. As dielectric welding uses flat base plate, it restricts its application to the products whose seams must lie flat during the sealing process. However, nowadays, certain specialized dielectric welders have three dimensional dies, base plates and vacuum systems for holding the fabric pieces in position while the dies are applied but they are very costly.

Although rotary wedge welding and rotary hot air welding are both the types of rotary welding, there are certain differences between them. The hot air welding is a faster welding process than the hot wedge welding. In wedge welding, a small metal wedge is used to deliver heat to the fabric immediately before it passes between the drive wheels where pressure is applied to seal the fabric together. In hot air welding, a hot air nozzle instead of a metal wedge is used to deliver heat.

When the seaming process is interrupted for a short while, the heat in the wedge builds up and when the fabric is again put in for seaming, it can sometimes burn the fabric at the initiating point itself. When using hot air welding, there is no such problem of heat build-up. As the wedge welding uses metal to deliver heat, some or the other type of contamination like dirt or melted coating bits, sometimes block the heat transfer, thus resulting in its non-uniformity. Hot air welders use air to deliver heat and so results in uniform heat transfer. Surface irregularities of fabric, such as a cross seam, raise the wedge as it goes over the irregularity hampering the quality of welding which is not in the case of hot air welding as air is not rigid and flows over the surface irregularities. However, wedge welding consumes less power and relatively produces less noise when compared to the airflow sounds coming out from hot air welders.

When analyzing these differences, it appears that wedge welding is more suitable for welding relatively simple products that are made from less technically advanced fabrics having regular and smooth surfaces. Hot air welding, on the other hand, can be used for more advanced designs and fabrics.

As can be understood by those skilled in the art, any of the attachment methods described throughout the entirety of this disclosure may be used to attach the wader 100 to the frame 204 as the embodiments disclosed herein are not limited to any one method or process.

Figure 62:
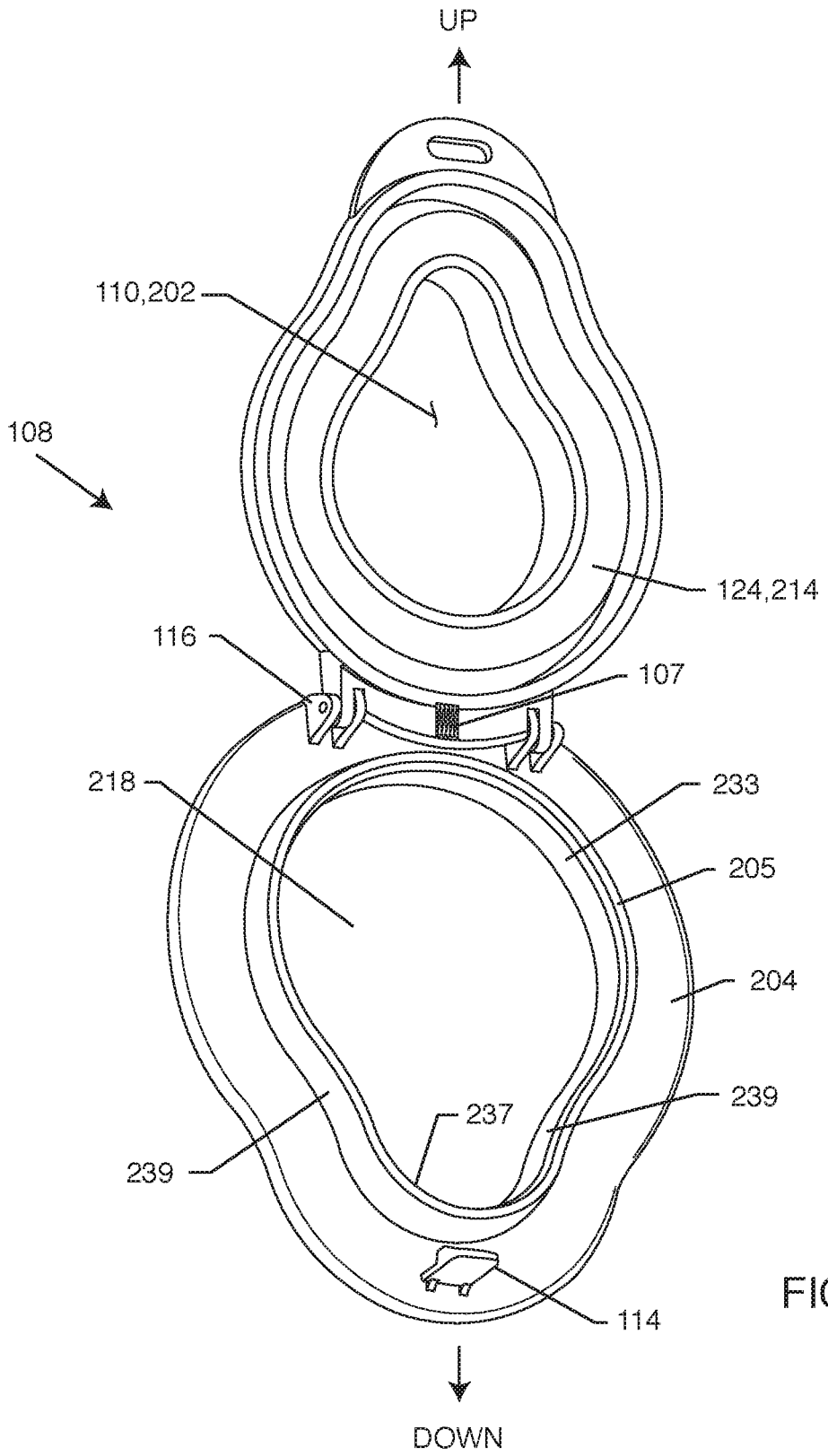
FIG. 62 is a perspective view of a further advancement of the urinary relief hatch assembly.

FIG. 62 is a perspective view of a further advancement of the urinary relief hatch assembly 108. As can be seen, aperture 218 is smaller directed toward the downside (bottom). Accordingly, it is also much larger in cross-sectional area toward the upside. This was as previously described in FIG. 52. Also shown is the latch 114, the hinge assembly 116 and a spring 107, which also may be combined so that the lid 110, 202 is kept in a convenient open position while one is urinating. A formable seal 124, 214 is shown, which in the closed position, is designed to form a water tight seal against the raised portion 205 of the base plate 204 (frame, frame base). The base plate 204 is also known as a frame or frame element, as these terms have been used interchangeably in this description.

Figure 63:
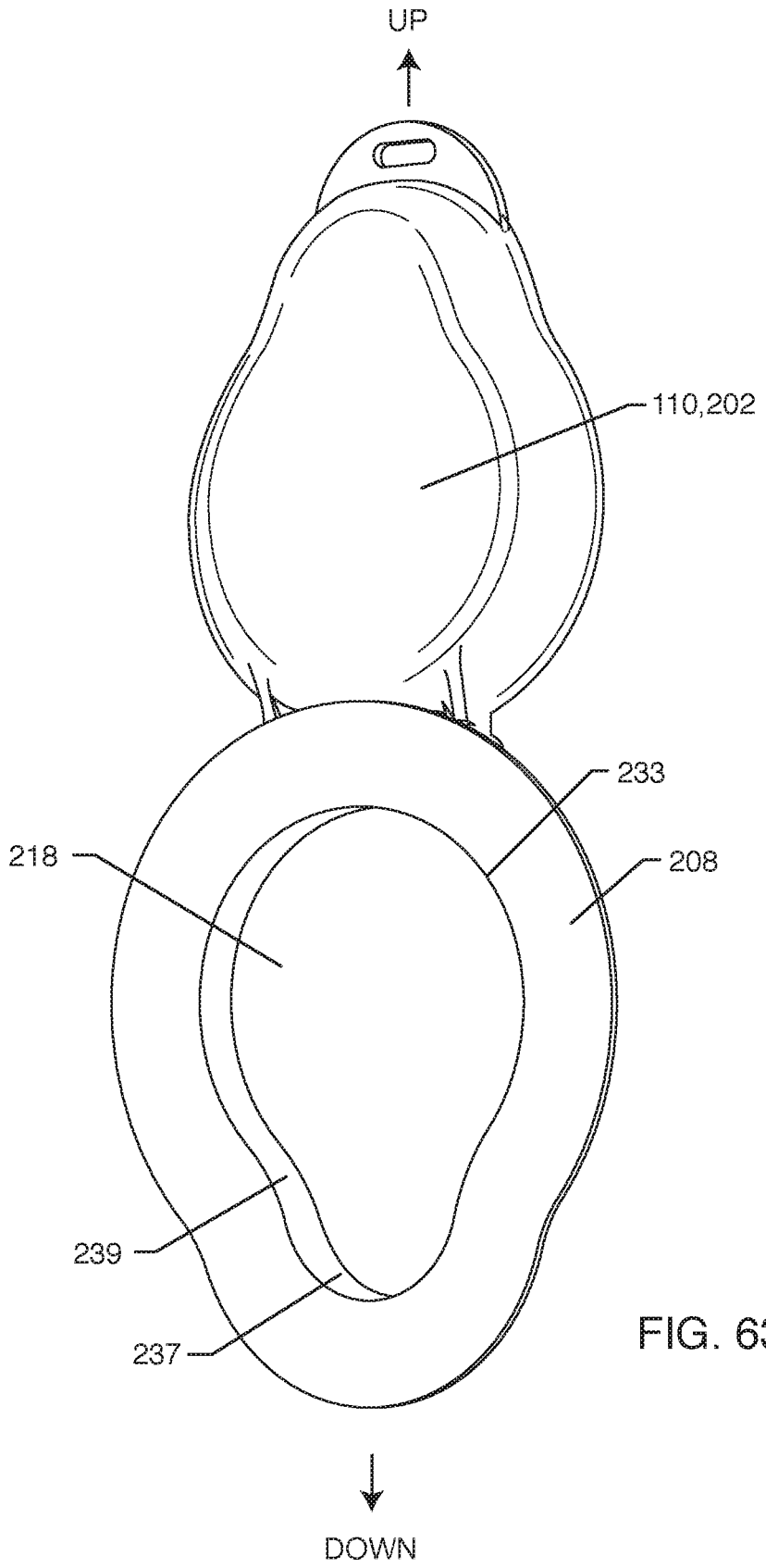
FIG. 63 is a perspective view of the structure of FIG. 62 now from an opposite direction.

FIG. 63 is very similar to FIG. 62 except that the urinary relief hatch assembly 108 has been rotated so that we are now looking at the back side of it. The opening/aperture 218 is as previously described in FIG. 62. In this case, one can see the reverse side of the urinary relief hatch 110, 202. A backing plate 208 is shown, which in an embodiment may somewhat flexible or in a different embodiment may be rigid. The backing plate 208 is used to sandwich the wader or pant material 100 between the backing plate and the frame 204. Referring back, FIG. 54 shows how the wader material 100 can be sandwiched between the backing plate 208 and frame element 204 through the use of castellations 226 and 227 which are optional. An adhesive 158 can be placed on one side or both sides of the wader material 100 that is sandwiched between the frame element and the backing plate.

Figure 64:
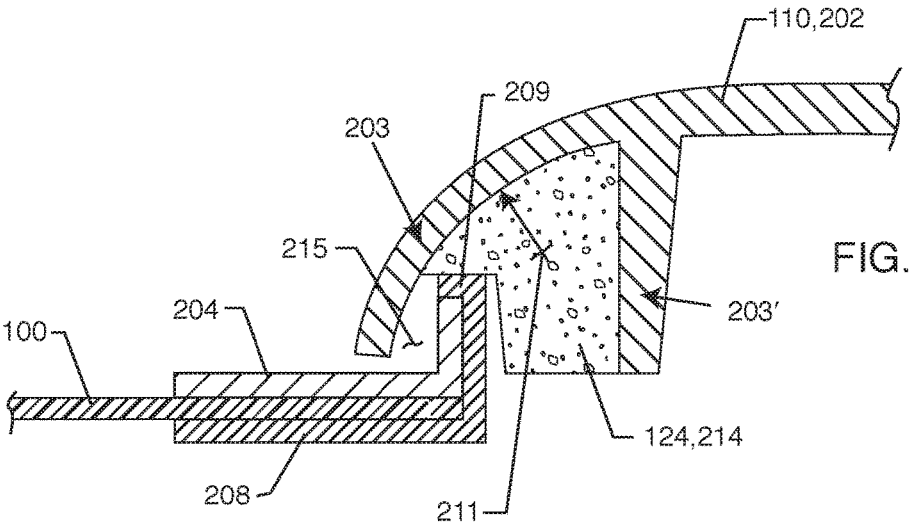
FIG. 64 is a sectional view of an exemplary embodiment of a sealing area that could be used with structure of FIGS. 62 and 63.

FIG. 64 is a cross-sectional view of one exemplary embodiment of the sealing area. It shows the wader material 100 sandwiched between the backing plate 208 and the frame element 204. It will be appreciated that adhesives 158 (not shown) would be disposed on one or both sides of the wader material 100 as it is sandwiched between the frame element 204 and the backing plate 208. The urinary relief hatch (also known as "the lid") 110, 202 is configured to hold a forcible O-ring material 124, 214, which in one embodiment would be a silicone O-ring or specially shaped seal material. In this case, we are using the word "O-ring" but it will be understood that the letter "O" has no meaning in this context, meaning that it could be round (O) or any other shape, such as the special shape disclosed in FIG. 64. When the lid 110, 202 is in the closed position as shown in FIG. 64, the flexible seal O-ring element 124, 214 is compressed against the upper end 209 of the backing plate 208. The frame element 204 is configured such that it is also L-shaped and fits against the upper portion 209 of the backing plate 208 and underneath the flexible seal mating surface 124, 214. Through extensive initial prototype testing, it was found that this particular seal configuration can work fairly well, but has some significant disadvantages. One significant disadvantage was the need to glue or use a sealant to attach the O-ring element 124, 214 to the inside curvature 211 of the lid 110, 202. Through testing, it was discovered that insufficient axial sealing force was being applied at location 209 and being distributed over the wide radius arch 211. Another significant disadvantage was found during testing of this prototype. This particular design does not accommodate variations in wader material 100 thickness. In fact, the first prototypes actually leaked at a wader seam and a bump was formed in the backing plate 208, which caused a non-uniform seal at location 209. In other words, these prototype versions of the present invention tended to leak water when tested in a swimming pool at location 209.

Figure 65:
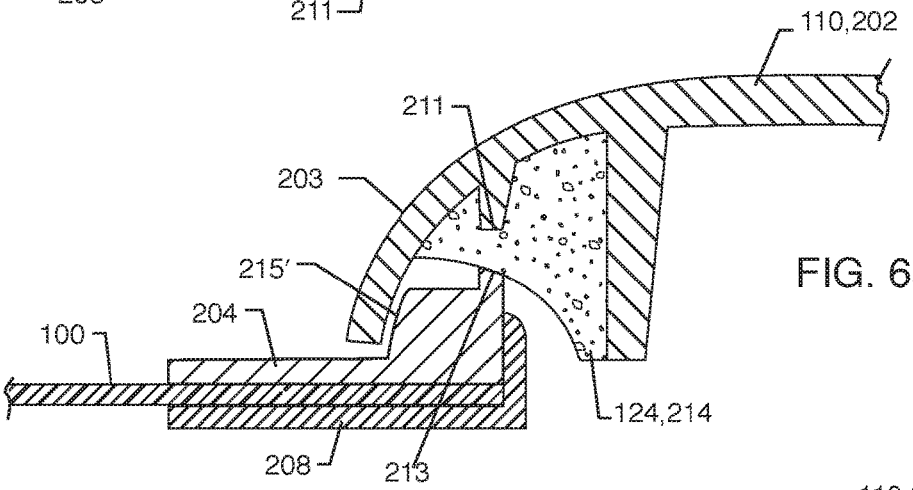
FIG. 65 is a sectional view similar to 64 now showing another exemplary embodiment of a sealing area.

FIG. 65 illustrates an attempt at an improved version of the urinary relief hatch assembly prototypes. First of all, one can see that the structure is no longer depending on the backing plate 208 to form the seal against the flexible O-ring material 124, 214. This means that variations in the wader thickness 100 do not matter. It will be appreciated that some inexpensive waders are made of simply a sheet of rubber. Other more expensive waders could be made of Gortex, PTFE or multi-layer fabrics. Referring to the Simms® online website, we will see that their higher end waders have 3 layers and their highest end guide waders have 5 layers (thereby making them substantially thicker). It will also be appreciated that neoprene waders are in the art, which are even thicker than traditional fishing waders. As one can see, in examining FIG. 65, if the wader material 100 was thicker, it would simply move the backing plate downward, but would have no effect on the sealing area between the upper portion 213 of the frame plate 204 and a reversed image seal area 211, which is an integral part of lid assembly 110, 202. It was found through testing that having this pinch-type feature wherein, sealing area 213 of frame 204 pinches against a mirror image sealing area 211, improves the overall sealing ability. This creates a reliable amount of compression in the seal area, such that, it is guaranteed to stay water tight. Another advantage to the protrusion or tooth area 211 is that this captures the O-ring seal 124, 214 such that it will not fall out. In other words, there are a lot of friction surfaces that hold it nicely in place between the inside surface of the lid 202 and the seal 124, 214 itself. However, during prototype evaluation, it was found that the design of FIG. 65 has a very significant disadvantage in a reduction in the opening side aperture 218. Referring back to FIG. 62, one can see open area 218 which is very important to access the penis or to place a GoGirl™ device, as previously described (reference FIG. 53).

Referring back to FIG. 64, one can see that there was a rather large gap 215 between the lid assembly 110, 202 and where it contacted the upper part of frame element 204. In testing, this turned out to be a significant negative. Any side bore to the lid, such as a fisherman slipping against a rock or a crab fisherman hitting a crab pot, would tend to distort the lid such that the hinge could break or that the lid itself could be fractured. Therefore is was discovered through testing, that a small gap 215', as illustrated in FIG. 65, is highly desirable. This small gap 215' would be present all the way around the bulk perimeter of the lid 110, 202. When this lid takes a side hit, the curvature 203 deflects through the small gap 215' and quickly hits the enlarged portion of the frame 204 thereby preventing damage or breakage. In other words, one stays within the elastic limit of the plastic or other material used to form the lid 110, 202 without causing it to break or without causing undo stresses on the hinge assembly. The gap 215' should be no greater than 200,000th of an inch (0.20 inches). In another embodiment, the gap should be no greater than 100,000th of an inch (0.10 inches) and in another embodiment, no greater than 50,000th of an inch (0.050 inches).

Figure 66:
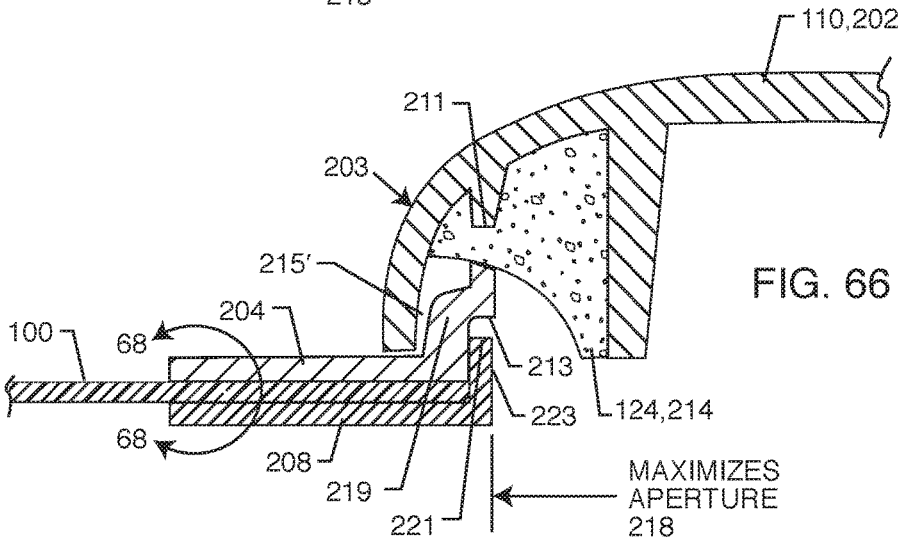
FIG. 66 is a sectional view similar to 64 and 64 now showing yet another exemplary embodiment of a sealing area.

After considerable development and experimentation, the design of FIG. 66 offers a number of very significant advantages. One can see that the backing plate 208 has the configuration very similar to that previously described in FIG. 65. In both FIGS. 65 and 66, backing plate 208 is not part of the pinch seal against O-ring structure 124, 214. What is very unique about the frame element 204 shown in section in FIG. 66 is that, as it is directed upward at 219, it is designed to fit above the upper part 221 of frame element 208. This novel structure preserves the very important pinch feature between tooth-type features 213 and 211 previously described in FIG. 65 and are also shown in FIG. 66. However, by having the frame element 204 jog over at 219 and be above backing plate 208, the full maximum aperture 218, as previously described in FIG. 62, has been preserved. In other words, the upper part of the frame element 213 would not extend beyond the surface 223 of the underlying backing plate 208. This unique design does involve a tradeoff and that is, the radius curve 203 may be a steeper radius than the radius curve 211 previously described in FIGS. 64 and 65. However, this design tradeoff has been found to be acceptable and wearer comfort has been preserved.

Referring again to FIG. 66, one will see that this design accommodates variations in thickness of the wader or fishing pant material 100. It will be understood herein that when one refers to wader material 100, that it is inclusive of all types of waders, foul weather gear, rain pants and the like. For example, when the inventors travel in Ketchikan, a wide variety of foul weather gear include rain pants, rain pants with suspenders, pants with and without a belt, fishing waders and other foul weather gear. Accordingly, the present invention is not limited in its applicability to a wide range of foul weather gear as this teaching is not intended to limit it just to the specific variations illustrated herein.

Figure 67:
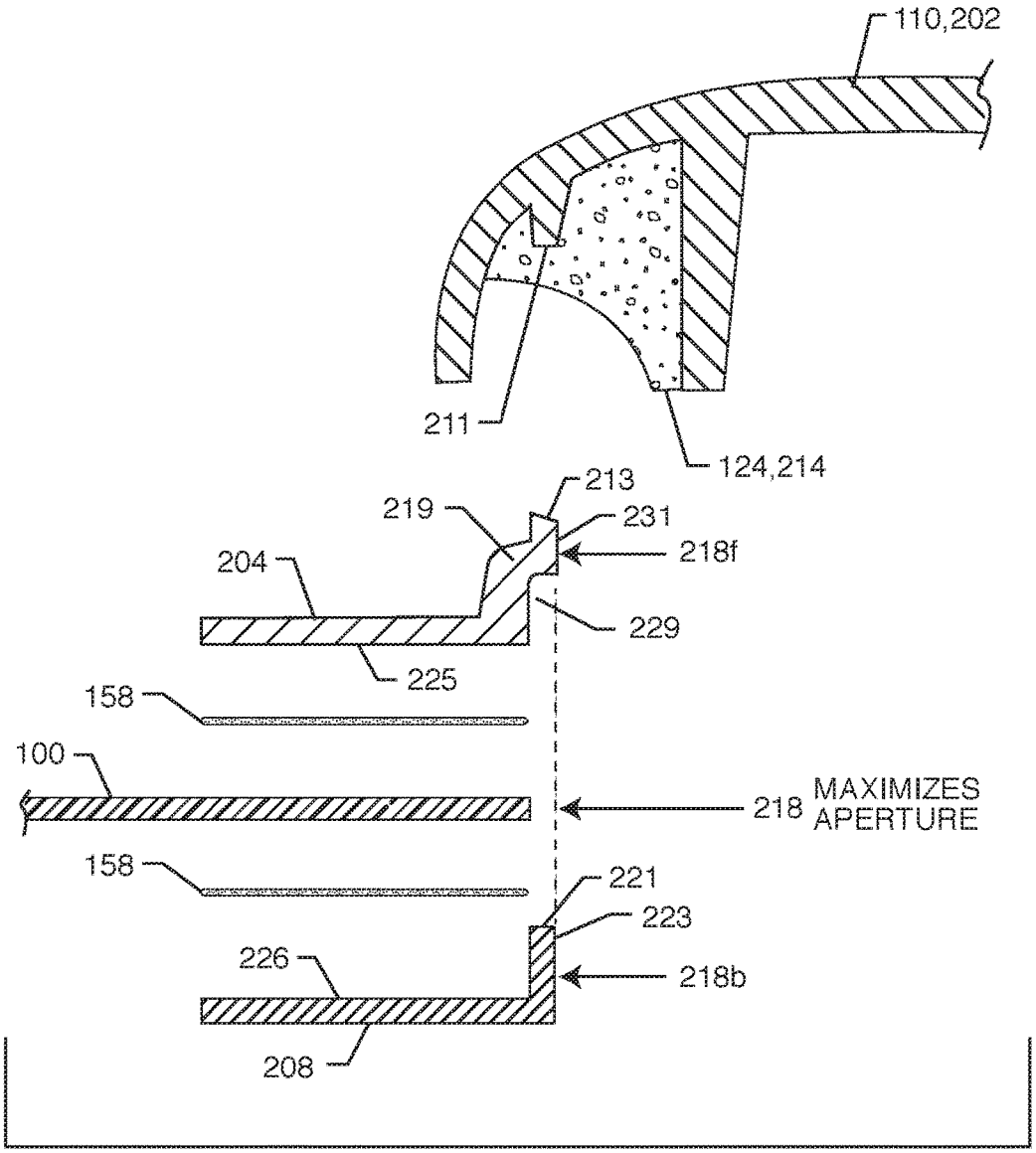
FIG. 67 is an exploded view of the structure of FIG. 66.

FIG. 67 is an exploded view of the structure of FIG. 66. It is now easier to see how the parts are combined to form a water tight seal. One can see that the frame aperture 218*f* is the same size as the backing aperture 218*b*. This means the overall aperture 218 has been maximized to allow for greater ease of the user being able to manipulate various garments and body parts through the aperture thereby facilitating ease of urination. One can see that a first surface 226 of the backing 208 and a back side surface 225 of the frame 204 capture there between the waterproof material 100. At least one adhesive bond 158 (in this case two) are disposed between the back side surface 225 of the frame and the waterproof material 100, and/or, between the first surface 226 of the backing 208 and the waterproof material 100. As one can see, the backing aperture 218*b* and frame aperture 218*f* are substantially aligned. Furthermore, the backing aperture 218*b* is equal to or greater in surface area in comparison to the frame aperture 218*f* because the backing aperture is as large or some embodiments larger than the frame aperture. In other words, the backing aperture may be at least as large in an aperture size as the frame aperture. The backing also has a raised edge 221 along an inside perimeter 223 of the backing aperture, wherein the raised edge is disposed within a perimeter undercut 229 formed in a second raised edge 219 of the frame 204 along a second inside perimeter 231 of the frame aperture 218*f*. The undercut 229 allows the raised edge 221 of the backing to nest inside, thereby maximizing the aperture 218. It can also be seen that the lid 202 has the third raised edge 211 extending towards the frame when the lid is in the closed position, wherein the third raised edge 211 of the lid is aligned with the second raised edge 221 of the frame and mutually capture at least a portion of the seal 214 there between when the lid is in the closed position.

Figure 68:
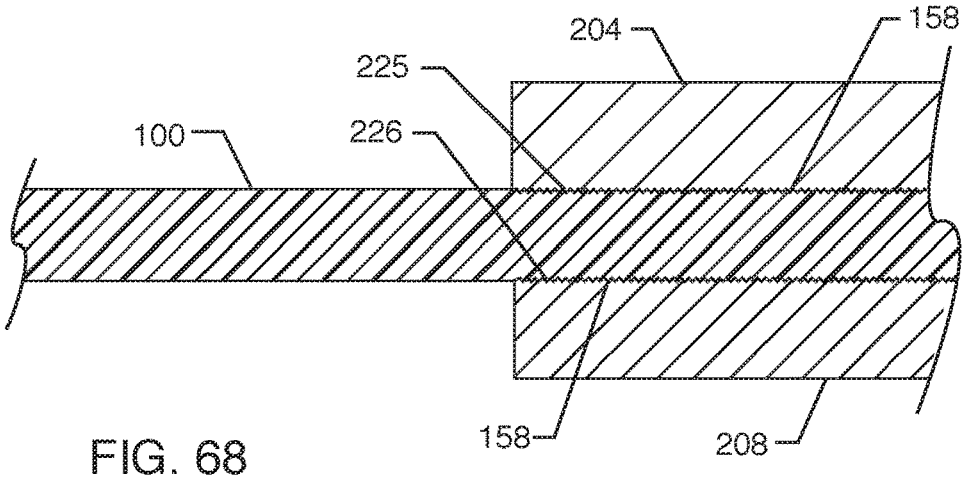
FIG. 68 is an enlarged sectional view taken from the structure of FIG. 66 showing an improved bonding technique.

FIG. 68 is an enlarged sectional view taken from the structure of FIG. 66. As shown in FIG. 68, the inside surface 225 of the frame (i.e. base) 204 and the inside surface 226 of the backing plate are roughened to help facilitate a strong mechanical bond between the wader material 100 and the surfaces 225, 226. As shown in FIG. 67, one must remember that an adhesive 158 may be placed on one side or both sides of the wader material 100 before it is sandwiched between the frame 204 and backing plate 208. As understood by those skilled in the art, the adhesives can be from a number of glues, adhesives, epoxies or bonding agents suitable to securely attach the wader material 100 to the frame 204 and backing plate 208. (Aqua Seal™ was found to be one such adhesive that bonded very well to common wader or waterproof rain pant/bib materials.) It was discovered during testing by the inventor in Alaska's Inside Passage, that a very smooth inside surface 225 and 226 made it harder for the adhesives to properly grip the wader material and the surfaces 225 and 226. This led to chest wader leakage failures while river fishing in the field when the user was wearing the invention. Surprisingly, when wading deep in a river or tidal area, there is significant water pressure against the adhesive seal. Examination revealed that these leaks were between the smooth plastic of surfaces 204 and 208 and not between the adhesive and the wader or pant material itself. The waders tested were of breathable Goretex™ type material which has many micro pores. It became apparent that an adhesive such as AquaSeal™ bonds and forms a watertight seal extremely well to such breathable fabric surfaces 100. The inventor discovered that a roughened surface 225 and 226 allowed the adhesives 158 to bond significantly better. The roughened surface could be applied after the parts (204, 208) were made, however, it is preferable if the roughened surface 225 and 226 can be designed into the mold that would create the frame 204 and backing plate 208. In this manner the roughened surface is part of the mold and is consistently created for all parts 204 and 208.

Figure 72:
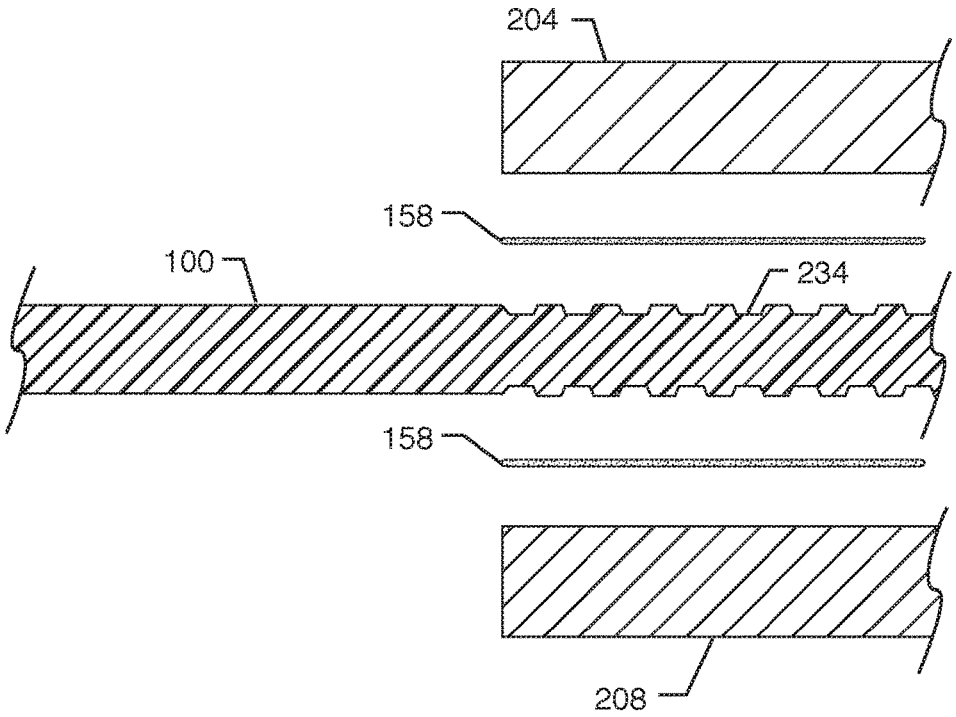
FIG. 72 is a sectional view similar to FIGS. 68 and 70 now showing an exploded view and channels formed into a non-breathable wader material for increased bond strength.

It is understood by those skilled in the art that through the use of adhesives 158 and proper bonding techniques to the surfaces 225 and 266 (and/or 100 as shown in FIG. 72) that the rivets 168 of FIGS. 29-34 are no longer needed. This means that overall flatness of the frame 204 and backing plate 208 can be optimized because the use of rivets, fasteners, screws, bolts, clips or the like are no longer needed. This also aids in overall appearance of the present invention and minimizes assembly time and reduces chances for errors or defects.

Figure 69:
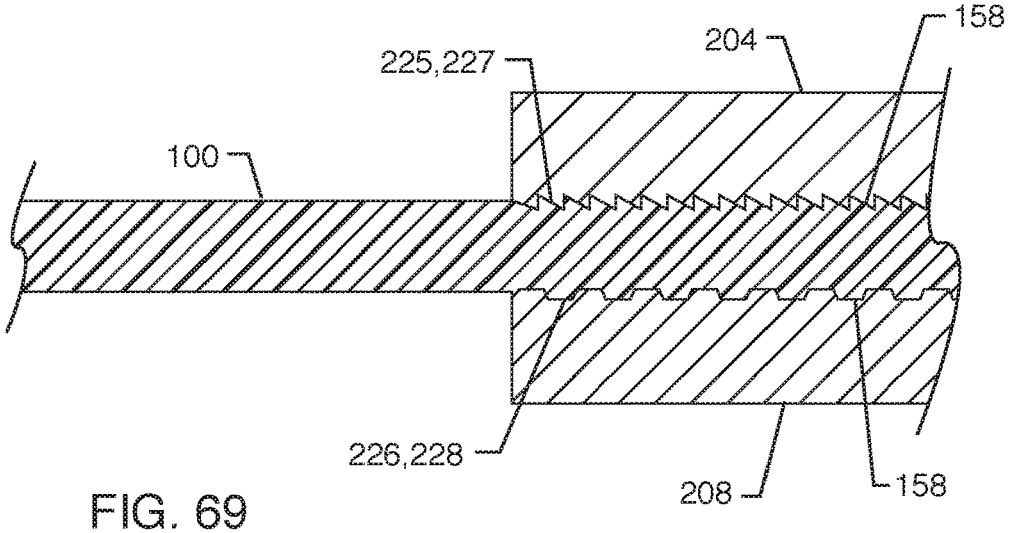
FIG. 69 is an enlarged sectional view very similar to FIG. 68, however now the roughened surface is formed as a series of triangular-shaped cutouts or channels that run along the perimeter edge of the frame.

FIG. 69 is an enlarged sectional view very similar to FIG. 68, however now the surface 225 is formed as a series of triangular-shaped cutouts 227 that run along the perimeter edge of the frame 204. The triangular-shaped cutouts 227 help dig into the wader material 100 thereby increasing the mechanical pull strength. In another embodiment, the surface 226 is shown as a series of channels 228 that run along the perimeter edge of the frame 204. Again, the adhesives 158 would flow into these cutouts 227 and/or channels 228 increasing the overall pull strength before failure. It is understood that the wader or pant material 100 may also be roughened (either during manufacturing or in a secondary sanding type operation). As is understood by those skilled in the art, there are a multitude of shapes, surface contours, roughenings and textures that could be applied and/or formed into the surfaces 225, 226 as these specific descriptions are not intended to be fully inclusive of all possible embodiments.

Figure 70:
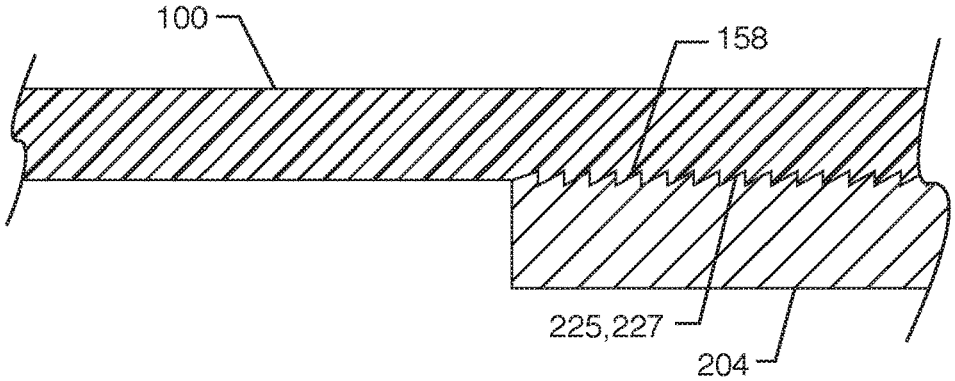
FIG. 70 is an enlarged sectional view similar to FIGS. 68 and 69 now showing another embodiment that only has a single frame with a roughened surface as the backing plate has been eliminated.

FIG. 70 is an enlarged sectional view similar to FIGS. 68 and 69 now showing another embodiment that only has a single frame 204 with a roughened surface 225, 227 as previously described. In this embodiment, the backing plate 208 has been eliminated because the bonding between the wader material 100 and the frame 204 is so strong from the combination of the correct adhesive 158 and the cutouts 227 that the backing plate 208 is no longer needed. Testing in the field has validated that the backing plate 208 may be eliminated, particularly when the wader or pant material 100 is either a breathable fabric or is also roughened in the bonding area. It will be understood by those skilled in the art that the frame 204 could be placed either on the inside of the waders 100, as shown here, or on the outside of the waders—as long as the bond and seal between the waders and frame is strong and waterproof either design configuration will be acceptable.

Testing in the wild rivers of the Alaska Inside Passage by the inventors has revealed that there are situations where the wader wearer must hike up steep river banks, wade through muddy boggy marshes, bust through heavy brush and Willow thickets and the like. In these situations, the inventors have broken fishing rods, lost fishing nets and equipment and the like. The point is that the wader/pant legs can be subjected to very significant pulling and impact stresses in the groin area where the adhesive bond 225, 227 is formed. The inventors have also spent many days and nights on their boat in Alaskan Inside Passage marinas such as the Bar Harbor Marina in Ketchikan. In these marinas, the inventors have often been docked right next to one of many types of Alaska commercial fishing boats (crabbers, trollers, netters, etc.). Accordingly, the inventors had numerous opportunities to speak with the crews and captains of these vessels. What was found is that life on a commercial boat is even rougher than the previously described river—hiking experiences the inventors personally experienced. Accordingly, for almost all situations, the roughened 208, 226, 228 backing plate adds additional rugged type strength to the invention and is preferred.

Figure 71:
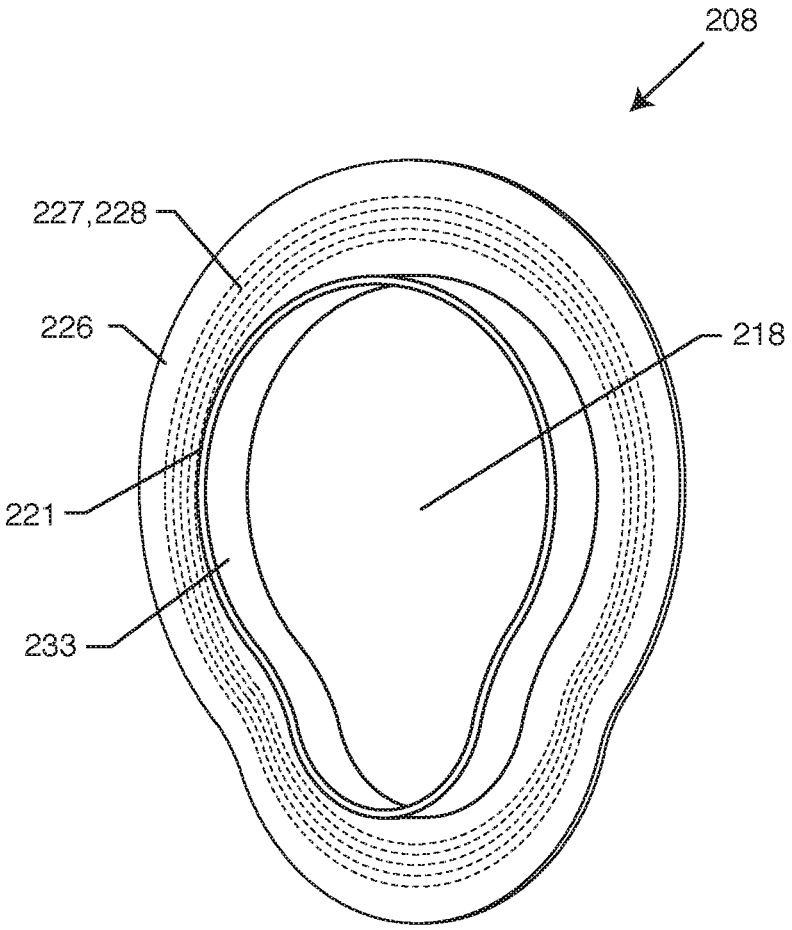
FIG. 71 is a perspective view of a backing plate now showing the adhesion surfaces following the contour of the aperture.

FIG. 71 is a perspective view of the front surface 226 of the backing plate 208 where the roughened surface can be in the form of the triangular-shaped cutouts 227 and/or the channels 228. As shown in FIG. 71, it is understood that these features can follow the shape of the aperture 218 as they curve around the surface 226. It is understood by those skilled in the art that the features 227 and 228 could be equally applied to the surfaces 225 of the frame 204.

FIG. 72 is a sectional view similar to FIGS. 68-70 now showing an exploded view of a new embodiment where the wader 100 is made of a non-breathable material such as rubber or various elastomers but now has channels 234 integrated into the wader material 100 itself. The channels 234 help allow the adhesives 158 to grip and properly adhere to the wader material 100. As will be understood by those skilled in the art, the same channels 227 and 228 can be applied to the frame 204 and backing plate 208.

It will be understood by those skilled in the art that instead of an adhesive 158, a seam weld may be used between the wader material 100 and either of the frame 104 or backing plate 108. Furthermore, other attachment means known to those skilled in the art may be used that are consistent with the structures taught herein to form a water tight connection between the wader material and the present invention's structures including adhesives, seam welds, compression fittings, gaskets, and the like."

Figure 73:
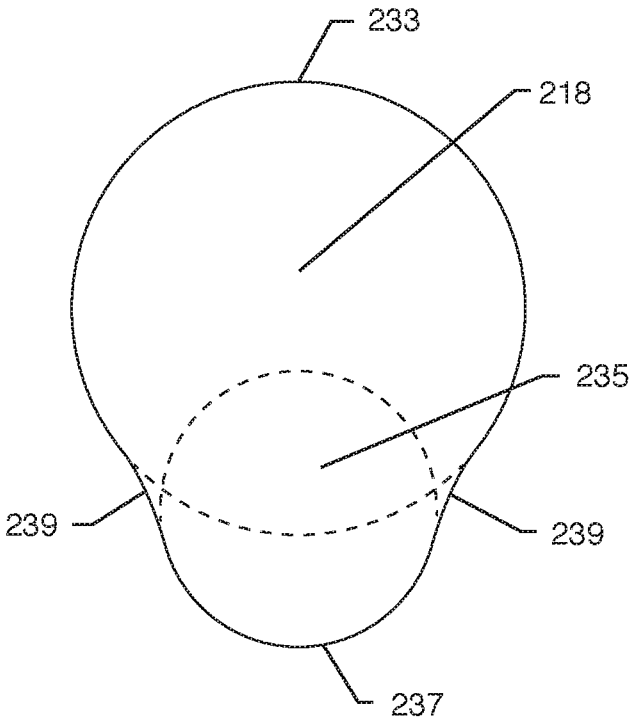
FIG. 73 is a geometrical representation of the aperture of FIGS. 62 and 63.

FIG. 73 is a geometrical representation of the aperture 218 of FIGS. 62 and 63. The inventors spent much time trying through trial and error trying to determine the best shape for the aperture 218. Many considerations were taken into account including comfort to the wearer, ease of manufacturing and ease of use through the aperture to name a few. The previous circular shapes and trapezoidal shapes all have severe deficits in one area or another. The inventors now believe that the best shape is simply a larger circle 233 (larger circular arc) at least partially overlapping 235 a smaller circle 237 (smaller circular arc). Extensive experimentation has shown that this larger circle on top of a smaller circle allows for easier hand access and placement of the penis (or GoGirl™). Then a fillet 239 can smoothly connect the larger circular arc to the smaller circular arc. This shape is easily seen in FIG. 73, but can also be seen in FIGS. 62 and 63. The aperture 218 now easily conforms to the human body and also allows ease of access through the aperture.

Figure 76:
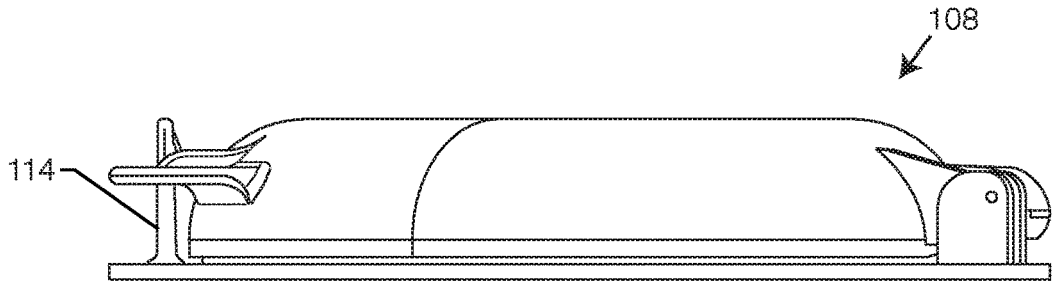
FIG. 76 is a side view of the structures of FIGS. 74 and 75 assembled into a hatch design.
Figure 77:
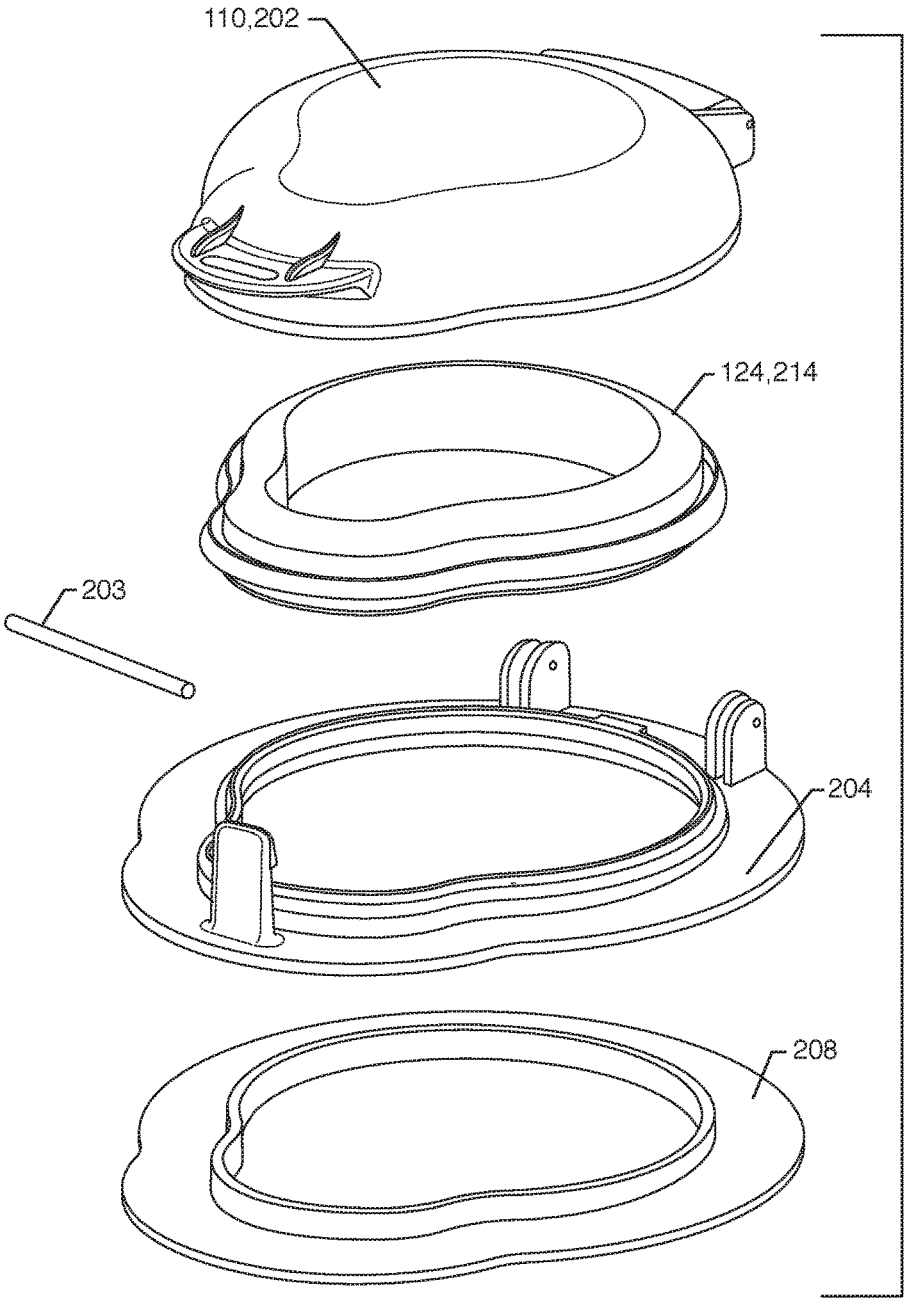
FIG. 77 is an exploded perspective view of the structure of FIG. 76.

FIGS. 74-77 show an earlier design tested by the inventors. FIGS. 74A-C are views of the frame 204. FIGS. 75A-C are views of the lid 110, 202. FIG. 76 is a side view of the urinary relief hatch 108. FIG. 77 is an exploded view showing the parts of the urinary relief hatch 108.

When the inventors tested the prototype based on FIGS. 74-77, the lid 110, 202 would close to the frame 204 and the seal 124, 214 would be compressed. Unexpectedly to the inventors, the forces compressing the seal 124, 214 were so high that the frame 204 would bend and/or deflect. The deflection of the frame 204 was so severe that gaps were created that allowed water to easily pass through the urinary relief hatch 108.

One possible solution would be to use higher strength materials such that the stiffness of each part was greatly increased. However, the inventors wanted a more robust design that focused on the geometry as the solution rather than solely relying on improved material properties. Therefore the following data is a baseline for this earlier design that can be compared to the later taught improved designs. The data for FIGS. 74-77 is as follows below.

Frame 204:
Density—0.04 pounds per cubic inch
Mass—0.06 pounds
Volume—1.79 cubic inches
Surface Area—39.12 square inches
Mass Moment of Inertia (taken at center of mass)
Ix—0.15 pounds*square inches
Iy—0.22 pounds*square inches
Iz—0.37 pounds*square inches Lid 110, 202:
Density—0.04 pounds per cubic inch
Mass—0.12 pounds
Volume—3.33 cubic inches
Surface Area—68.15 square inches
Mass Moment of Inertia (taken at center of mass)
Ix—0.15 pounds*square inches
Iy—0.27 pounds*square inches
Iz—0.41 pounds*square inches The density used to calculate these values was 0.04 $lbs/in^3$ as this was a typical density for various plastics that would be injection molded. It is understood by those skilled in the art that if a higher density material was used, the mass moments of inertia would correspondingly increase as well. Likewise, if a lower density material was used, the mass moments of inertia would also decrease.

The inventors came to the conclusion that a stiffer structure was needed and thus set out to improve the previous design. The inventors wanted to keep the overall dimensions of the urinary relief hatch 108 slim, but wanted increase the stiffness of at least the frame 204 such that leaks would be eliminated.

The area moment of inertia is a property of a two-dimensional plane shape which characterizes its deflection under loading. In other words, the area moment of inertia is a property of a cross section that can be used to predict the resistance of beams to bending and deflection, around an axis that lies in the cross-sectional plane. Beams with higher area moments of inertia, such as I-beams, are so often seen in building construction as opposed to other beams with the same area. Area moment of inertia is a measure of the flexural stiffness of a beam. It is in essence a measure of the resistance offered by a beam to bending deflections. The area moment of inertia is material independent, so you can say it is the capacity of a cross-section to resist applied bending. To calculate the actual deflection of a beam one would then use the material properties of the beam to arrive at an actual deflection value.

The mass moment of inertia is a measure of the resistance offered by a body to a change in its angular momentum. In other words, the mass moment of inertia is a measure of an object's resistance to changes its state of rotation. (Any kind of moment of inertia is basically a measure of an object's resistance to a change in its state of motion.) The mass moment of inertia for a body depends on the body's mass and the location of the mass. The greater the distance the mass is from the axis of rotation, the larger mass moment of inertia will be. As the present inventors added various strengthening ribs, this not only increased the parts stiffness and resistance to bending but it also increased its mass moment of inertia.

However, in this present case we have three-dimensional parts which are not symmetrical about the axes of rotation. It would be practically impossible to compare area moments of inertia at each individual slice taken through the different parts to determine which design is better or to compare designs. An easier solution is to then compare the mass moments of inertia which can be easily calculated using the various three-dimensional CAD programs available in the marketplace. The inventors have used Solidworks® for their data presented herein.

It is understood that the mass moments of inertia will be different based on the density of the material. However, if one was to use the same density of 0.04 pounds per cubic inch then direct comparisons between the parts can readily be made. Therefore, the claims in the present case use the baseline density of 0.04 pounds per cubic inch. If an infringing part used a different density, the various mass moments of inertia can either be scaled up or scaled down correspondingly to then provide equalized data for comparison purposes.

Figure 78A:
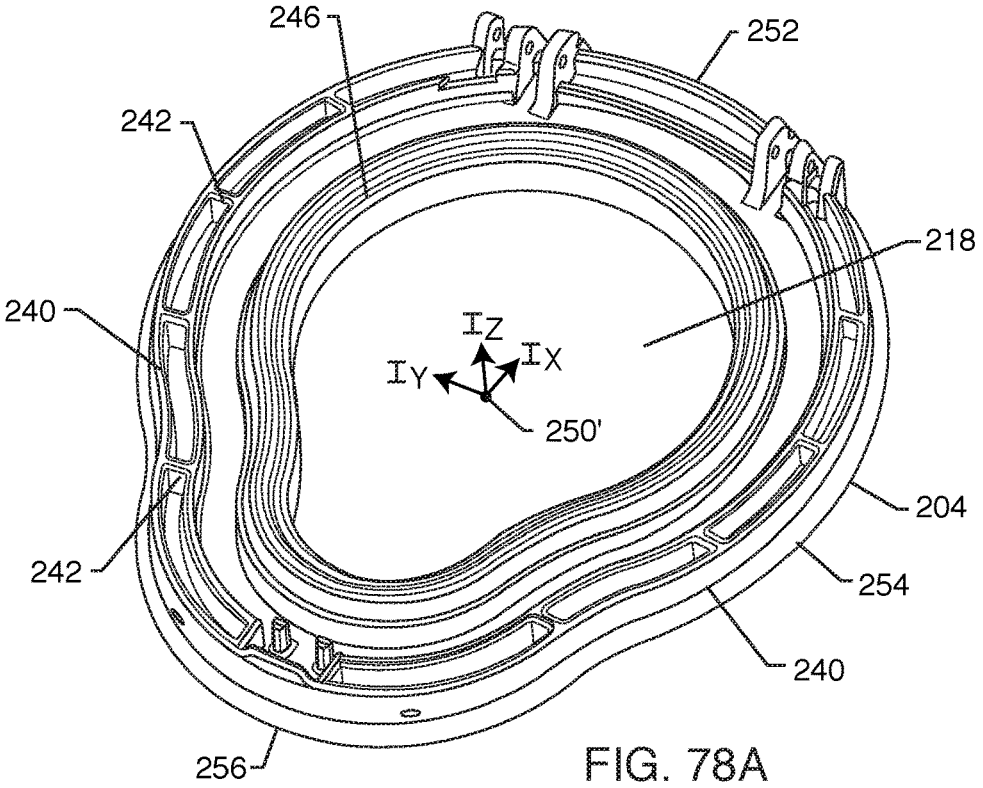
FIG. 78A is a perspective top view of a new embodiment of a frame design.
Figure 78B:
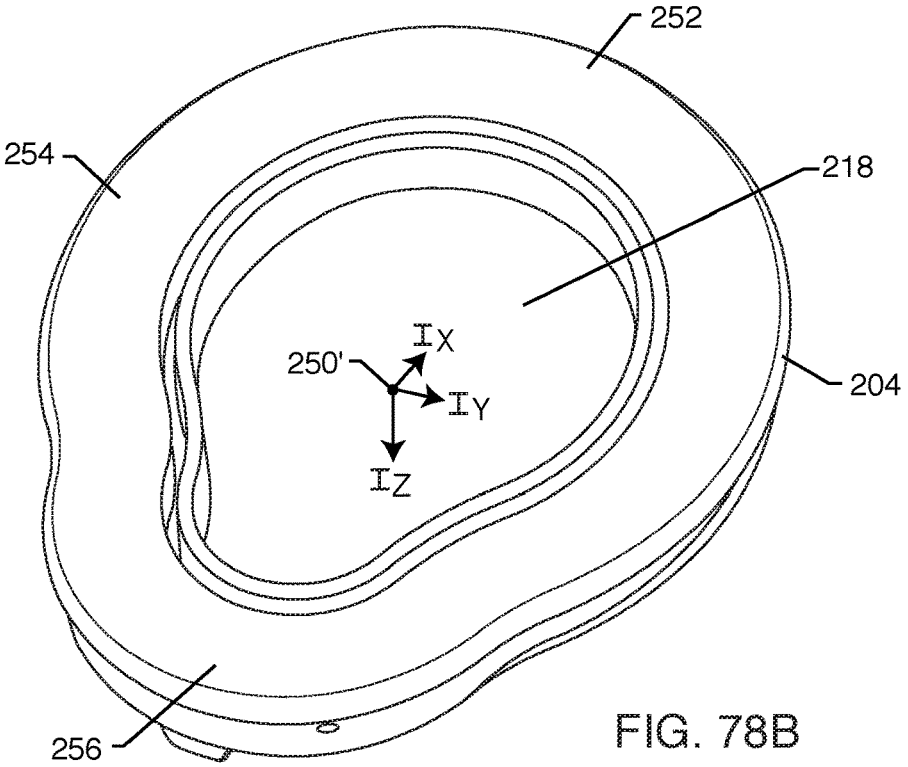
FIG. 78B is a perspective bottom view of the frame design of FIG. 78A.
Figure 78C:
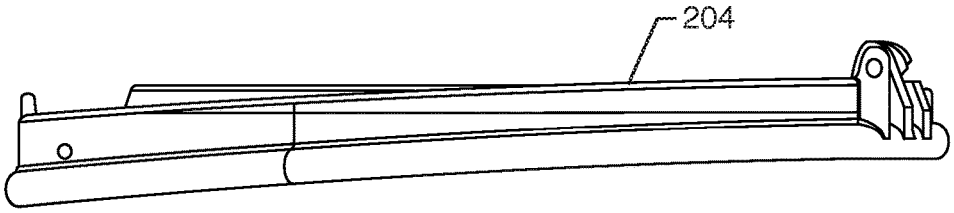
FIG. 78C is a side view of the frame design of FIG. 78A.
Figure 79C:
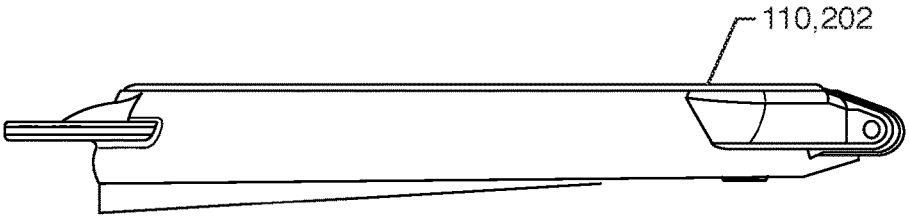
FIG. 79C is a side view of the lid design of FIG. 79A.
Figure 80:
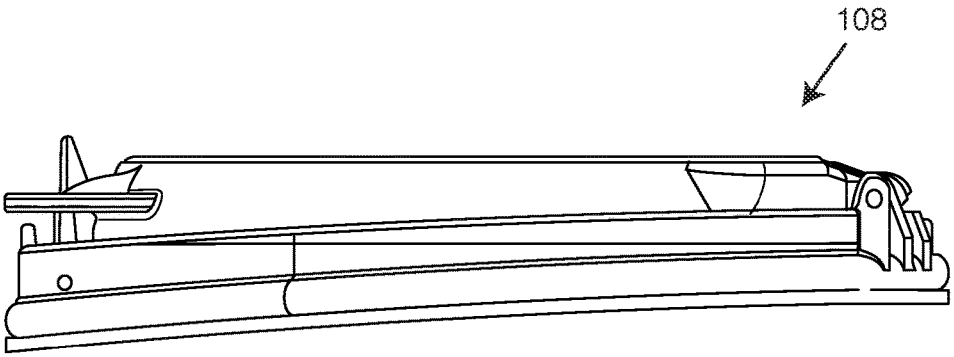
FIG. 80 is a side view of the structures of FIGS. 78 and 79 assembled into a new hatch design.
Figure 81:
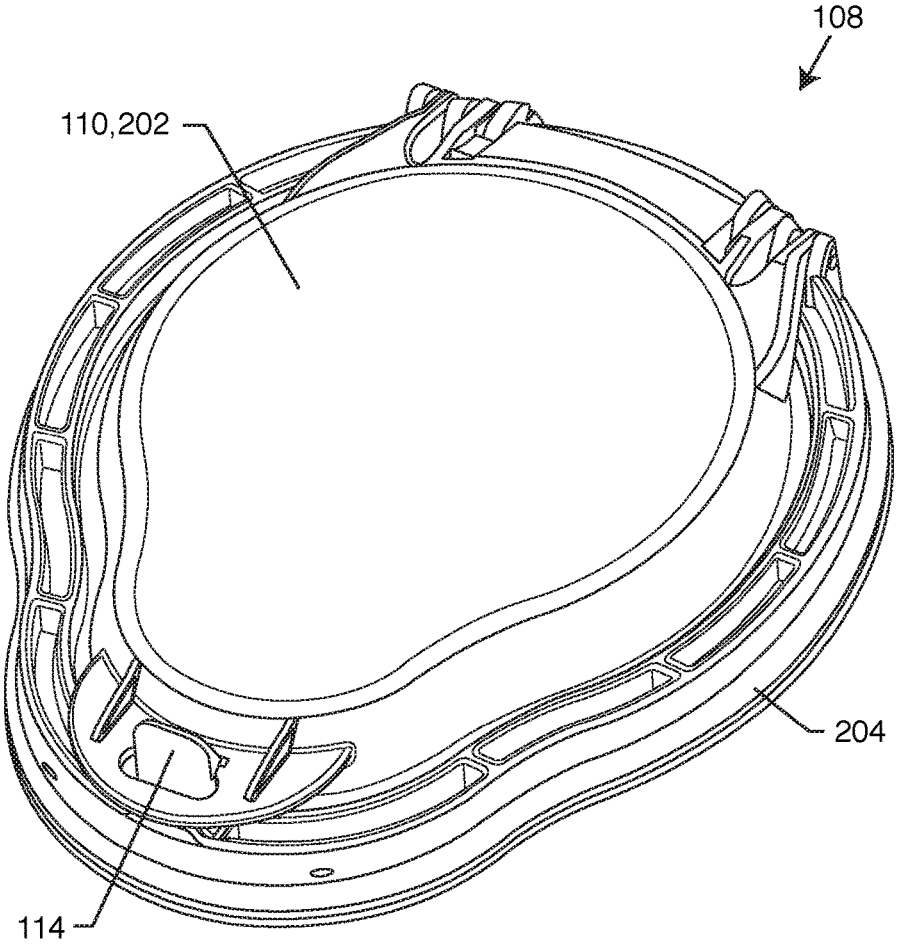
FIG. 81 is a perspective view of the structures of FIGS. 78 and 79 assembled into a new hatch design.
Figure 82:
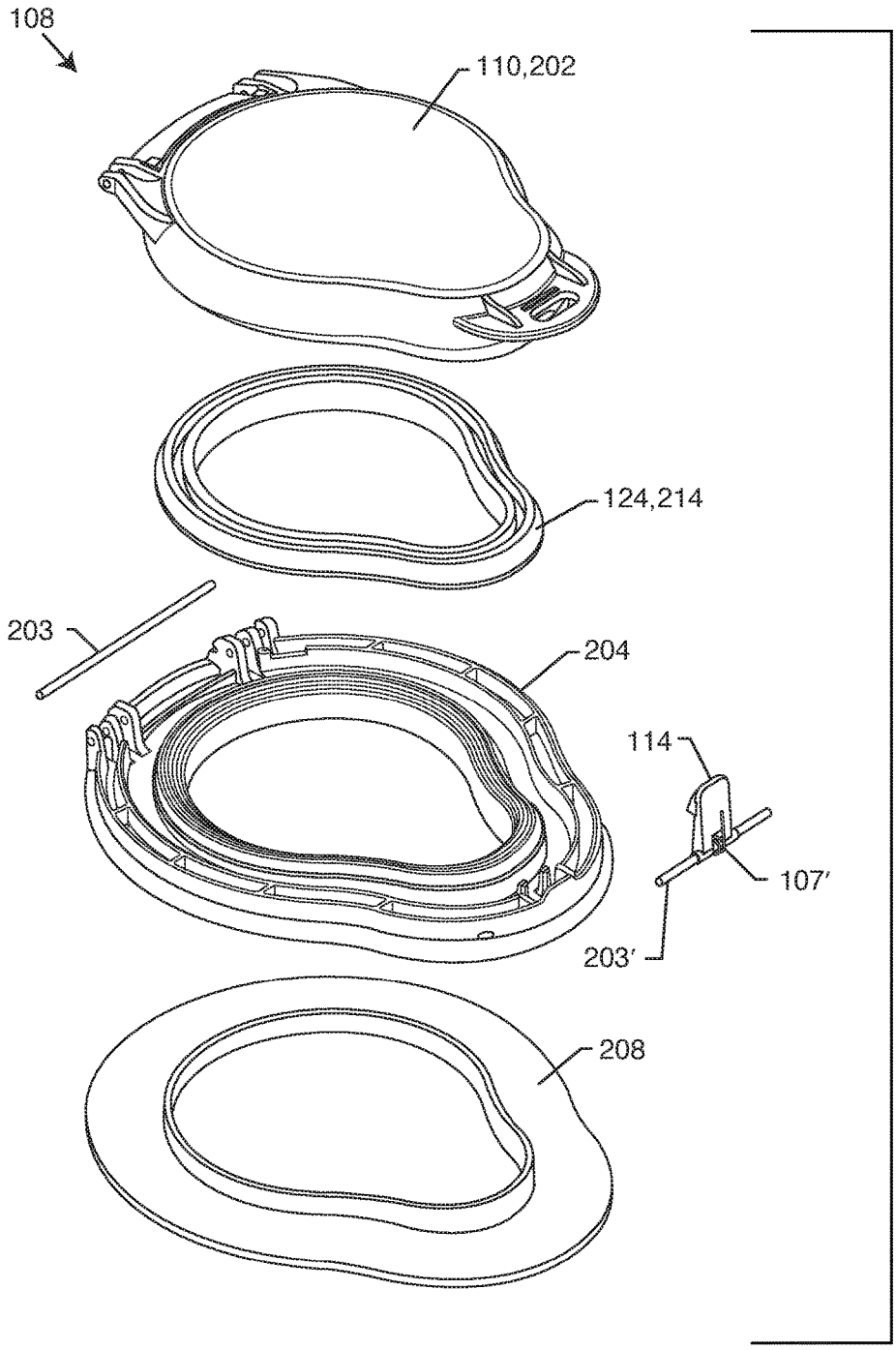
FIG. 82 is an exploded perspective view of the structure of FIGS. 80 and 81.
Figure 83:
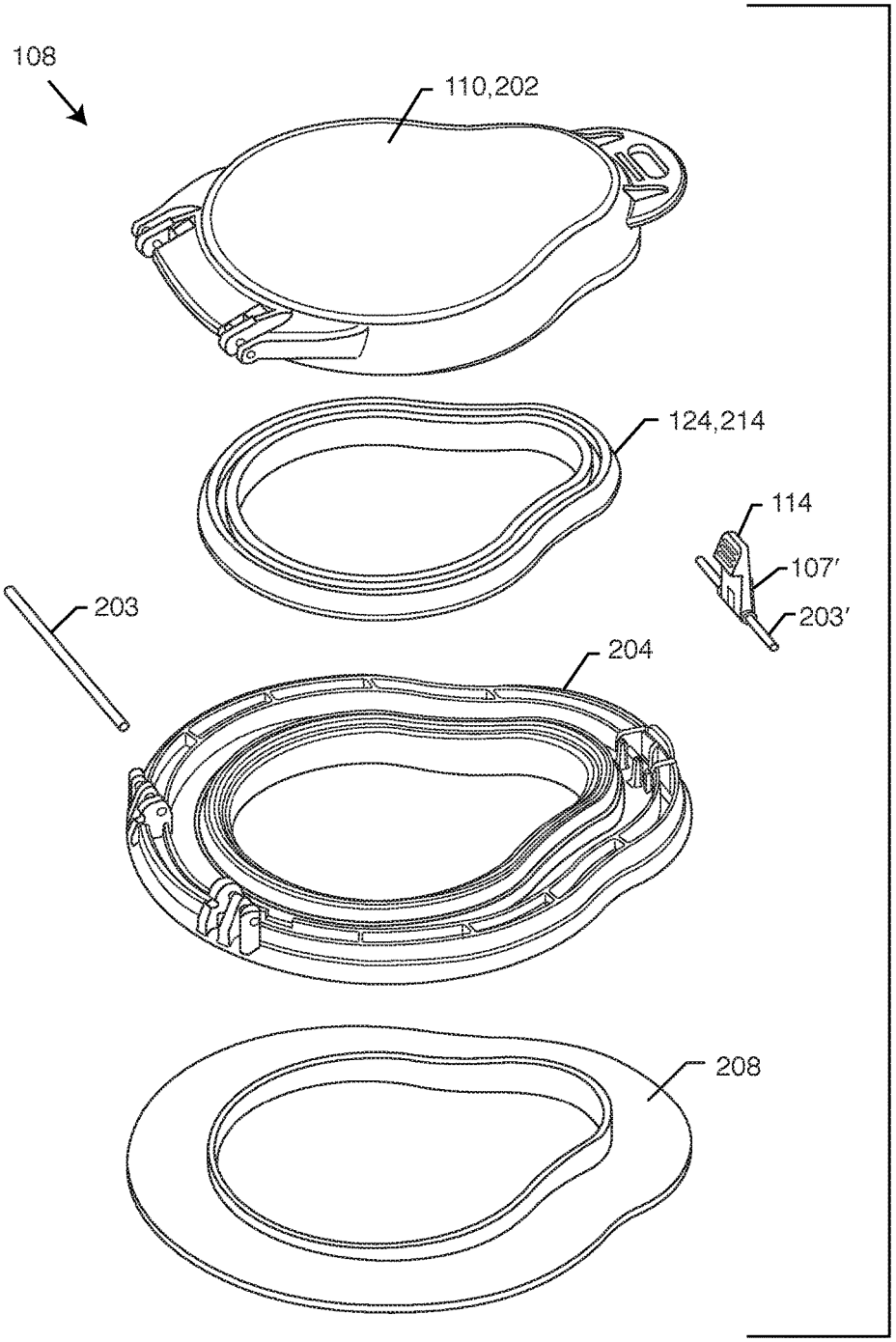
FIG. 83 is an exploded perspective view of the structure of FIGS. 80 and 81.

FIGS. 78-83 show a new and improved design of the urinary relief hatch 108. FIGS. 78A-C are views of the new and improved frame 204. FIGS. 79A-C are views of the new and improved lid 110, 202. FIG. 80 is a side view of the new and improved urinary relief hatch 108. FIG. 81 is a perspective view of the structure of FIG. 80. FIGS. 82 and 83 are exploded views of the structure of FIG. 80 showing the various parts of the urinary relief hatch 108.

Referring now to FIGS. 78A-C, one can see that strengthening/stiffening ribs 240 have been added. The stiffening ribs 240 follow the outside curvature of the frame 204. In this particular embodiment the strengthening rib 240 is a double rib with intermediate connecting portions 242. During plastic injection molding, it is desirable to keep the thickness of each portion of the part at the same value such that the hot plastic flows better when being injected into mold/cavity. Therefore, very thick or very thin portions should be avoided as these create trouble areas for the plastic to flow properly. The double rib 204 satisfies this by increasing the stiffness of the part substantially but also making it moldable. One can also see that the inside rib 246 has been thickened as well.

At this point it is worth noting that the latch 114 is now a separately manufactured part and is not shown in FIGS. 78A-C. In previous designs when the latch was formed with the frame, an undercut was needed during molding which then reduced the area available on the frame to bond the wader to, whether it was done through adhesives or various plastic welding techniques. In this new design the latch 114 is later attached to the frame 204 with a pin 203' and a spring 107' which is best seen in FIGS. 82-83. The material of the frame will now be chosen to be very stiff. To the contrary, the latch design in FIGS. 74A-C had to be flexible to allow it deflect for opening and closing. This then created a material property conflict between the frame and latch that has been alleviated by making the latch a separately manufactured part, whether through injection molding or machining. The latch could even be made from a metal material in this new design, including but not limited to steel, stainless steel, aluminum and/or alloys thereof.

The frame 204 in FIGS. 78A-C has been dramatically improved. The data for the new and improved frame is as follows below.

New and Improved Frame 204:
Density—0.04 pounds per cubic inch
Mass—0.13 pounds
Volume—3.49 cubic inches
Surface Area—52.83 square inches
Mass Moment of Inertia (taken at center of mass)
Ix—0.23 pounds*square inches
Iy—0.32 pounds*square inches
Iz—0.54 pounds*square inches When comparing the old and the new frame, one can see that the mass and volume have more than doubled. The volume went from 1.79 to now 3.49 cubic inches. This makes sense considering the addition of the stiffening ribs. However, the surface area only increased by about 40%, where it went from 39.12 to 52.83 square inches. The mass moments of inertia did increase where needed. The mass moment of inertia about Ix went from 0.15 to 0.23 pounds*square inches. The mass moment of inertia about Iy went from 0.22 to 0.32 pounds*square inches. These improvements in the mass moment of inertia have greatly increased the stiffness and strength of the lid 204.

Figure 79A:
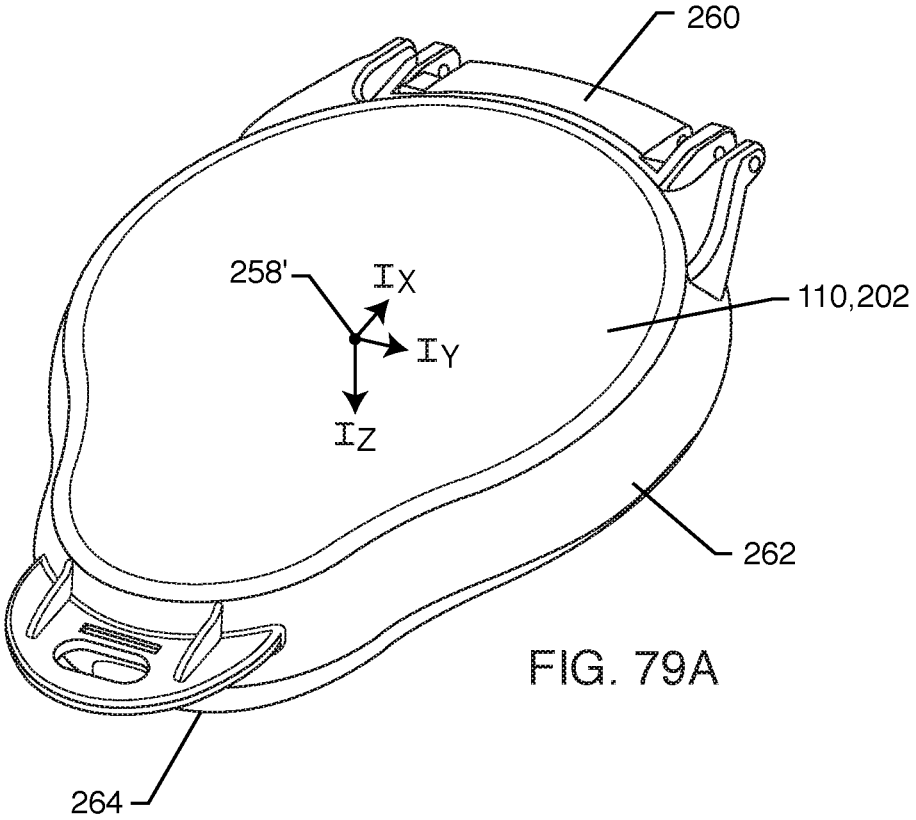
FIG. 79A is a perspective top view of a previous embodiment of a lid design.
Figure 79B:
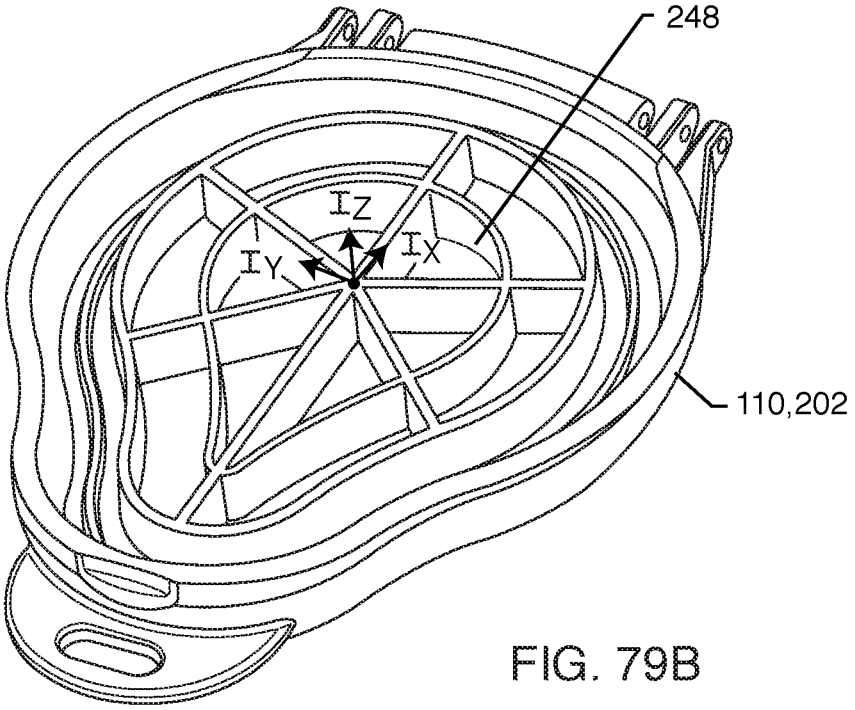
FIG. 79B is a perspective bottom view of the lid design of FIG. 79A.

Referring now to FIGS. 79A-79C the new and improved lid 110, 202 has actually been reduced in size to accommodate the frame 204 getting thicker and larger. The stiffness of the lid has actually been reduced which is not a problem as the previous deflection was in the frame 204 and not the lid 110, 202. However, to help increase stiffness of the lid the inventors have added strengthening/stiffening ribs 248 to the interior portion. The data for the new and improved lid is as follows below.

New and Improved Frame Lid 110, 202:
Density—0.04 pounds per cubic inch
Mass—0.12 pounds
Volume—3.42 cubic inches
Surface Area—53.73 square inches
Mass Moment of Inertia (taken at center of mass)
Ix—0.11 pounds*square inches
Iy—0.20 pounds*square inches
Iz—0.30 pounds*square inches When comparing the old and the new lid, the volume stayed almost the exact same yet the overall surface area decreased a little from 68.15 to 53.73 square inches. One can see that the mass moments of inertia did decrease for each axis. However, this is an acceptable tradeoff as the frame 204 is now stiffer.

In the old design the mass moment of inertia of the lid was equal to or larger than the mass moment of inertia of the frame. In the new design the mass moment of inertia of frame is greater than the mass moment of inertia of the lid. Said differently, in the old design the lid was stiffer than the frame, whereas in the new design the frame is much stiffer than the lid. This new and improved design no longer deflects when closed and therefore no gaps are created that leak water.

Figure 74A:
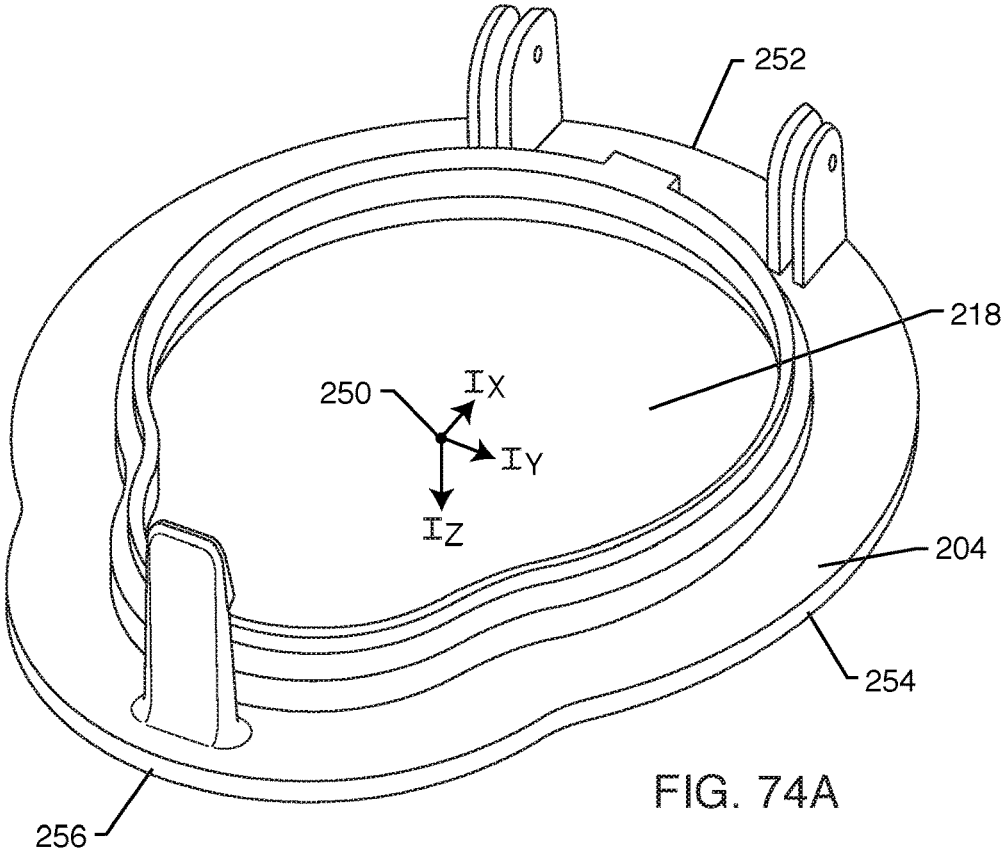
FIG. 74A is a perspective top view of a previous embodiment of a frame design.
Figure 74B:
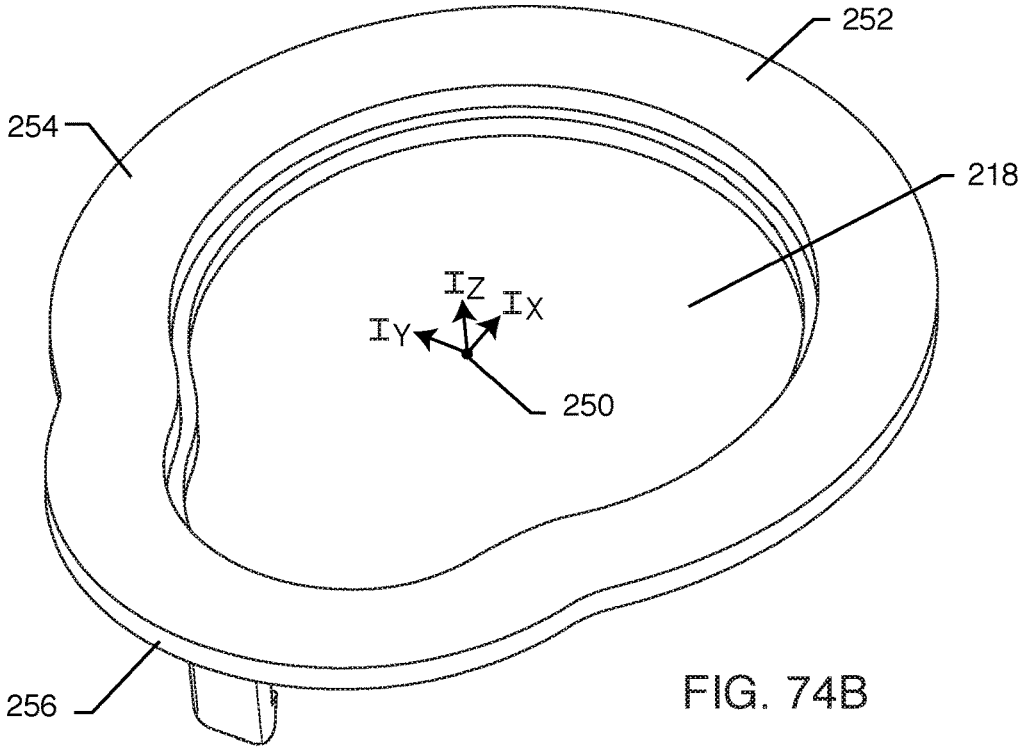
FIG. 74B is a perspective bottom view of the frame design of FIG. 74A.
Figure 74C:
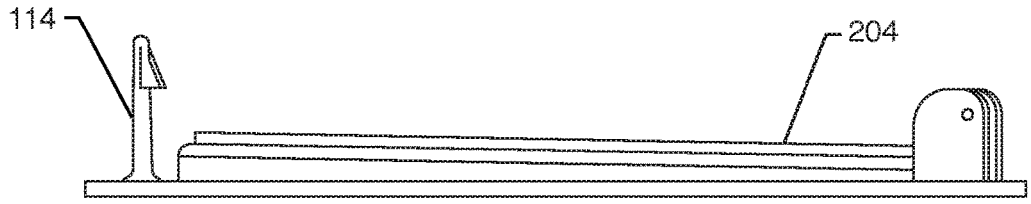
FIG. 74C is a side view of the frame design of FIG. 74A.
Figure 75C:
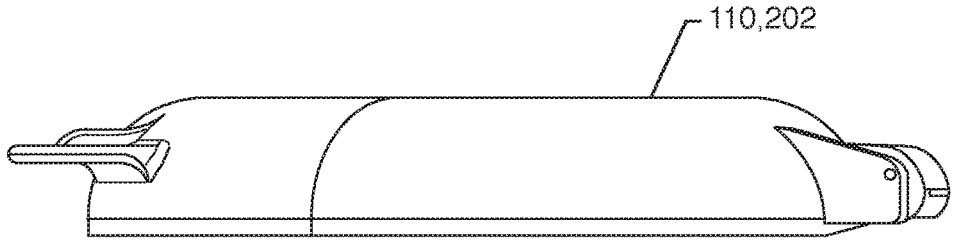
FIG. 75C is a side view of the lid design of FIG. 75A.

To help understand the claims, when looking at FIGS. 74A-B one can see a three-dimensional (Cartesian) coordinate system 250 located at its center of mass. The frame coordinate system 250 has a x-axis (Ix) pointing towards a top 252 (opposite the bottom 256) of the frame, a y-axis (Iy) pointing towards a side 254 of the frame and a z-axis (Iz) pointing through the frame aperture towards the inside of the pair of pants and/or waders. Regarding the new embodiments of the frame in FIG. 78, the frame coordinate system is now 250'.

Figure 75A:
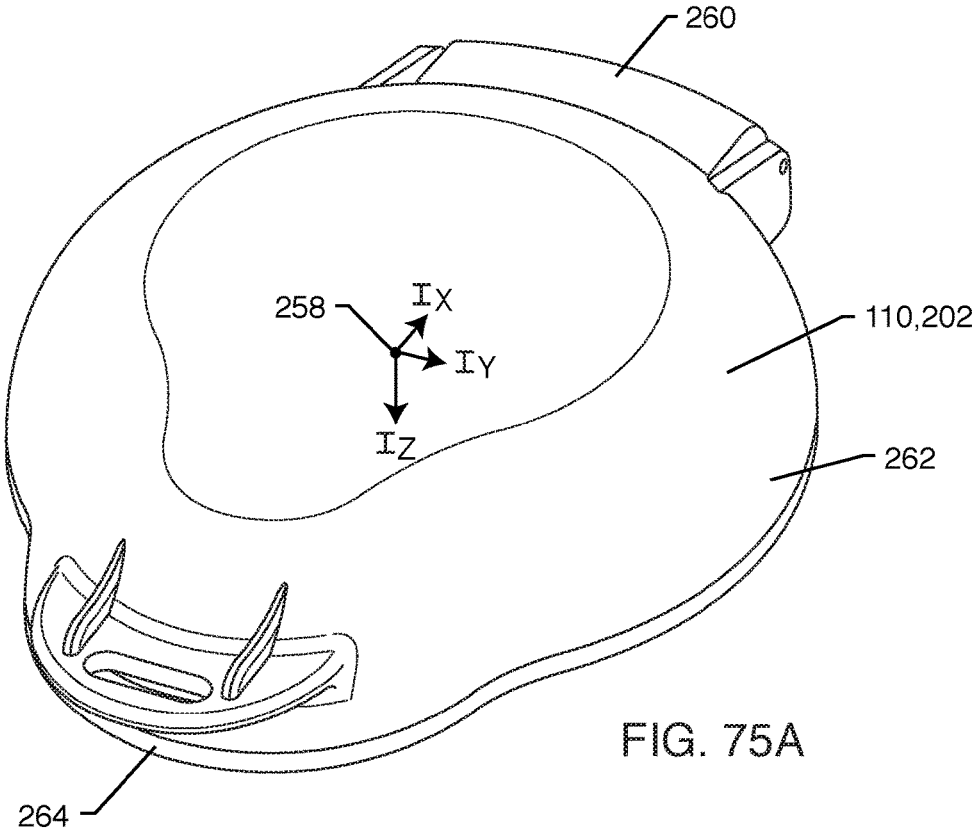
FIG. 75A is a perspective top view of a previous embodiment of a lid design.
Figure 75B:
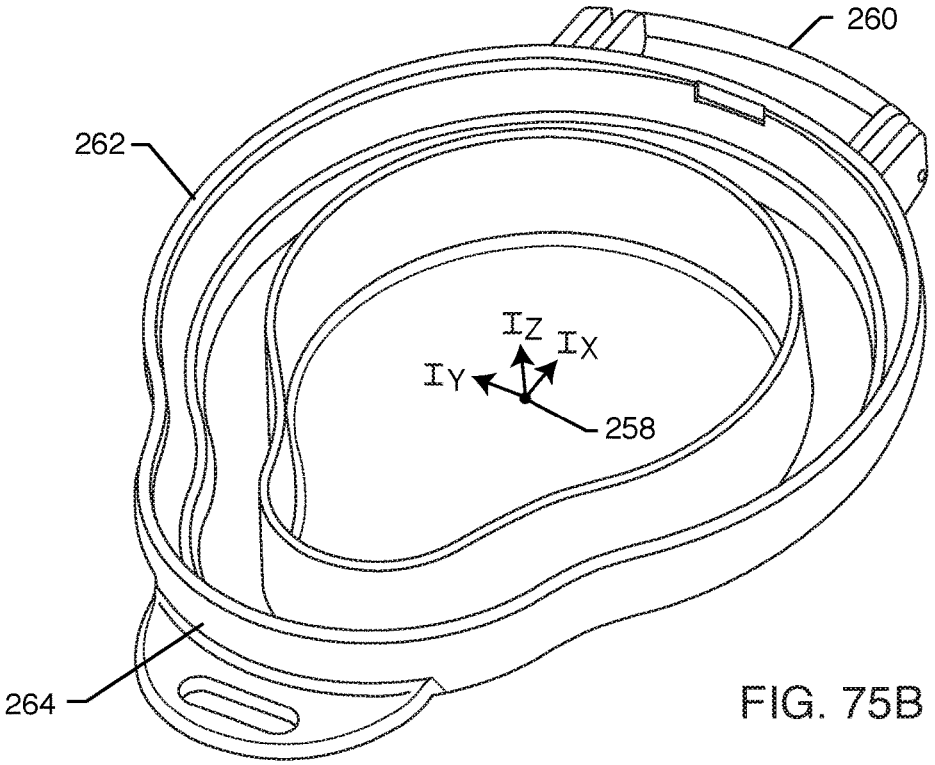
FIG. 75B is a perspective bottom view of the lid design of FIG. 75A.

Similarly, when looking at FIGS. 75A-B one can see a three-dimensional (Cartesian) coordinate system 258 located at its center of mass. The lid coordinate system 258 has a x-axis (Ix) pointing towards a top 260 (opposite the bottom 264) of the frame, a y-axis (Iy) pointing towards a side 262 of the frame and a z-axis (Iz) pointing through the frame aperture towards the inside of the pair of pants and/or waders. Regarding the new embodiments of the lid in FIG. 79, the frame coordinate system is now 258'.

Figure 84:
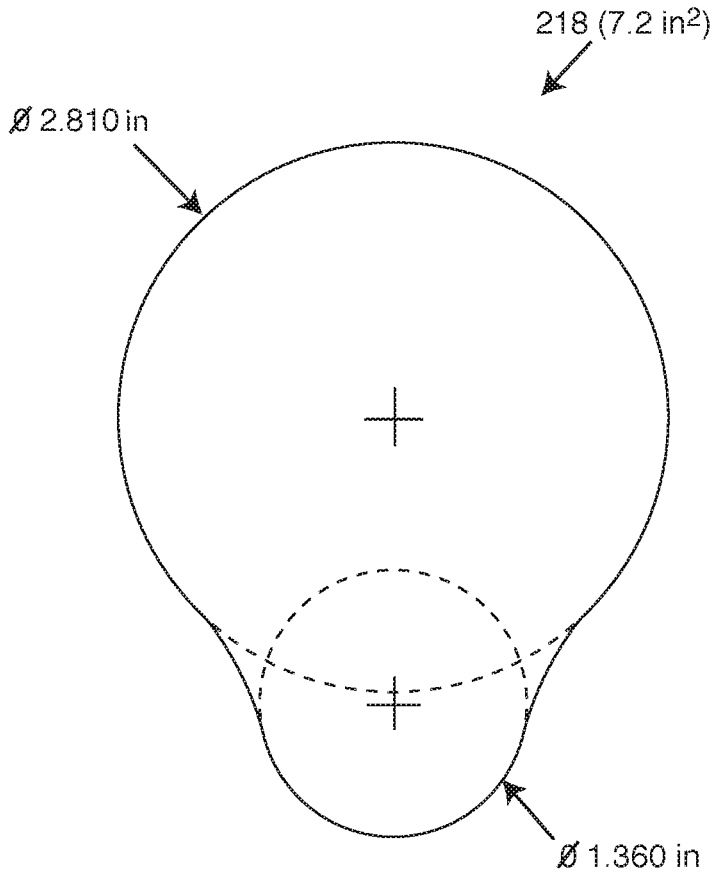
FIG. 84 is similar to FIG. 73 now showing the dimensions of a particular aperture sizing.

FIG. 84 is a top view of the size and shape of the aperture 218 used in FIGS. 74-83 which was previously shown and taught in FIG. 73. FIG. 84 is depicting the area of just the aperture 218 which is approximately 7.205 square inches ($in^2$). The shape can be generally described as a smaller diameter circle (1.360 inches in diameter) that overlaps a larger diameter circle (2.810 inches in diameter). Other shapes of the aperture could be used as this particular shape is not intended to be limiting. For example, the frame aperture shape could simply be a circle. That is why the inventors have calculated the overall all area to be approximately 7.205 square inches.

As one either scales the overall design of the urinary relief hatch assembly 108 up or scales the overall design down, the mass moments of inertias will correspondingly change. This may be desired because various sizes of the present invention are desired. For example a child's version, or a small, medium and large version could be manufactured. Therefore, the claims have been drafted to account for this variable to allow one design to be compared to another design even when the aperture sizes are not the same. For example, the claims include the language of when the area of the frame aperture is set to 7.205 inches (plus or minus 5, 10, 15, 20, 25 or 30 percent). If one was starting with a smaller version, it can be scaled up within a computer program while keeping all of its relative dimensions the same such that it then would have an aperture area equal to 7.2 square inches. As can now be appreciated by those skilled in the art, to compare two different designs one will set the density and the area of the frame aperture at the same values to then get a direct comparison of the mass moment of inertias. In this manner two different designs that are of different sizing can be compared for infringement purposes.

The use of the term "rigid" herein means that the material is not highly elastic nor easily deformable. For example, a rigid frame or rigid lid may be made from a variety of plastics, metals and/or composites. It is understood that all materials, even the stiffest of materials, do bend and deform to some degree under enough force and pressure. However, a rigid lid and/or rigid frame will substantially keep its shape and form when in use and subjected to normal operating conditions. This is in contrast to the seal of the present invention which is not rigid and is actually designed to deform when sandwiched between the frame and lid to facilitate the waterproof seal.

Although several embodiments have been described in detail for purposes of illustration, various modifications may be made to each without departing from the scope and spirit of the invention. Accordingly, the invention is not to be limited, except as by the appended claims.

What is claimed is:

1. A rainproof pair of pants and/or a waterproof pair of waders including a sealable opening for relief of bodily fluids, comprising:

a pair of pants and/or waders comprising a first and a second leg portion, wherein the first and the second leg portions are joined to a torso portion terminating generally at or between a waist and a neck of a wearer, wherein the pair of pants and/or waders comprise a substantially waterproof material, and wherein the pants are configured to overlap a separate pair of boots and/or the waders are configured to be integrally attached to a pair of boots;

a rigid frame sealed in a waterproof manner to the pair of pants and/or waders disposed in a groin section of the pair of pants and/or waders, wherein the frame forms a frame aperture separating an outside of the pair of pants and/or waders from an inside of the pair of pants and/or waders;

a rigid lid pivotably connected to the frame disposed on the outside of the pair of pants and/or waders and configured to engage the frame aperture, wherein the rigid lid in an open position allows access through the frame aperture and the rigid lid in a closed position does not allow access through the frame aperture;

a seal disposed between the frame and the lid forming a waterproof closure of the frame aperture when the lid is in the closed position;

a latch pivotably connected to the frame and configured to retain the lid in the closed position; and a spring disposed between the latch and the frame, the spring biasing the latch to retain the lid in the closed position.

2. The pair of pants and/or waders of claim 1, wherein the latch is a separately manufactured component in relation to the frame and/or the lid.

3. The pair of pants and/or waders of claim 1, wherein the frame and the latch are different materials.

4. The pair of pants and/or waders of claim 1, wherein the frame is plastic and wherein the latch is metallic.

5. The pair of pants and/or waders of claim 1, wherein the frame and the latch are made from different plastic materials.

6. The pair of pants and/or waders of claim 1, including a first pin attached to the frame by an interference fit, wherein the latch is pivotable about the first pin.

7. The pair of pants and/or waders of claim 1, wherein the spring is a torsion spring.

8. The pair of pants and/or waders of claim 1, including a cam formed as part of the lid and/or the frame disposed at or near a pivot between the lid and the frame, wherein the cam biases the lid into remaining in the open position once the lid is in the open position.

9. The pair of pants and/or waders of claim 1, wherein the frame defines a three-dimensional coordinate system located at its center of mass, the frame coordinate system having a x-axis pointing towards a top of the frame, a y-axis pointing towards a side of the frame and a z-axis pointing through the frame aperture towards the inside of the pair of pants and/or waders; wherein, when the density of the frame is first set to be 0.04 pounds per cubic inch (lbs*in$^3$) and when the frame and lid are scaled so an area of the frame aperture is first set to be 7.205 inches squared (in$^2$), then the following is true:

a mass moment of inertia taken at the frame center of mass about the frame x-axis is equal to or greater than 0.19 pound square feet (lbs*in$^2$); and a mass moment of inertia taken at the frame center of mass about the y-axis is equal to or greater than 0.27 pound square feet (lbs*in$^2$).

10. The pair of pants and/or waders of claim 1, wherein the frame defines a three-dimensional coordinate system located at its center of mass, the frame coordinate system having a x-axis pointing towards a top of the frame, a y-axis pointing towards a side of the frame and a z-axis pointing through the frame aperture towards the inside of the pair of pants and/or waders; wherein the lid defines a three-dimensional coordinate system located at its center of mass, the lid coordinate system having a x-axis pointing towards a top of the lid, a y-axis pointing towards a side of the lid and a z-axis pointing towards the inside of the pair of pants and/or waders; wherein, when the density of the frame and lid are the same, a mass moment of inertia taken at the frame center of mass about the frame x-axis and frame y-axis are greater respectively than a mass moment of inertia taken at the lid center of mass about a lid x-axis and a lid y-axis.

11. The pair of pants and/or waders of claim 1, wherein, when the frame and lid are scaled so an area of the frame aperture is first set to be 7.205 inches squared (in2), then the following is true:

the frame has a surface area equal to or greater than 45.97 square inches (in2); and the lid has a surface area equal to or less than 61 square inches (in2).

12. The pair of pants and/or waders of claim 1, wherein, when the frame and lid are scaled so an area of the frame aperture is first set to be 7.205 inches squared (in2), then the following is true:

the lid has a volume equal to or less than 3.50 cubic inches (in3); and the volume of the frame is equal to or greater than 2.64 cubic inches (in3).

13. The pair of pants and/or waders of claim 1, wherein the frame aperture comprises a shape of a larger circular arc at least partially overlapping a smaller circular arc, wherein the larger circular arc is disposed at a top of the frame aperture and the smaller circular arc is disposed at a bottom of the frame aperture.

14. The pair of pants and/or waders of claim 1, wherein the frame aperture comprises a shape of a larger contoured aperture at least partially overlapping a similarly shaped smaller contoured aperture, wherein the larger contoured aperture is disposed at a top of the frame aperture and the smaller contoured aperture is disposed at a bottom of the frame aperture.

15. The pair of pants and/or waders of claim 1, including an adhesive bond disposed between a back side surface of the frame and the waterproof material of the pair of pants and/or waders, wherein the back side surface of the frame comprises a non-smooth surface.

16. The pair of pants and/or waders of claim 1, including a rigid backing forming a backing aperture, wherein a first surface of the backing and a back side surface of the frame capture there between the waterproof material of the pair of pants and/or waders in the groin section; including at least one adhesive bond disposed between the back side surface of the frame and the waterproof material of the pair of pants and/or waders, and/or, between the first surface of the backing and the waterproof material of the pair of pants and/or waders; wherein the backing aperture and frame aperture are substantially aligned; and wherein the backing aperture is equal to or greater in surface area in comparison to the frame aperture.

17. The pair of pants and/or waders of claim 1, wherein a middle line is defined horizontally across the frame aperture equal distance between a top and a bottom of the frame aperture separating a top half of the frame aperture from a bottom half of the frame aperture, wherein the top half of the frame aperture comprises a larger amount of surface area as compared to the bottom half.

18. The pair of pants and/or waders of claim 1, including a weld, a hot air weld, a hot wedge weld, a radio frequency weld, a sonic weld or an ultrasonic weld attaching the waterproof material of the pair of pants and/or waders to the frame.

19. A rainproof pair of pants and/or a waterproof pair of waders including a sealable opening for relief of bodily fluids, comprising:

a pair of pants and/or waders comprising a first and a second leg portion, wherein the first and the second leg portions are joined to a torso portion terminating generally at or between a waist and a neck of a wearer, wherein the pair of pants and/or waders comprise a substantially waterproof material, and wherein the pants are configured to overlap a separate pair of boots and/or the waders are configured to be integrally attached to a pair of boots;

a rigid frame sealed in a waterproof manner to the pair of pants and/or waders disposed in a groin section of the pair of pants and/or waders, wherein the frame forms a frame aperture separating an outside of the pair of pants and/or waders from an inside of the pair of pants and/or waders;

a rigid lid pivotably connected to the frame disposed on the outside of the pair of pants and/or waders and configured to engage the frame aperture, wherein the rigid lid in an open position allows access through the frame aperture and the rigid lid in a closed position does not allow access through the frame aperture;

a seal disposed between the frame and the lid forming a waterproof closure of the frame aperture when the lid is in the closed position;

a latch pivotably connected to the frame and configured to retain the lid in the closed position;

a torsion spring disposed between the latch and the frame, the torsion spring biasing the latch to retain the lid in the closed position wherein the latch is a separately manufactured component in relation to the frame and/or the lid; and wherein the frame and the latch are different materials.

20. A rainproof pair of pants and/or a waterproof pair of waders including a sealable opening for relief of bodily fluids, comprising:

a pair of pants and/or waders comprising a first and a second leg portion, wherein the first and the second leg portions are joined to a torso portion terminating generally at or between a waist and a neck of a wearer, wherein the pair of pants and/or waders comprise a substantially waterproof material, and wherein the pants are configured to overlap a separate pair of boots and/or the waders are configured to be integrally attached to a pair of boots;

a rigid frame sealed in a waterproof manner to the pair of pants and/or waders disposed in a groin section of the pair of pants and/or waders, wherein the frame forms a frame aperture separating an outside of the pair of pants and/or waders from an inside of the pair of pants and/or waders;

a rigid lid pivotably connected to the frame disposed on the outside of the pair of pants and/or waders and configured to engage the frame aperture, wherein the rigid lid in an open position allows access through the frame aperture and the rigid lid in a closed position does not allow access through the frame aperture;

a seal disposed between the frame and the lid forming a waterproof closure of the frame aperture when the lid is in the closed position; and a cam formed as part of the lid and/or the frame disposed at or near a pivot between the lid and the frame, wherein the cam biases the lid into remaining in the open position once the lid is in the open position.

* * * * *